US008418742B2

(12) United States Patent
Anderson et al.

(10) Patent No.: US 8,418,742 B2
(45) Date of Patent: Apr. 16, 2013

(54) SINGLE CORD DRIVE FOR COVERINGS FOR ARCHITECTURAL OPENINGS

(75) Inventors: Richard N. Anderson, Whitesville, KY (US); Steven R. Haarer, Whitesville, KY (US); Donald E. Fraser, Owensboro, KY (US); Robert E. Fisher, II, Owensboro, KY (US)

(73) Assignee: Hunter Douglas, Inc., Upper Saddle River, NJ (US)

( * ) Notice: Subject to any disclaimer, the term of this patent is extended or adjusted under 35 U.S.C. 154(b) by 0 days.

(21) Appl. No.: 12/906,341

(22) Filed: Oct. 18, 2010

(65) Prior Publication Data

US 2011/0031343 A1 Feb. 10, 2011

Related U.S. Application Data

(62) Division of application No. 12/098,067, filed on Apr. 4, 2008, now Pat. No. 7,836,937, which is a division of application No. 10/819,690, filed on Apr. 7, 2004, now Pat. No. 7,380, 582.

(60) Provisional application No. 60/641,549, filed on Apr. 9, 2003.

(51) Int. Cl.
*E06B 9/17* (2006.01)

(52) U.S. Cl.
USPC ..... 160/308; 160/323.1

(58) Field of Classification Search ..... 160/291, 160/292, 305, 307, 308, 323.1, 121.1, 84.05, 160/170, 171, 313, 242, 319, 133, 370.22
See application file for complete search history.

(56) References Cited

U.S. PATENT DOCUMENTS

| | | | | |
|---|---|---|---|---|
| 1,267,016 | A * | 5/1918 | Underwood | 160/242 |
| 1,325,105 | A * | 12/1919 | Minnis | 160/242 |
| 1,388,346 | A | 8/1921 | Kirsch | |
| 1,476,160 | A | 12/1923 | Kirsch | |
| 1,527,342 | A | 2/1925 | Anderson | |
| 1,799,137 | A | 3/1931 | Simpson | |
| 1,838,320 | A | 12/1931 | Moore | |
| 1,841,384 | A * | 1/1932 | Schmelz | 160/298 |
| 2,056,823 | A | 10/1936 | Brown | |
| 2,227,211 | A | 12/1940 | Bakthasar | |
| 2,240,987 | A | 5/1941 | Garbowsky | |
| 2,250,106 | A | 7/1941 | Lorentzen | |
| 2,267,869 | A | 12/1941 | Loehr | |
| 2,334,132 | A | 11/1943 | Sherwood | |
| 2,552,180 | A | 5/1951 | Kenney | |
| 2,579,144 | A | 12/1951 | Griesser | |
| 2,580,252 | A | 12/1951 | Stuber et al. | |
| 2,723,715 | A | 11/1955 | Kaulfmann et al. | |
| 2,732,010 | A | 1/1956 | Griesser | |

(Continued)

FOREIGN PATENT DOCUMENTS

| | | |
|---|---|---|
| CH | 581 257 | 9/1976 |
| CH | 672 658 | 12/1989 |

(Continued)

*Primary Examiner* — David Purol
(74) *Attorney, Agent, or Firm* — Camoriano and Associates

(57) ABSTRACT

A shade for architectural openings incorporating a single cord drive featuring automatic braking of the shade when the user releases the drive cord. In a preferred embodiment, an automatic tilt-open mechanism is provided to tilt the shade open when the shade is in the fully extended down position.

8 Claims, 72 Drawing Sheets

U.S. PATENT DOCUMENTS

| | | | | | |
|---|---|---|---|---|---|
| 2,851,098 | A | | 9/1958 | Rosenbaum | |
| 3,324,929 | A | | 6/1967 | Griesser | |
| 4,224,974 | A | | 9/1980 | Anderson et al. | |
| 4,347,885 | A | | 9/1982 | von Knorring et al. | |
| 4,372,432 | A | * | 2/1983 | Waine et al. | 192/223.4 |
| 4,411,401 | A | | 10/1983 | Anderson | |
| 4,424,851 | A | * | 1/1984 | Kohayakawa | 160/298 |
| 4,476,910 | A | * | 10/1984 | Saito | 160/291 |
| 4,492,261 | A | | 1/1985 | Chong | |
| 4,653,567 | A | | 3/1987 | Starcke et al. | |
| 4,751,953 | A | | 6/1988 | Appel et al. | |
| 4,779,662 | A | * | 10/1988 | Wilk | 160/321 |
| 4,865,109 | A | * | 9/1989 | Sherman | 160/321 |
| 5,029,629 | A | | 7/1991 | Cheng-Pei | |
| 5,042,553 | A | | 8/1991 | Schaffer et al. | |
| 5,074,350 | A | | 12/1991 | Carter | |
| 5,167,269 | A | * | 12/1992 | Abo | 160/305 |
| 5,328,113 | A | | 7/1994 | de Chevron Villette | |
| 5,353,857 | A | | 10/1994 | Anderson | |
| 5,361,822 | A | * | 11/1994 | Nijs | 160/321 |
| 5,462,105 | A | | 10/1995 | Supernak | |
| 5,464,052 | A | | 11/1995 | Wieczorek et al. | |
| 5,566,741 | A | | 10/1996 | Ogawara et al. | |
| 5,725,040 | A | | 3/1998 | Domel | |
| 5,791,393 | A | * | 8/1998 | Judkins | 160/321 |
| 5,927,370 | A | * | 7/1999 | Judkins | 160/291 |
| 5,934,354 | A | | 8/1999 | Price et al. | |
| 6,076,587 | A | | 6/2000 | Pastor | |
| 6,079,471 | A | | 6/2000 | Kuhar | |
| 6,129,131 | A | | 10/2000 | Colson | |
| 6,142,211 | A | * | 11/2000 | Judkins | 160/308 |
| 6,164,428 | A | * | 12/2000 | Berman et al. | 192/223.4 |
| 6,223,802 | B1 | | 5/2001 | Colson | |
| 6,289,964 | B1 | | 9/2001 | Colson et al. | |
| 6,457,688 | B1 | | 10/2002 | Welfonder | |
| 6,536,503 | B1 | | 3/2003 | Anderson et al. | |
| 6,546,989 | B2 | | 4/2003 | Anderson et al. | |
| 6,588,480 | B2 | | 7/2003 | Anderson | |
| 6,739,373 | B1 | | 5/2004 | Liu et al. | |
| 6,935,401 | B2 | | 8/2005 | Fraczek et al. | |
| 6,948,544 | B2 | | 9/2005 | Nien | |
| 7,380,582 | B1 | | 6/2008 | Anderson et al. | |

FOREIGN PATENT DOCUMENTS

| | | |
|---|---|---|
| DE | 29807940 | 9/1998 |
| GB | 13798 | 0/1893 |
| GB | 923205 | 4/1963 |
| GB | 931344 | 7/1963 |
| GB | 1132985 | 11/1968 |
| GB | 2163202 | 2/1986 |
| JP | 11270253 | 10/1999 |
| NZ | 154 363 | 9/1996 |

* cited by examiner

SINGLE CORD DRIVE FOR COVERINGS FOR ARCHITECTURAL OPENINGS

This application is a divisional of U.S. patent application Ser. No. 12/098,067, filed Apr. 4, 2008, which is a divisional of U.S. patent application Ser. No. 10/819,690, filed Apr. 7, 2004, which claims priority from U.S. Provisional Application Ser. No. 60/461,549, filed Apr. 9, 2003. The present invention relates to a cord drive for producing rotary motion. In the embodiments shown here, the cord drive is used for raising and lowering coverings for architectural openings such as Venetian blinds, pleated shades, and other blinds and shades. This cord drive may also be used on vertical blinds and other mechanical devices requiring rotary motion.

BACKGROUND OF THE INVENTION

Typically, a blind transport system will have a top head rail which both supports the blind and hides the mechanisms used to raise and lower or open and close the blind. Such a blind system is described in U.S. Pat. No. 6,536,503, Modular Transport System for Coverings for Architectural Openings, which is hereby incorporated by reference. In the typical top/down product, the raising and lowering of the blind is done by a lift cord suspended from the head rail and attached to the bottom rail (also referred to as the moving rail or bottom slat). The opening and closing of the blind is typically accomplished with ladder tapes (and/or tilt cables) which run along the front and back of the stack of slats. The lift cords (in contrast to the tilt cables) usually run along the front and back of the stack of slats or through holes in the middle of the slats. In these types of blinds, the force required to raise the blind is at a minimum when the blind is fully lowered, since the weight of the slats is supported by the ladder tape so that only the bottom rail is being raised at the onset. As the blind is raised further, the slats stack up onto the bottom rail, transferring the weight of the slats from the ladder tape to the lift cords, so progressively greater lifting force is required to raise the blind as the blind approaches the fully raised position.

Some window covering products are built in the reverse (bottom/up), where the moving rail, instead of being at the bottom of the window covering bundle, is at the top of the window covering bundle, between the bundle and the head rail, such that the bundle is normally accumulated at the bottom of the window when the opening is uncovered and the moving rail is at the top of the window covering, next to the head rail, when the window opening covered. There are also composite products which are able to do both, to go top/down and/or bottom/up.

In contrast to a blind, in a typical top/down shade, such as a shear horizontal window shade, the entire light blocking element wraps around a rotator rail as the shade is raised. Therefore, the weight of the shade is transferred to the rotator rail as the shade is raised, and the force required to raise the shade is thus progressively lower as the shade (the light blocking element) approaches the fully raised (fully open) position. Of course, there are also bottom/up shades and also composite shades which are able to do both, to go top/down and/or bottom/up. In the case of a bottom/up shade, the weight of the shade is transferred to the rotator rail as the shade is lowered, mimicking the weight operating pattern of a top/down blind.

Most shades may have a single covering or light blocking element which is either extended or retracted, such as a roller shade. However, there is also a type of shade which may be referred to as a variable light control shade, wherein the light-controlling element is composed of several sub-elements resembling the slats in a blind. In this type of shade, in addition to extending and retracting the overall light-blocking element, these slats may be moved relative to each other, tilting them open or closed to effect variable light control.

A wide variety of drive mechanisms is known for raising and lowering blinds and shades, and for tilting their slats. A cord drive to raise or lower the blind is very handy. It does not require a source of electrical power, and the cord may be placed where it is readily accessible, getting around many obstacles.

At this point, it is beneficial to explain that the cord (or cords) in a cord drive may be the same lift cord which attaches to the bottom slat (or bottom rail) of the blind, or the drive cords and lift cords may be totally separate and independent. To avoid confusion, we will henceforth refer to the cords attached to the cord drive as drive cords, while the cords attached to the bottom rail will be referred to as lift cords, with the understanding that, in some embodiments, the drive cord and the lift cord may be the same cord.

Known cord drives have some drawbacks. The cords in a cord drive, for instance, may be such that they are either hard to reach when the cord is way up (and the blind is in the fully lowered position), or the cord may drag on the floor when the blind is in the fully raised position.

SUMMARY OF THE INVENTION

The present invention provides a cord drive which has the advantages of prior art cord drives, plus it eliminates the problems with prior art cord drives which may be too high to reach or which may drag the floor. One embodiment of the present invention provides a single cord drive which does not require the drive cord to travel as far as the window covering. It also permits the use of this single cord drive in unpowered, underpowered, or overpowered blinds and shades.

For instance, in unpowered shades, when the drive cord lock is unlocked, the shade may lower as the drive cord winds up onto a lift spool. As soon as the user releases the cord, the drive cord may automatically lock to keep the shade in place where it was released. Pulling down on the single cord may then raise the shade, perhaps with a mechanical advantage; perhaps such that the vertical distance the drive cord travels is less than the vertical distance traveled by the shade. In the case of lightweight shades (as compared to the heavier blinds), a spring assist generally is not required to raise or lower the shades. In the case of the variable light control shades, since the shade is tilted closed as it wraps onto the rotator rail, it has a tendency to remain in the tilted closed position or to tilt open only partially when the shade is lowered. In certain embodiments of this invention, a spring mounted on the rotator rail provides the required assist to push the shade to the tilted open position once the shade is fully lowered. It may also be noted that a weighted bottom rail design, as described in U.S. Pat. No. 6,546,989, "Shifting Weight Bottom Rail" issued Apr. 15, 2003, and hereby incorporated by reference, may be used in lieu of the spring mounted on the rotator rail for the same end result, namely to push the shade to the tilted open position once the shade is fully lowered.

Also, in some of the embodiments, the distance traversed by the drive cord to fully raise or lower the shade is a fraction of the distance traversed by the shade itself. In some embodiments, the distance traversed by the drive cord is 65% or less of the distance traversed by the shade, while the force required at any point to raise or lower the shade is less than 1.5 times the weight of the shade being raised or lowered. Furthermore, even for large shades, the force required at any point to raise or lower the shade generally is less than 15 pounds, making the shade easy for anyone to use.

While various embodiments of the present invention are shown being used in typical horizontal window shades and blinds, it should be obvious to those skilled in the art that this cord drive may be used in any number of different types of mechanical drives.

DESCRIPTION OF THE PREFERRED EMBODIMENTS

Figure 1:
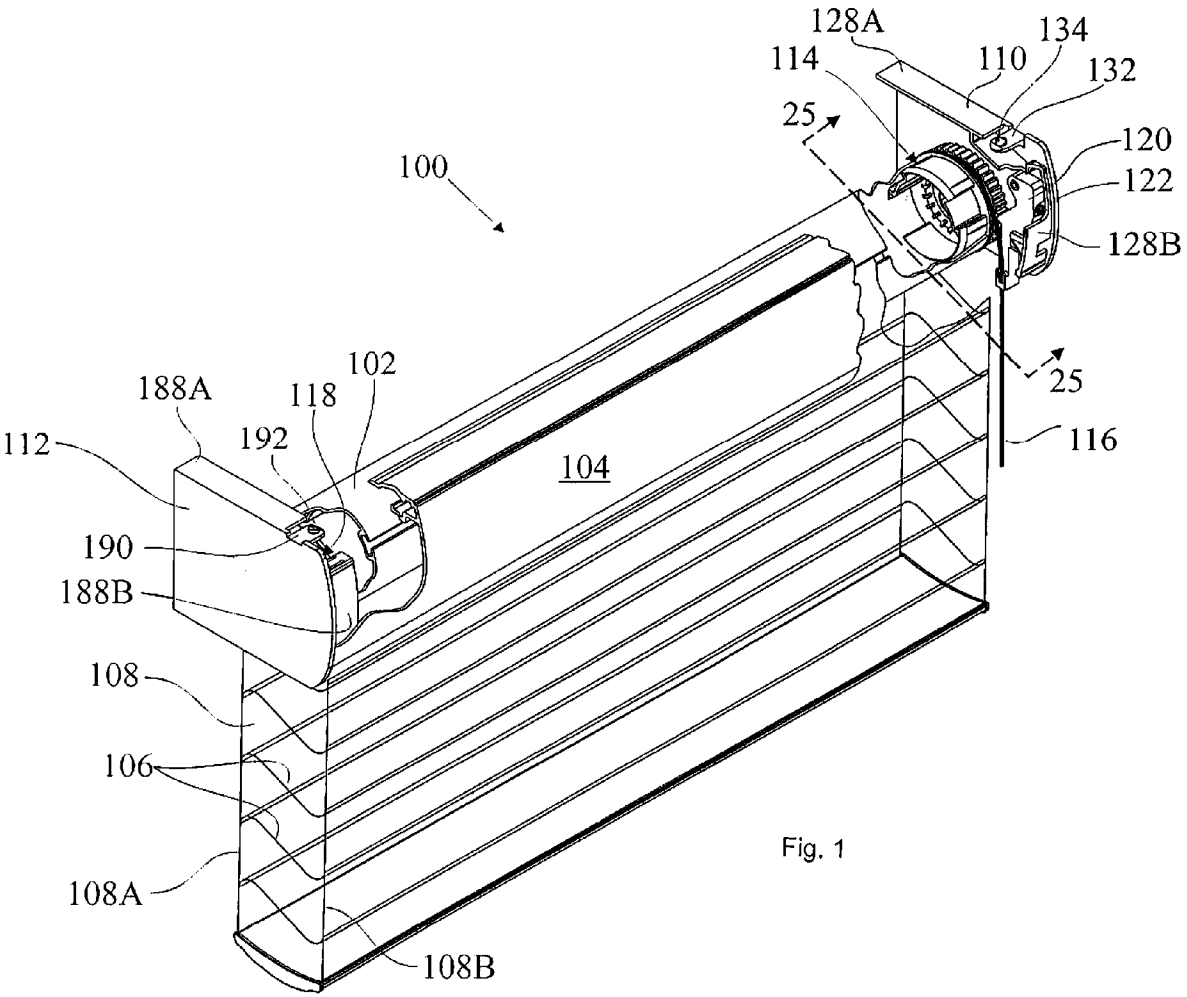
FIG. 1 is a partially broken away perspective view of a variable light control shade incorporating a cord drive with a spring assist brake and a clock spring assembly made in accordance with the present invention.

FIGS. 1 through 6 illustrate various embodiments of the present invention as it relates to horizontal variable light control shades. FIG. 1 is a partially broken away, perspective view of a first embodiment of a shade 100 utilizing a spring assist automatic brake 114 (illustrated in further detail in FIGS. 24 through 28) to hold the shade in the desired position once the drive cord is released, and a clock spring assembly 118 (illustrated in further detail in FIGS. 7 and 8) to assist in tilting the shade fully open when the shade is in the fully lowered position.

The shade 100 of FIG. 1 includes a rotator rail 102, a head rail cover 104, and a plurality of slats 106 suspended from the rotator rail 102 by means of ladder tapes 108 (108A and 108B). In this embodiment, the ladder tapes 108 extend for the full width of the blind. End caps 110 and 112 are used to mount the shade 100 to the architectural opening.

At the right end (also referred to as the control end) of the blind 100, a spring assist brake 114 (described in more detail later) attaches the first end of the rotator rail 102 to the first end cap 110. The drive cord 116 may be pulled downwardly to raise the shade, or it may be pulled forward to release the brake 114 and allow the shade to lower by gravity. As soon as the drive cord 116 is released, the brake 114 is automatically engaged to lock the shade 100 in the desired position, as will be described later.

At the left end (also referred to as the idler end) of the blind 100, a clock spring assembly 118 attaches the second end of the rotator rail 102 to the second end cap 112. As will be described in more detail later, when the shade 100 is fully lowered, the clock spring assembly 118 assists the shade 100 by forcing the rotator rail 102 to "kick over" to ensure that the slats 106 are fully open.

Spring Assist Automatic Brake

Referring now to FIGS. 24 through 28, the spring assist brake 114 of FIG. 1 includes the first end cap 110, an actuator arm 120, a biasing spring 122, a ratchet drive plug 124, and a drive cord spool and rotator rail adapter 126, as well as the drive cord 116.

Figure 24:
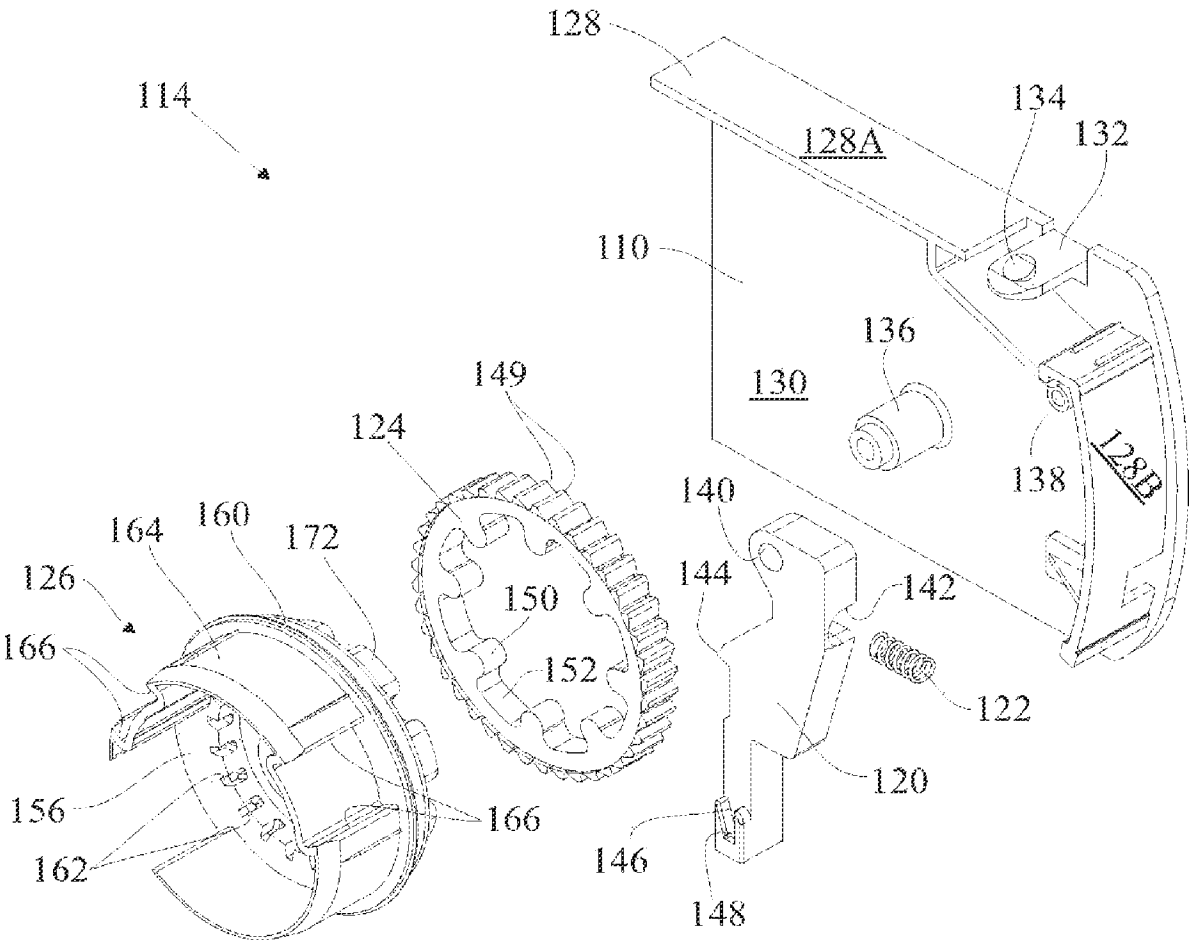
FIG. 24 is an exploded, perspective view of the spring assist brake mechanism used in the embodiment of FIG. 1.

As seen in FIG. 24, the end cap 110 includes a flange 128 projecting from and perpendicular to the inside surface 130 of the end cap 110. The flange 128 includes a top portion 128A and a front portion 128B. As will be described later, the flange 128, including a finger 132 with a nub 134, is used to attach and secure the head rail cover 104 to the end cap 110. Also projecting from the inside surface 130 of the end cap 110 is a first stub shaft 136, which defines an axis of rotation for the drive cord spool 126, and a second stub shaft 138, which defines an axis of rotation for the actuator arm 120, as described below.

Figure 26:
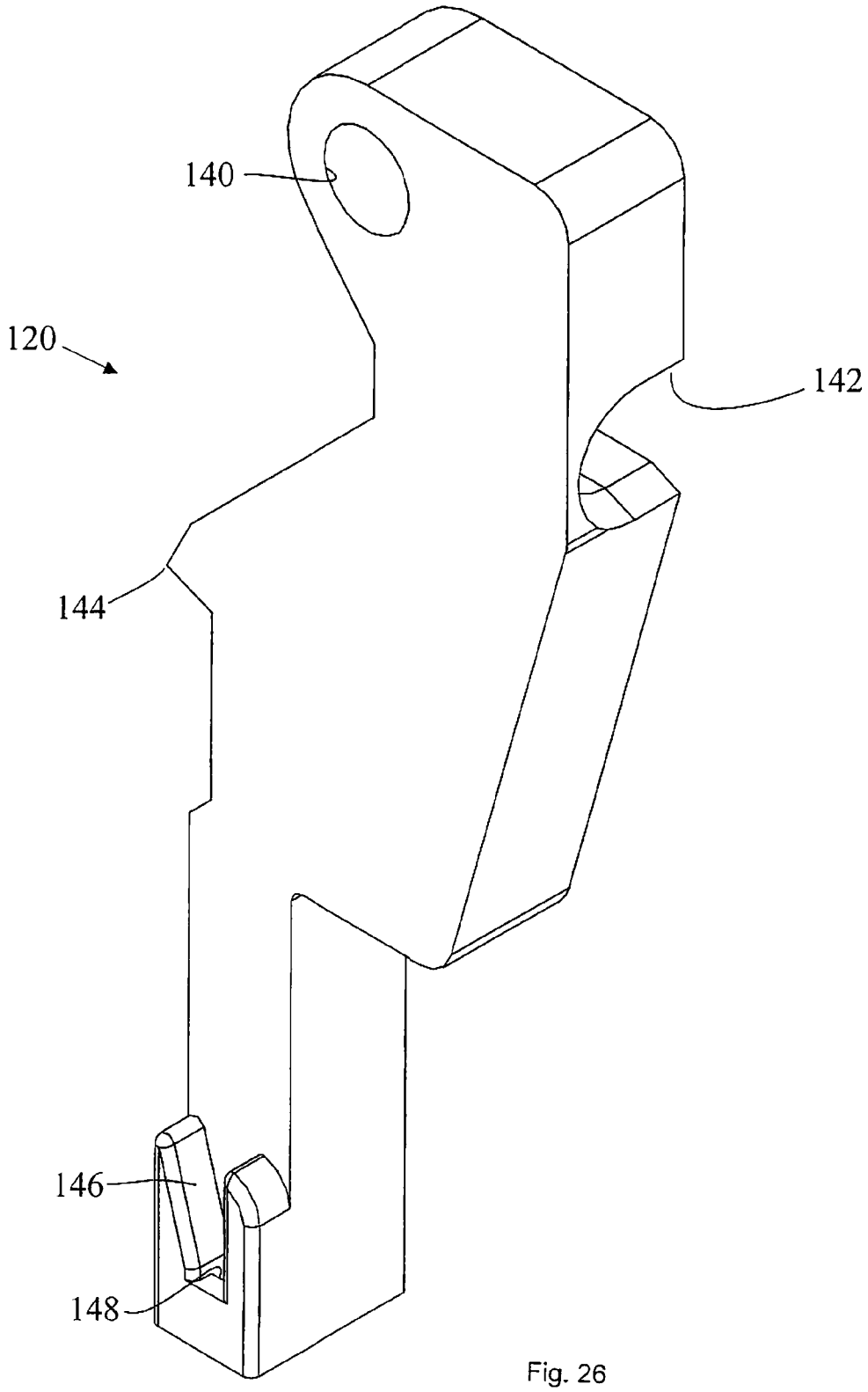
FIG. 26 is a perspective view of the brake release arm of FIG. 24.

Referring to FIG. 26, the actuator arm 120 is an elongate member with a cylindrical opening 140 adjacent its upper portion. This opening 140 fits over the second stub shaft 138 of the end cap 110. The second stub shaft 138 serves as a bearing surface, allowing the arm 120 to swing forward (toward the front portion 1288 of the flange 128) and aft, along a plane parallel to the inside surface 130 of the end cap 110, and about the axis of the second stub shaft 138.

A cavity 142 partway down the actuator arm 120 receives the biasing spring 122, such that one end of the spring 122 pushes against the arm 120 and the other end of the spring 122 pushes against the front portion 1288 of the flange 128 of the end cap 110, thus biasing the actuator arm 120 to swing aft, and pushing the arm 120 against the ratchet drive plug 124 as described below.

A nose projection 144 approximately half way down the actuator arm 120 engages against the ratchet drive plug 124 (See FIG. 25) when the spring 122 urges the arm 120 aft, preventing counter clockwise rotation (as seen from the vantage point of FIGS. 24 and 25) of the ratchet drive plug 124, which corresponds to the lowering of the shade 100 as will be described later. Adjacent the lower portion of the actuator arm 120, a saddle 146 receives the drive cord 116, which is threaded through an opening 148 in the saddle 146 so that, as the drive cord 116 is pulled by the user, the actuator arm 120 is rotationally displaced counterclockwise about the stub shaft 136, disengaging the nose 144 from the ratchet drive plug 124, as shown in FIG. 25A.

Figure 27:
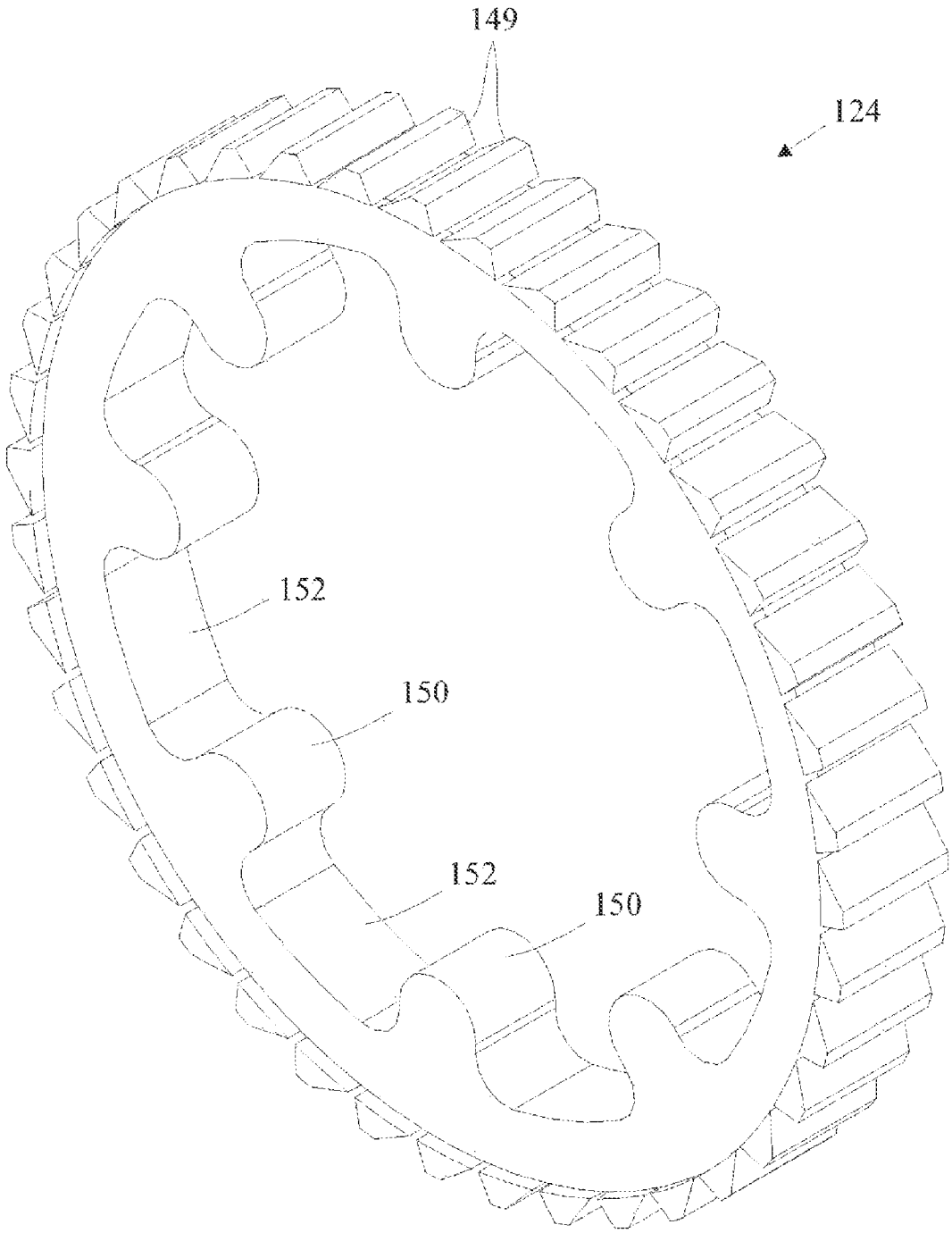
FIG. 27 is a perspective view of the ratchet gear of FIG. 24.

The ratchet drive plug 124, as seen in FIG. 27, is ring-shaped with a plurality of gear teeth 149 on its outside circumference and a pattern of peaks 150 and valleys 152 on its inside circumference. The ratchet drive plug 124 preferably is made from a softer, rubber-like material as compared with the actuator arm 120 and the drive cord spool 126, which preferably are made from a harder material such as a plastic or a metal. The rubber-like material of the ratchet drive plug 124 allows for a smoother and quieter operation, and for a longer life, of the brake assembly 114.

Figure 28:
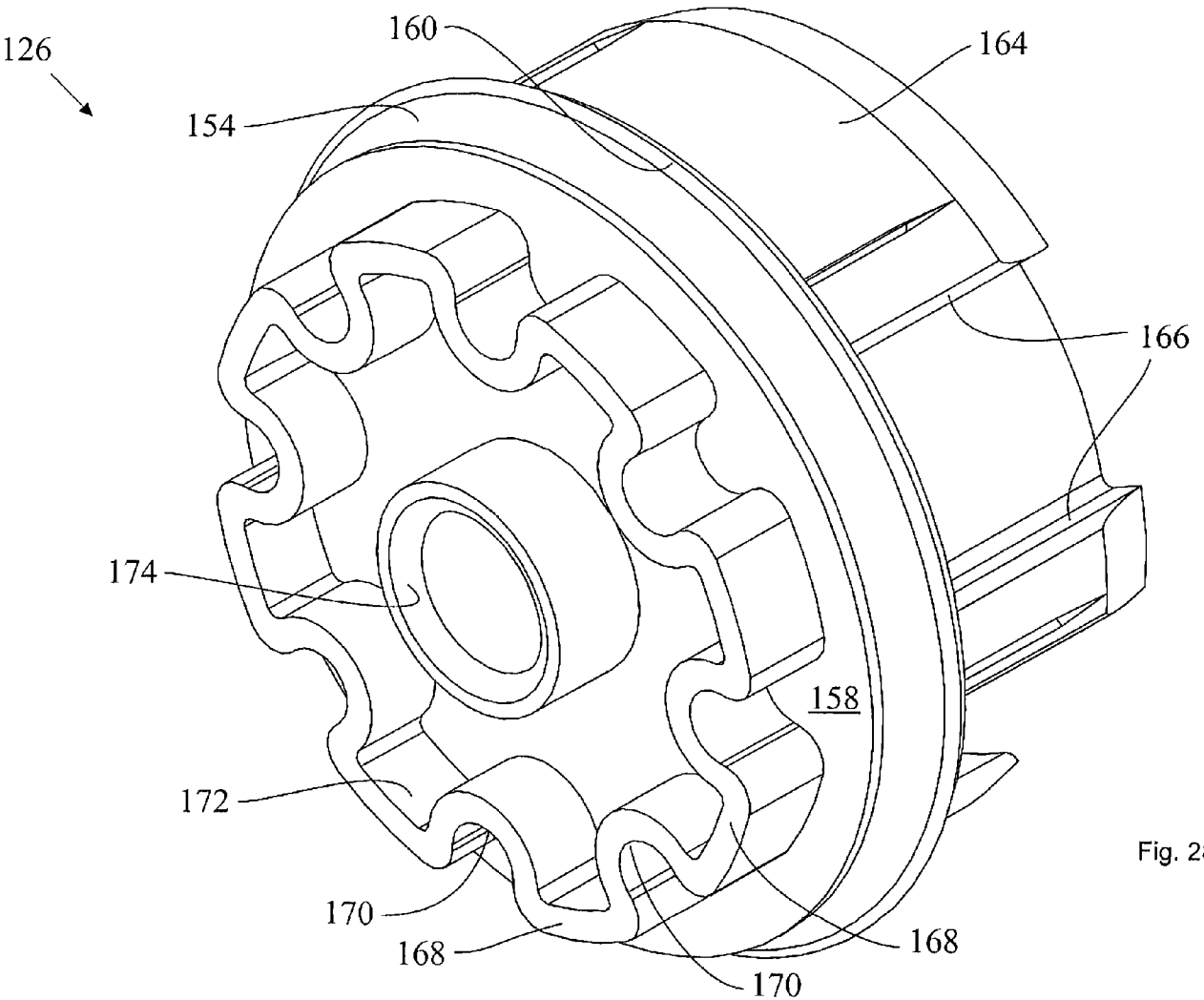
FIG. 28 is a perspective view of the drive cord spool of FIG. 24.

FIG. 28 depicts the drive cord spool and rotator rail adapter 126 (hereinafter referred to simply as the drive cord spool 126). This drive cord spool 126 defines a disk 154 having an inside surface 156 (See FIG. 24) and an outside surface 158. The outer perimeter of the disk 154 defines a groove 160, where the drive cord 116 winds up onto the spool 126 as the shade 100 is lowered. Openings 162 (See FIG. 24) extend from the inside surface 156 of the disk 154 to the groove 160 so that one end of the drive cord 116 may be fed from the groove 160 through one of the openings 162, where a knot or a grommet (not shown) is tied to the end of the drive cord 116 to secure it to the spool 126.

Preferably, the drive cord 116 is secured through an opening 162 which is closest to the bottom of the spool 126 when the shade 100 is drawn all the way up (rolled onto the rotator rail 102) and the drive cord 116 is fully extended (uncoiled from the spool 126) so that the drive cord 116 does not exert any further rotational moment on the spool 126 when the shade 100 is all the way up. A first, inwardly-projecting, semi-circular skirt 164 projects from the inside surface 156 of the disk 154, with the outside circumference of the skirt 164 matching very closely the inside contour of the rotator rail 102. The inwardly-projecting skirt 164 has shoulders 166, which match up with similar shoulders 230 in the rotator rail 102 (See FIG. 33) to ensure a positive engagement of the rotator rail 102 with the spool 126.

A second, outwardly-projecting skirt 172 with a pattern of peaks 168 and valleys 170 projects from the outside surface 158 of the disk 154. The pattern on this second skirt 172 mirrors the pattern of peaks 150 and valleys 152 on the inside of the ratchet drive plug 124 such that, when the spool 126 and the ratchet drive plug are assembled together (as seen in FIG. 25), they positively engage.

A hollow, stub shaft 174 projecting through the middle of the disk 154 receives the stub shaft 136 of the end cap 110. The stub shaft 136 of the end cap 110 supports the spool 126 for rotation about the stub shaft 136.

Figure 25:
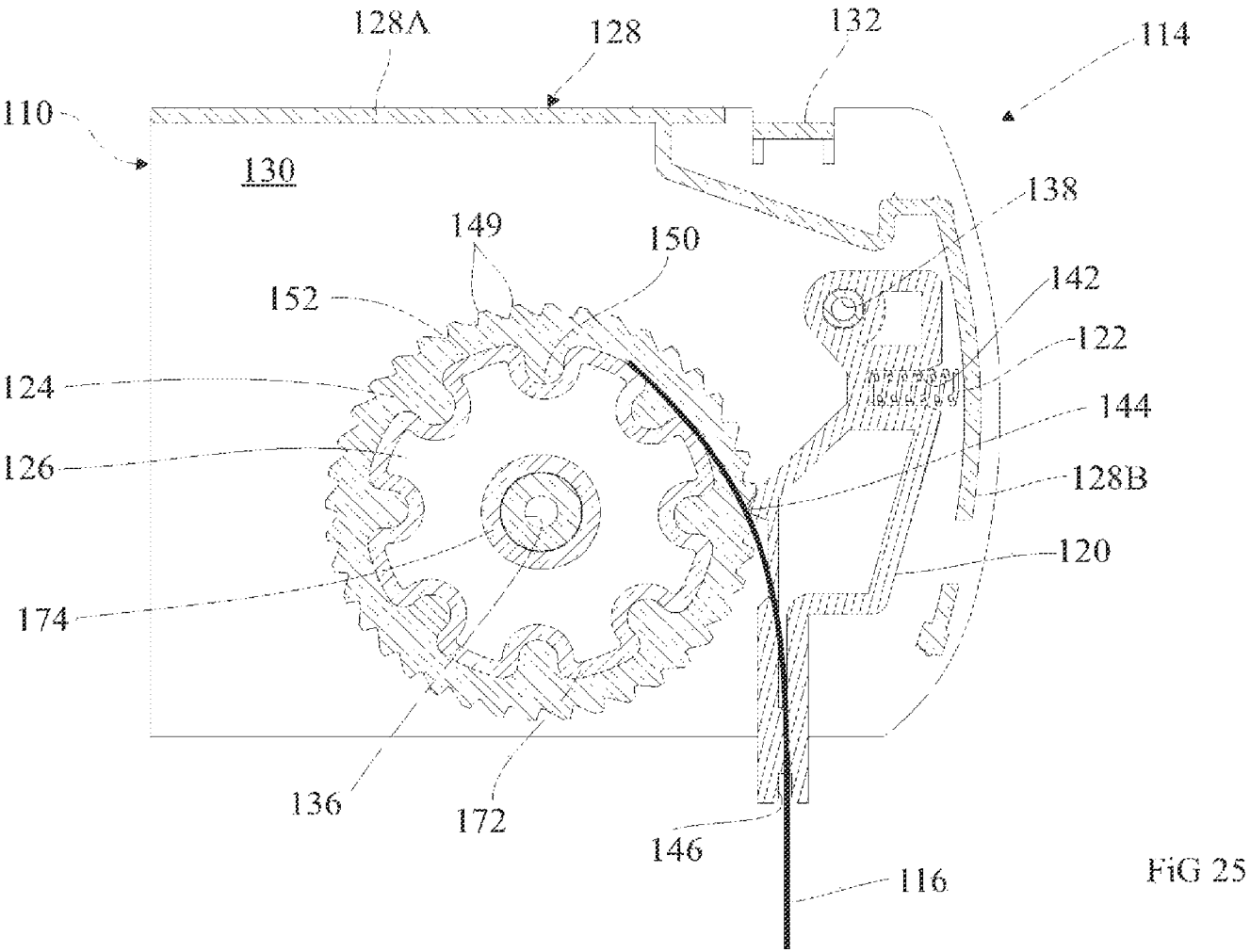
FIG. 25 is a sectional view taken along line 25-25 of FIG. 1, showing the automatic brake engaged.
Figure 25A:
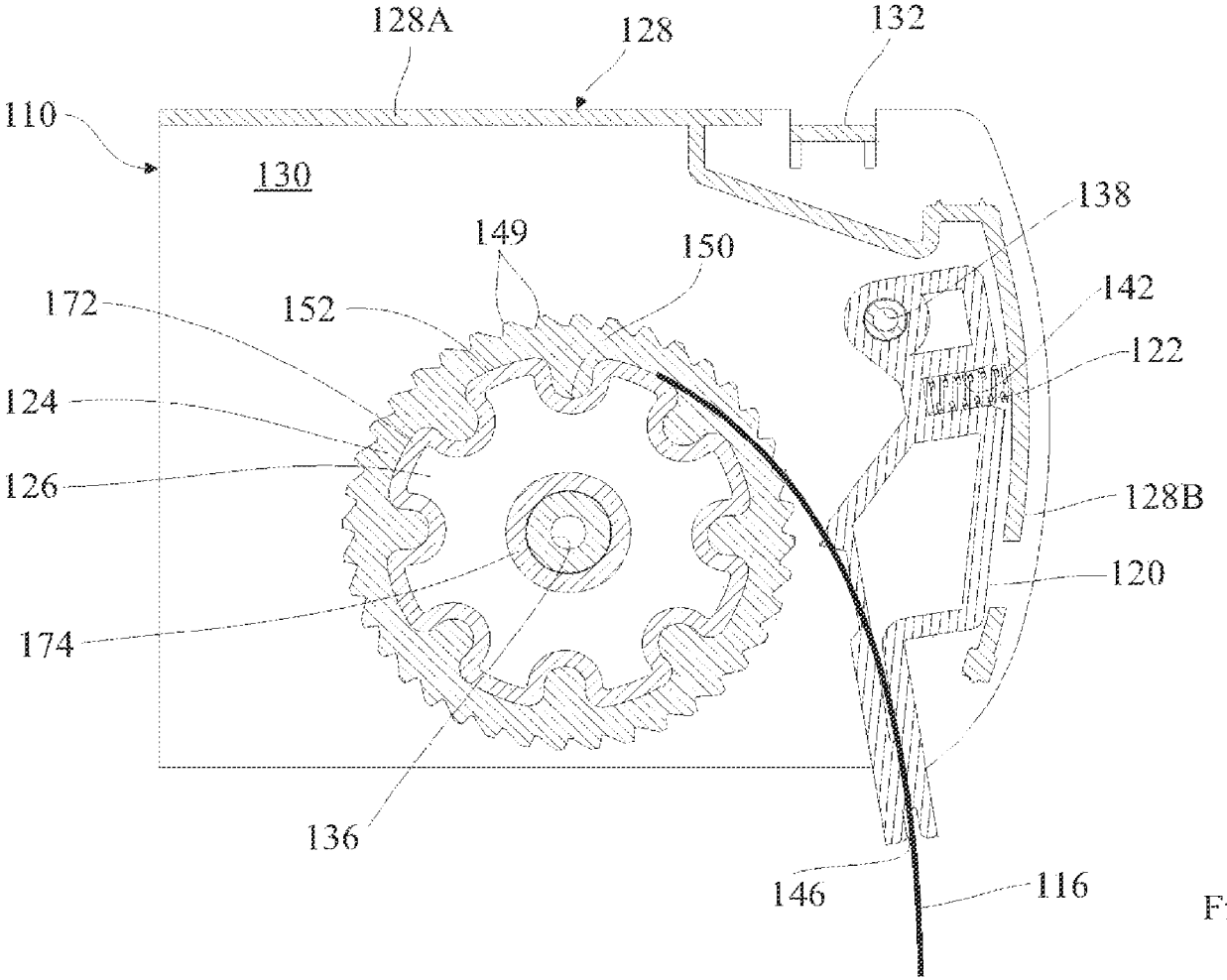
FIG. 25A is the same view as in FIG. 25 but with the automatic brake released.

FIG. 25 shows the spring assist brake assembly 114 with its components shown in their relative positions when the drive cord 116 has been released by the user and the brake is automatically engaged. The spring 122 urges the actuator arm 120 aft, until the nose projection 144 of the actuator arm 120 engages one of the gear teeth 149 of the ratchet drive plug 124. The gear teeth 149 are tapered in one direction and straight in the other, so that, when the nose projection 144 engages the gear teeth 149, it prevents counter-clockwise rotational movement of the ratchet drive plug 124 while permitting clockwise rotational movement. When the actuator arm 120 prevents counter-clockwise rotational movement of the ratchet drive plug 124, it also prevents counter-clockwise rotational movement of the spool 126 and of the rotator rail 102, which are in positive engagement with the ratchet drive plug 124, as has already been described.

Referring also to FIG. 1, the ladder tapes 108 and slats 106 of the shade 100 wrap onto the rotator rail 102 when the rotator rail 102 rotates in a clockwise direction, and they unwrap when the rotator rail 102 rotates in a counter-clockwise direction. When the drive cord 116 is released by the user, and the nose projection 144 of the arm 120 engages the gear teeth 149, preventing further counter-clockwise rotation of the rotator rail 102, the actuator arm 120 is opposing the force of gravity which is tending to unwrap the shade 100. FIG. 25A is similar to FIG. 25, except that it depicts the situation in which the user is pulling forward on the drive cord 116, causing the actuator arm 120 to rotate counterclockwise about the stub shaft 138, compressing the biasing spring 122, and releasing the nose projection 144 from the gear teeth 149, thereby releasing the brake 114. If the user slowly releases some of the drive cord 116 while maintaining some tension on the drive cord 116, such that the arm 120 is still pulled forward and the nose projection 144 of the arm 120 is not against the gears 149 of the ratchet drive plug 124, then the force of gravity acting on the ladder tapes 108 and slats 106, with assistance from the clock spring assembly 118 (as will be described later), causes the shade to unwrap (NOTE: The clock spring assembly 118 need not be part of the embodiment for it to work, as will also be described later). As the shade 100 unwraps, the rotator rail 102 rotates counter-clockwise, and the spool 126 rotates with it, causing the drive cord 116 to wrap onto the groove 160 of the spool 126.

On the other hand, pulling down on the drive cord 116 causes the spool 126 to rotate in a clockwise direction (whether or not the brake is engaged), which unwinds the drive cord 116 from the spool 126 and wraps the ladder tapes 108 and slats 106 onto the rotator rail 102, thereby raising the shade.

Clock Spring Assembly

Figure 7:
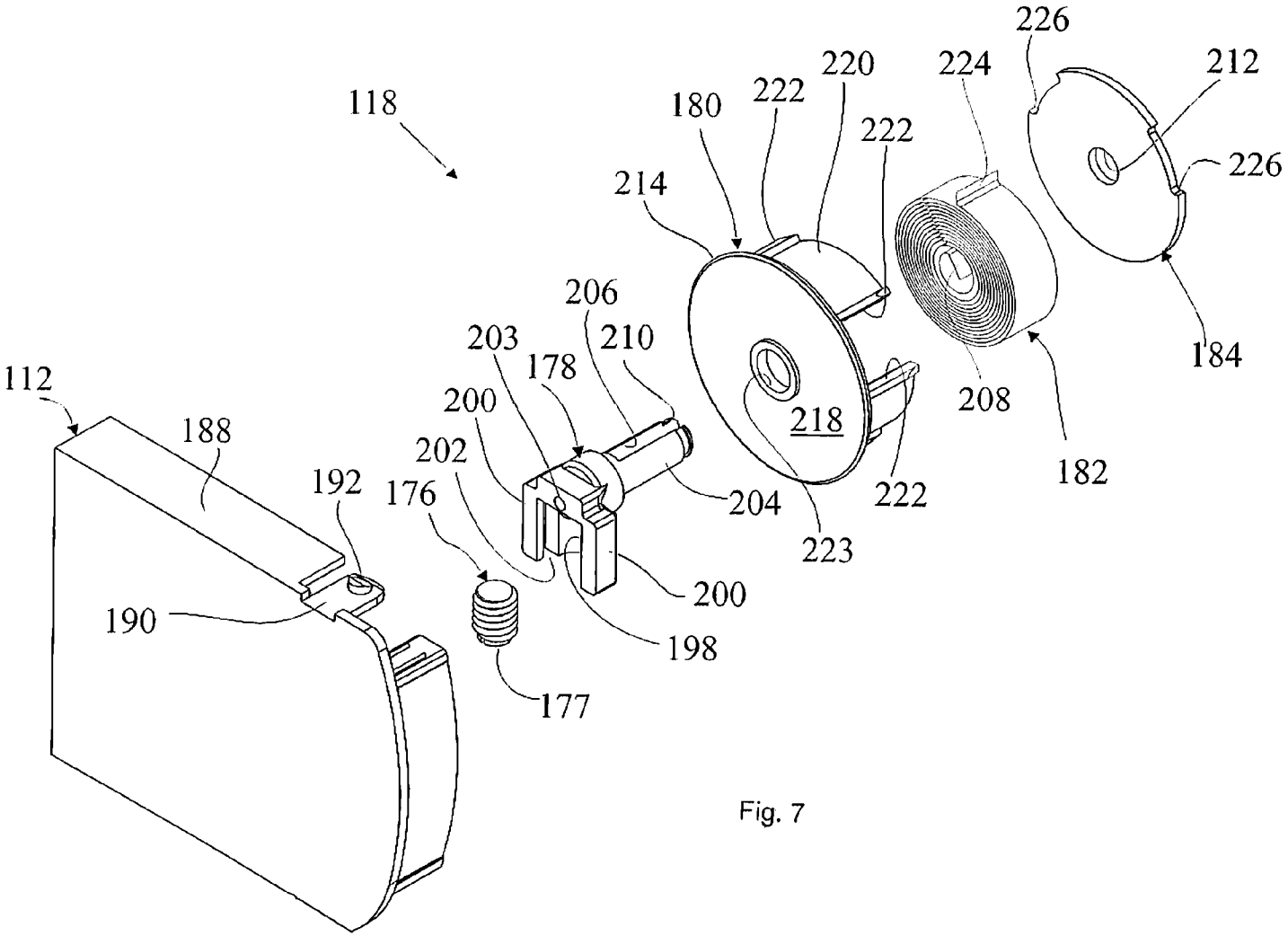
FIG. 7 is an exploded, perspective view of the clock spring mechanism which is one of the components of the embodiments of FIGS. 1, 3, and 5.
Figure 8:
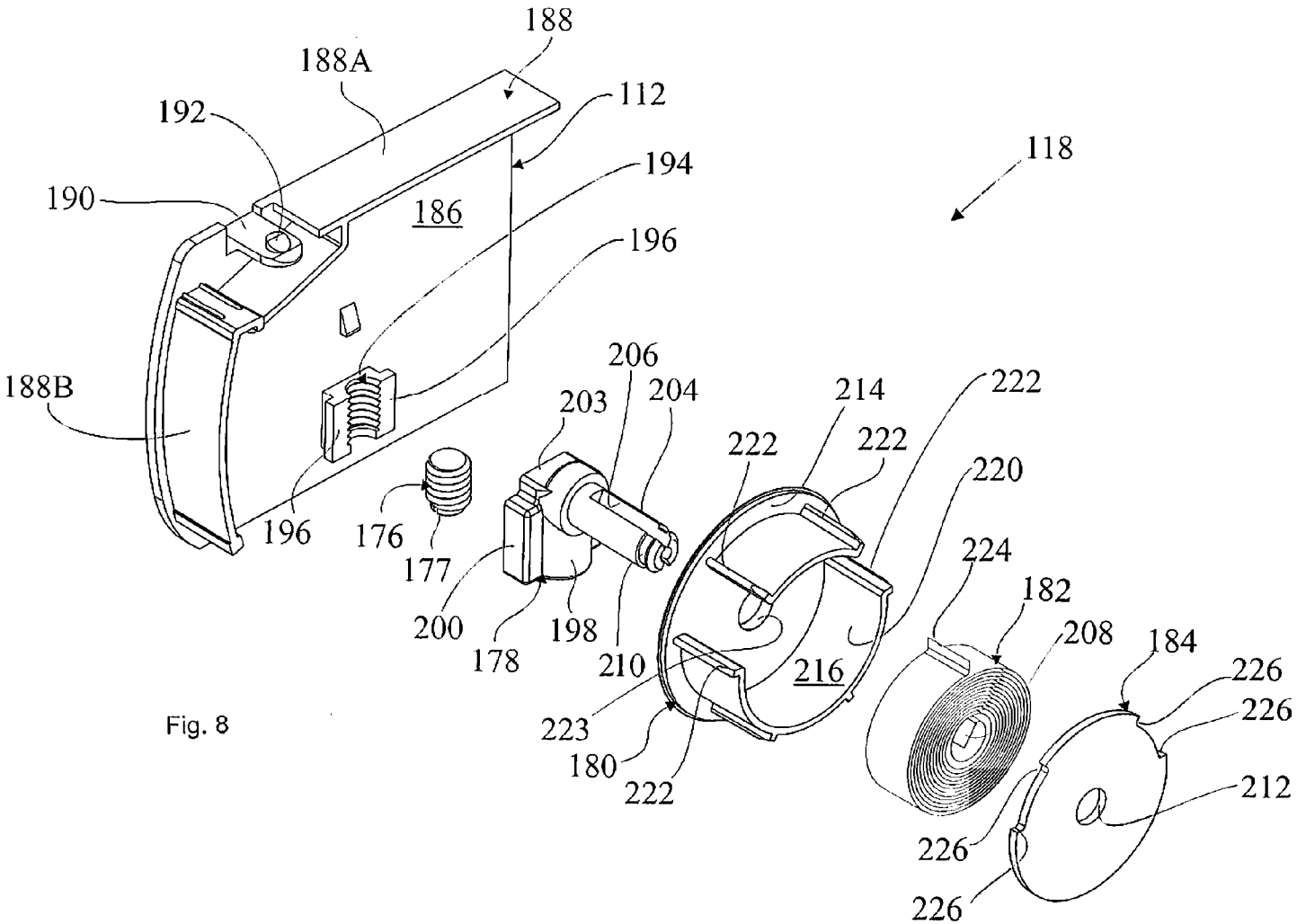
FIG. 8 is an exploded, perspective view of the clock spring mechanism of FIG. 7, but seen from the opposite end.

FIGS. 7 and 8 show the clock spring assembly 118 of FIG. 1 in more detail. The clock spring assembly 118 includes the end cap 112, a skew adjustment screw 176, a skew adjustment screw cover 178, a spring and rotator rail adapter housing 180 (hereinafter also referred to as the adapter housing 180), a clock spring 182, and a drive washer 184.

Referring to FIGS. 7 and 8, the second end cap 112 is similar to the previously described first end cap 110, except that it is designed for use on the opposite end of the shade 100, and the two stub shafts 136, 138 found in the first end cap 110 are not found in the second end cap 112. The second end cap 112 has an inside surface 186 and a flange 188 projecting inwardly from and perpendicular to the inside surface 186, including an upper flange portion 188A and a front flange portion 1888. The flange 188, including a finger 190 with a nub 192 are used to attach and secure the head rail cover 104 to the second end cap 112. Projecting inwardly from the inside surface 186 of the second end cap 112 is a half-cylindrical projection 194, elongated in the vertical direction and having a vertically-oriented longitudinal axis, which is perpendicular to the axis of rotation of the rotator rail 102. The semi-cylindrical projection 194 defines internal threads and includes short, flat flanges 196 extending the length of the projection 194 and parallel to the inside surface 186 of the end cap 112.

The skew adjustment screw cover 178 (hereinafter referred to as the skew cover 178) includes a semi-cylindrical body 198, similar to the projection 194 on the end cap 112 except that this semi-cylindrical body 198 is not threaded and, instead of having flat flanges 196 extending the length of the projection 194, it has grooved flanges 200 with internal grooves 202 designed to receive the flat flanges 196 such that, when assembled, the skew cover 178 and the projection 194 on the end cap 112 form a cylindrical shape which receives the skew adjustment screw 176 to permit the skew adjustment of the rotator rail 102 as will be described later. The skew adjustment screw 176 has a slot 177 on its bottom surface for receiving a screw driver. The skew cover 178 also includes a stop 203, which partially closes off the semi-cylindrical body 198, and a split stub shaft 204, which extends inwardly from the semi-cylindrical body 198, perpendicular to and away from the inside surface 186 of the end cap 112. A slit 206 runs the length of the split stub shaft 204, and this slit receives a first end 208 of the clock spring 182, as described later. A small, radial groove 210 at the free end of the split stub shaft 206 is received in an opening 212 on the drive washer 184, with a snap fit, thereby locking the adapter housing 180 and the clock spring 182 onto the skew cover 178 as explained below.

The adapter housing 180 defines a disk 214 with an inside surface 216 (See FIG. 8) and an outside surface 218. A semi-circular skirt 220 projects from the inside surface 216 of the disk 214, with the outside perimeter of the skirt 220 matching very closely the inside shape of the rotator rail 102. The skirt 220 has shoulders 222 which match up with similar shoulders 230 in the rotator rail 102 (See FIG. 33) to ensure a positive engagement of the rotator rail 102 with the adapter housing 180. These shoulders 222 also serve to engage the second end 224 of the clock spring 182 as is explained later. A through opening 223 in the center of the adapter housing disk 214 fits over the split stub shaft 204, allowing for rotation of the adapter housing 180 about the axis of the stub shaft 204. The drive washer 184 is a flat disk with a central opening 212, which fits over the split stub shaft 204, allowing the drive washer 184 to rotate about the axis of the stub shaft 204. The outer perimeter of the drive washer 184 also includes shoulders 226, which match up with the shoulders 222 on the skirt 220 of the adapter housing 180.

To assemble the clock spring assembly 118, the skew cover 178 is slid downwardly onto the semi-cylindrical projection 194 of the end cap 112, with the grooved flanges 200 of the skew cover 178 receiving the flanges 196 of the semi-cylindrical projection 194, until the stop 203 abuts the top of the flanges 196, to form a cylindrical recess which receives the skew adjustment screw 176. The skew adjustment screw 176, the projection 194, and the skew cover 178 are all preferably made from a resilient plastic material. This facilitates threading the adjustment screw into the cylindrical recess even though only half of the cylindrical recess is threaded (the half corresponding to the projection 194). As the adjustment screw 176 is threaded into the recess, it eventually reaches the stop 203 of the skew cover 178. Any further threading of the skew adjustment screw 176 forces the entire skew cover 178 to move upwardly relative to the projection 194 (and thus relative to the end cap 112), as the skew adjustment screw 176 pushes up against the stop 203. The actual adjustment procedure of the skew adjustment feature is described below.

Figure 37:
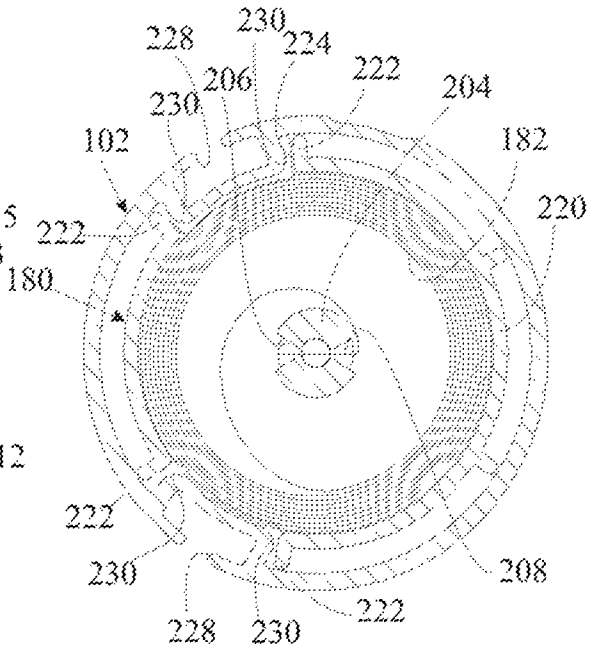
FIG. 37 is a sectional view along line 37-37 of FIG. 13 depicting a clock spring assist mechanism to tilt open the shade.

The adapter housing 180 then mounts onto the split stub shaft 204, with the outside surface 218 of the adapter housing 180 facing the end cap 112. Referring briefly to FIG. 37, the clock spring 182 then mounts inside the skirt 220 of the adapter housing 180, with the first end 208 of the spring 182 sliding into the slit 206 of the split stub shaft 204, and the second end 224 of the spring 182 resting against one of the shoulders 222 of the skirt 220 of the adapter housing 180. Then, the drive washer 184 mounts over the end of the split stub shaft 204, snapping into place on the radial groove 210, and enclosing the spring 182 inside the adapter housing 180. The assembler rotates the drive washer 184 into a position in which the shoulders 226 of the drive washer 184 are aligned up with corresponding shoulders 222 of the adapter housing 180, as shown in FIGS. 7 and 8.

Shade Assembly and Operation

Figure 33:
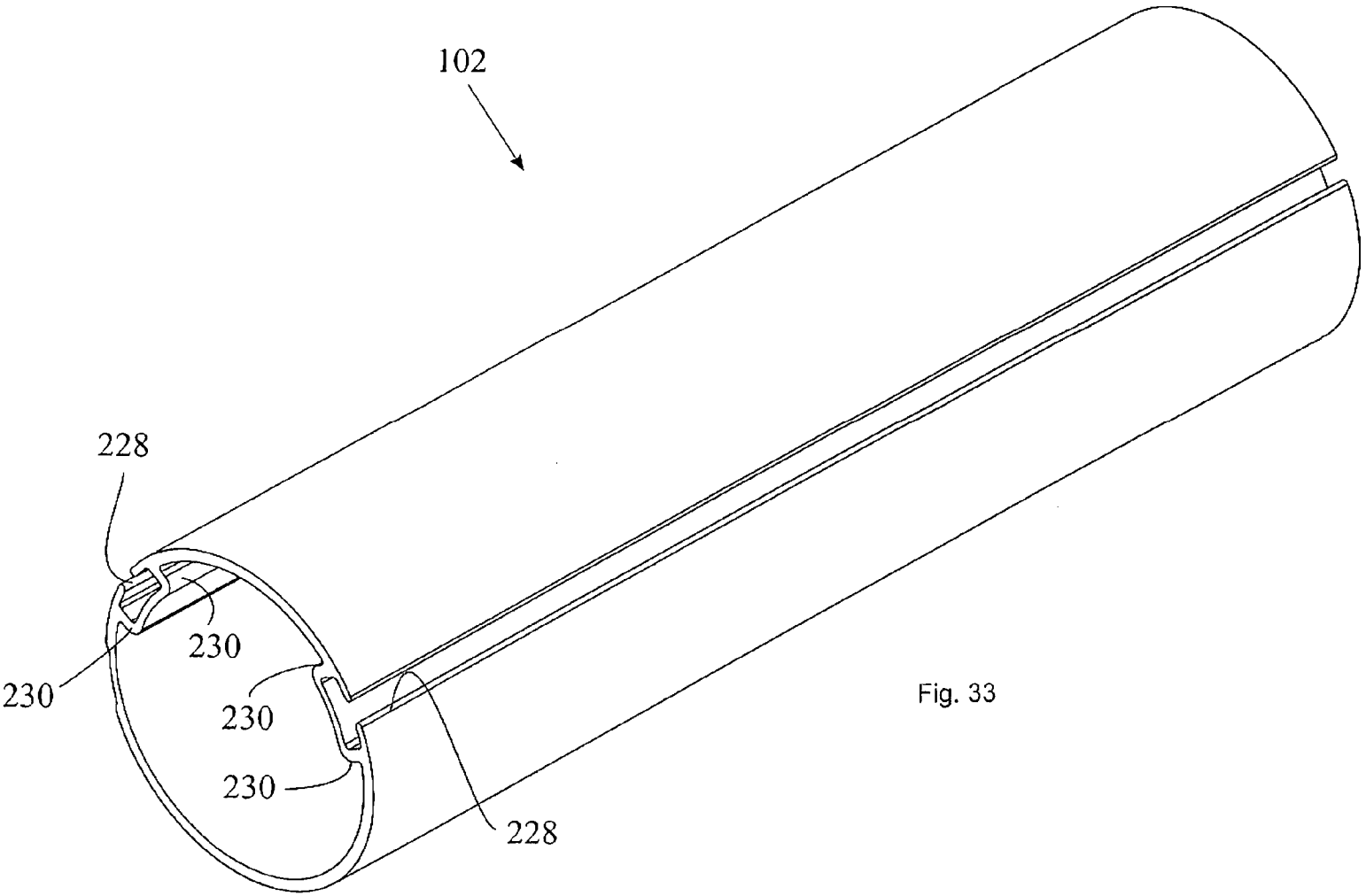
FIG. 33 is a perspective view of the rotator rail of FIGS. 13 and 14.

The rotator rail 102 is shown in detail in FIG. 33. This is a hollow cylindrical tube with two longitudinally extending grooves 228, having a T-shaped cross section, with the bottom of the "T" opening to the outside of the rail 102. The tube also has four shoulders 230, extending longitudinally along the inside surface of the rail 102 behind the grooves 228. As seen in FIG. 37, the shoulders 230 of the rail 102 are received between the shoulders 222 of the adapter housing 180, with the second end 224 of the spring 182 trapped between two adjacent shoulders 230, 222. The mating sets of shoulders 222, 230 ensure positive engagement between the adapter housing 180 and the rotator rail 102.

At the opposite end of the rotator rail 102, the drive cord spool 126 of the spring assist brake 114 (See FIG. 24) also has shoulders 166, which also receive the shoulders 230 of the rotator rail 102 to ensure positive engagement between the cord spool 126 and the rotator rail 102.

As may be appreciated from FIG. 1, the shade 100 includes ladder tapes 108. The upper edges of these ladder tapes 108 have an enlarged profile that is thicker than the bottom of the "T" grooves 228 in the rotator rail 102 but thin enough to fit into the upper portion of the "T" profile. The enlarged profiles at the upper edges of the ladder tapes 108 slide lengthwise into the grooves 228 of the rotator rail 102 with the remainder of the ladder tapes 108 extending through the bottom of the "T" to the exterior of the rotator rail 102, in order to secure the ladder tapes 108 to the rotator rail 102.

Figure 32:
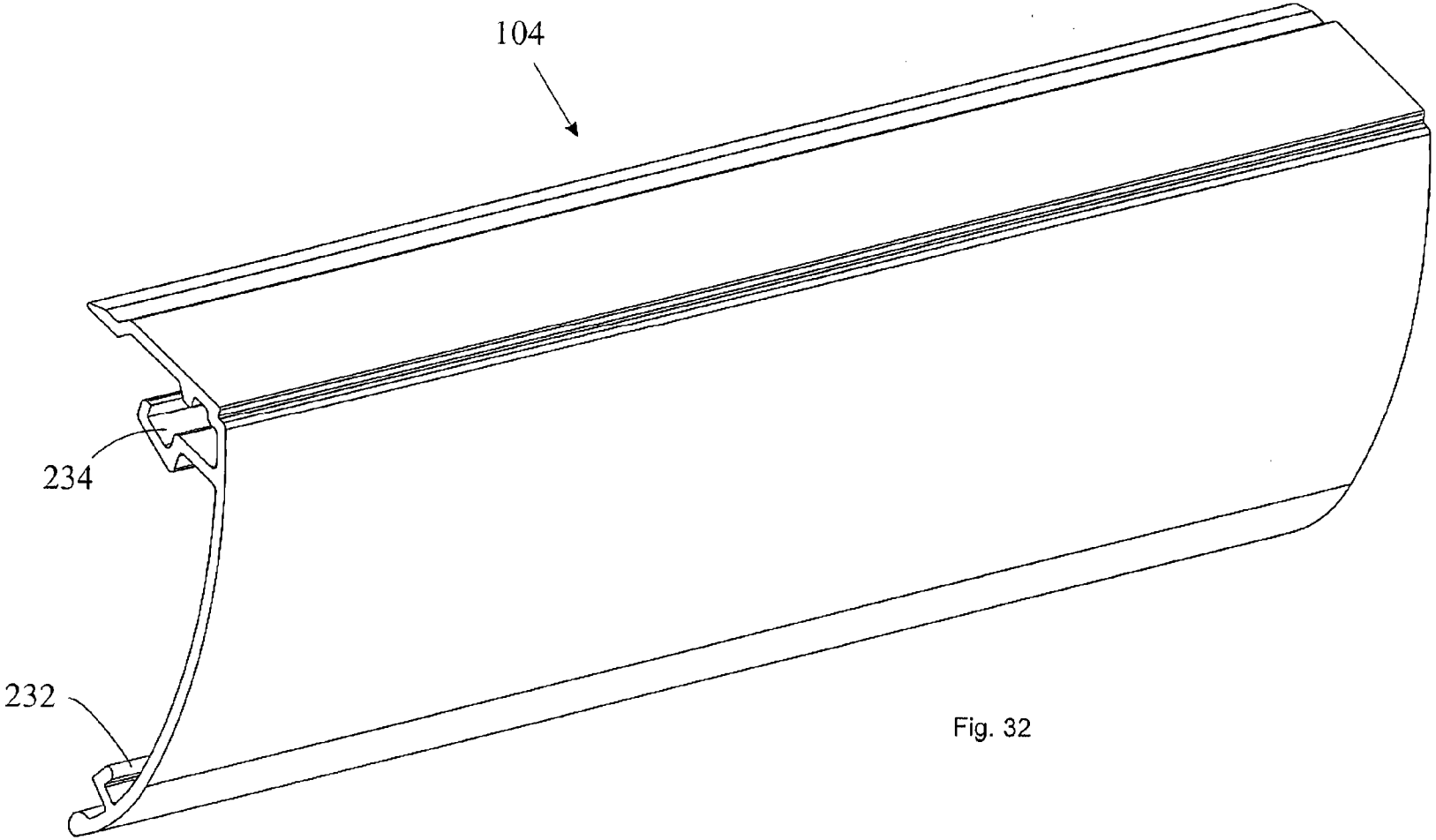
FIG. 32 is a perspective view of the head rail of FIGS. 13 and 14.

A head rail cover 104 (See FIG. 32) is installed to cover the rotator rail 102 (See FIGS. 1 and 13), with a first longitudinally extending channel 232 engaging the bottom edges of the front flanges 1288, 1888 of the end caps 110, 112, respectively, and a second longitudinally extending channel 234 engaging the fingers 132, 190 and the nubs 134, 192 of the end caps 110, 112, respectively.

Once the shade 100 is assembled, with the ladder tapes 108 and slats 106 wrapped onto the rotator rail 102, when the user pulls forward on the drive cord 116 (See FIG. 1), the automatic spring assist brake 114 is released (See FIG. 25A), because the drive cord 116 pulls on the actuator arm 120, compressing the biasing spring 122 to disengage the nose projection 144 of the actuator arm 120 from the teeth 149 of the ratchet drive plug 124. With the brake assembly 114 and rotator rail 102 free to rotate about the stub shafts 136, 204, the shade may be allowed to unwind by gravity from the rotator rail 102, with assistance from the clock spring 182, thereby wrapping the drive cord 116 onto the groove 160 of the drive cord spool 126.

If the user then pulls down on the drive cord 116, the drive cord 116 unwinds from the drive cord spool 126, causing the rotator rail 102 to rotate clockwise (as seen from FIG. 25A), wrapping the ladder tapes 108 and slats 106 onto the rotator rail 102 to raise the shade (and also winding up the clock spring 182 of the clock spring assembly 118 as described below).

At the opposite end of the rotator rail 102 (see FIG. 37), as the shade is being raised, the clock spring assembly 118 is also rotating about the split stub shaft 206 of the skew cover 178, with the outer end 224 of the clock spring 182 rotating clockwise, and the inner end 208 of the clock spring 182 remaining fixed in the slit 206 on the stub shaft 204. Thus, as the shade is being raised, the clock spring 182 is being uncoiled, creating potential energy in the spring 182, which will later be used to help lower the shade 100 and kick the slats 106 into the open position when the shade 100 is fully lowered. Of course, it will be obvious to those skilled in the art that this mechanism may be readily reversed such that as the shade is being raised, the clock spring 182 is being coiled (instead of being uncoiled), assisting in raising the shade 100.

The outside diameter of the groove 160 where the drive cord 116 winds up onto the drive cord spool 126 is less than the outside diameter of the rotator rail 102. The drive cord 116 is very thin, so that the effective outside diameter of the groove 160 onto which the drive cord 116 winds is not noticeably increased even when the entire drive cord 116 is wound up onto the drive cord spool 126 which corresponds to when the shade 100 is fully raised. However, when the shade 100 is being raised, the ladder tapes 108 and slats 106 wind up onto the rotator rail 102 such that the effective outside diameter of the rotator rail 102 in combination with the ladder tapes 108 and slats 106 is substantially increased. The net effect is that the drive cord 116 is not required to travel as far as the full length of the ladder tapes 108 to effect a full raising or lowering of the shade 100. In fact, in this embodiment, the drive cord 116 travels a distance which is approximately half (and preferably no more than 65% of) the full length of the ladder tapes 108 to effect a full raising or lowering of the shade 100. Furthermore, the aspect ratio of the rotator rail 102 and the groove 160 preferably is selected such that the force required at any given point to raise or lower the shade does not exceed either 1.5 times the weight of the shade or 15 pounds. These guidelines for total travel distance of the drive cord and for maximum force required to raise or lower the shade may apply to any of the embodiments.

As discussed earlier, the drive cord 116 is preferably secured to the spool 126 by extending through an opening 162 (See FIG. 24) which is closest to the bottom of the spool 126 when the ladder tapes are fully rolled onto the rotator rail 102, and the drive cord 116 is fully extended (uncoiled from the drive cord spool 126), so that the drive cord 116 is unable to exert any further rotational moment to the spool 126 when the shade 100 is fully raised.

As the shade 100 is being raised, it is possible for the ladder tapes 108 to want to "creep" along the length of the rotator rail 102 if the rotator rail 102 is not mounted substantially parallel to the horizon (substantially horizontal). If this is the case, the skew adjustment screw 176 may be used to bring the rotator rail 102 to a substantially horizontal position by inserting a screwdriver into the groove 177 at the bottom of the skew adjustment screw 176 and rotating the skew adjustment screw 176 in order to move the skew adjustment screw cover 178 up or down to raise or lower the left end of the rotator rail 102 as required.

If the user then slowly releases the drive cord 116 while maintaining some tension on the drive cord 116, such that the actuator arm 120 continues to be held back away from the ratchet drive plug 124, the force of gravity pulls down on the ladder tapes 108, which, together with the force of the clock spring 182, causes the shade to unwind. The rotator rail 102 is now rotating counter-clockwise (as seen from FIGS. 1, 25A, and 37) until the shade 100 is fully extended or until the user releases the drive cord 116. The clock spring 182 is coiling itself back up during this operation, with its outer end 224 rotating counter-clockwise and its inner end 208 still fixed in the stationary slot 206.

If the user releases the drive cord 116 so that there is no longer any tension on the drive cord holding the actuator arm 120 away from the ratchet drive plug 124, the biasing spring 122 urges the actuator arm 120 aft, toward the ratchet drive plug 124. This allows the nose projection 144 to contact one of the teeth 149, stopping the ratchet drive plug 124, the rest of the automatic brake assembly 114, and the rotator rail 102 from any further counter-clockwise rotation, and the shade 100 will stop lowering and will remain in that position.

Figure 34:
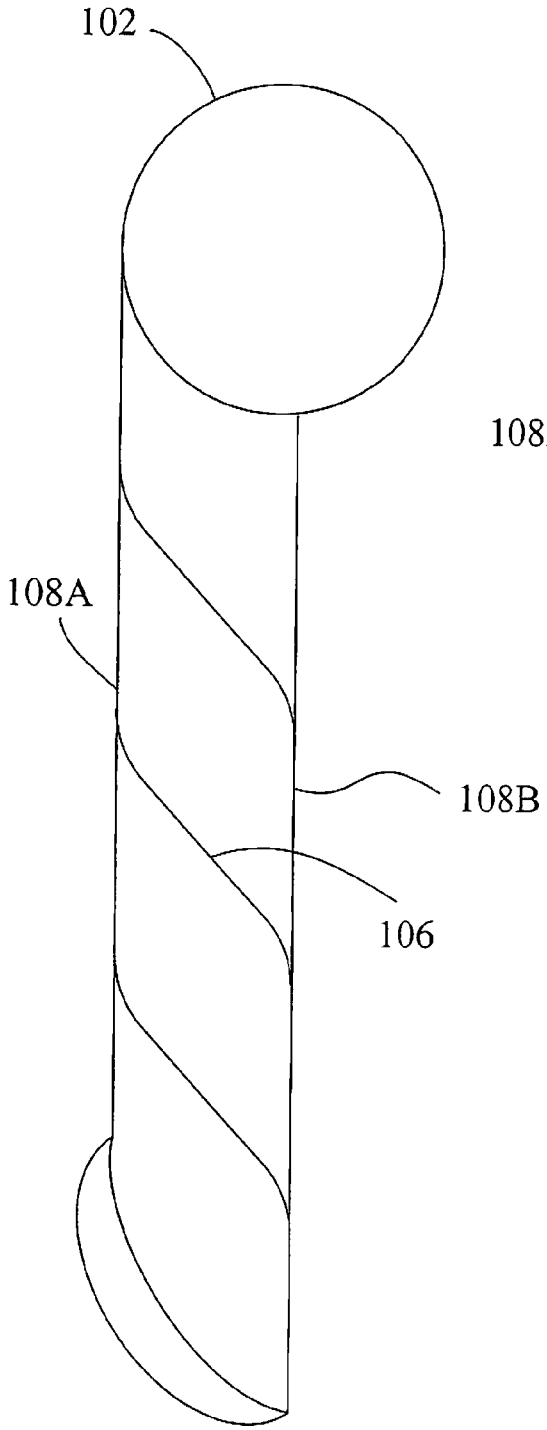
FIG. 34 is a schematic view taken from the left end of the shade of FIG. 1, showing the shade in the fully lowered position just before the spring assist operates to tilt the slats to the fully open position.

When the shade is fully lowered and starting to be raised, the rear ladder tape 108A (See FIG. 1) starts wrapping onto the rotator rail 102 before the front ladder tape 108B, so the slats 106 tilt closed before the shade begins to be raised. Similarly, as the shade 100 is being lowered, the slats travel down in the tilted closed position and cannot tilt open until the shade is fully lowered. The slats 106 tend to remain tilted closed or to tilt open only partially (as seen schematically in FIG. 34) when the ladder tapes 108 reach the end of their downward travel. However, the clock spring assembly 118, which has been assisting the lowering of the shade 100, ensures that the slats 106 tilt fully open by giving the rotator rail 102 an extra "kick" at the end of its travel, as shown schematically in FIG. 35.

Figure 35:
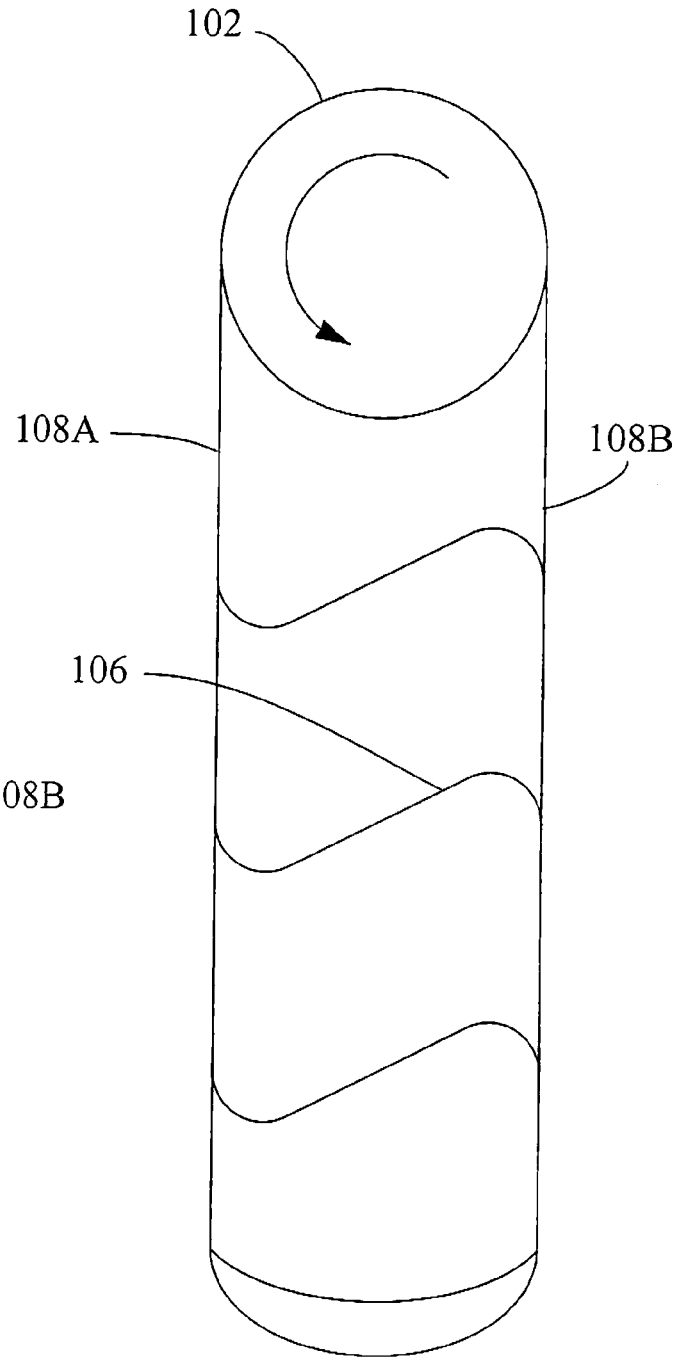
FIG. 35 is the same view as FIG. 34, but showing the action of the spring assist to tilt the slats to the fully open position.

The clock spring 182 is a long stroke spring with just enough potential energy remaining when the shade 100 is fully lowered to provide the extra "kick" to the rotator rail 102 to push the slats 106 into the tilted open position. As the shade 100 is lowered, the rotator rail 102 rotates counter-clockwise as seen from the vantage point of FIG. 37, and the clock spring 182 is coiling itself up, assisting in the lowering of the shade 100. At the end of the downward travel of the shade 100, the clock spring 182 is still not completely coiled, and the second end 224 of the spring 182 continues pushing counter-clockwise against the shoulder 230 of the rotator rail 102, forcing the adapter housing 180 and the rotator rail 102 to rotate just a little bit more in the counter-clockwise direction to tilt the slats 106 to the fully open position as seen in FIG. 35.

It is interesting to note that the use of the clock spring assembly 118 (or of the spring motor assembly 402 described later) in conjunction with any one of the automatic brake mechanisms disclosed in this application is a handy way to adjust the extent of tilting open of the shade. If the drive cord 116 is released just as the shade is fully lowered but before the slats 106 are tilted open, the automatic brake locks the shade in the fully lowered but tilted closed position. At that point, pulling slightly and momentarily on the drive cord 116 releases the automatic brake just long enough for the clock spring assembly 118 to rotate the rotator rail 102 to cause the slats 106 to begin tilting open. A long pull on the drive cord 116 allows the slats 106 to tilt open fully. However, a short tug on the drive cord 116 allows the rotator rail 102 to index only a short distance before the automatic brake locks it back in place, resulting in the slats 106 tilting open only a small amount. Repeated short tugs on the drive cord 116 allow the user to control precisely the degree of "tilted-open" condition of the shade.

Weight Assist Automatic Brake

Figure 3:
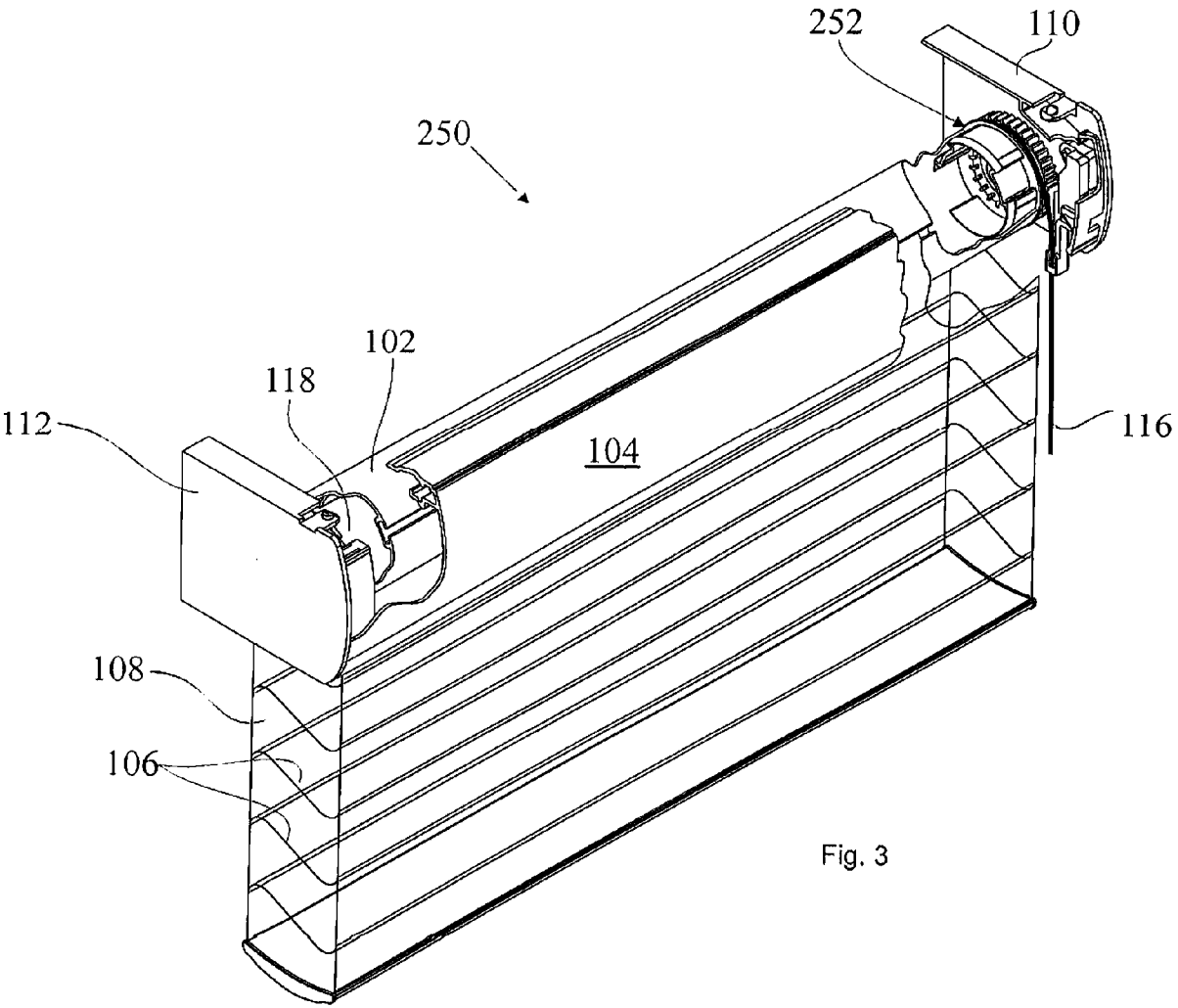
FIG. 3 is a partially broken away perspective view of another variable light control shade incorporating a cord drive with a weight assist brake and a clock spring assembly made in accordance with the present invention.
Figure 29:
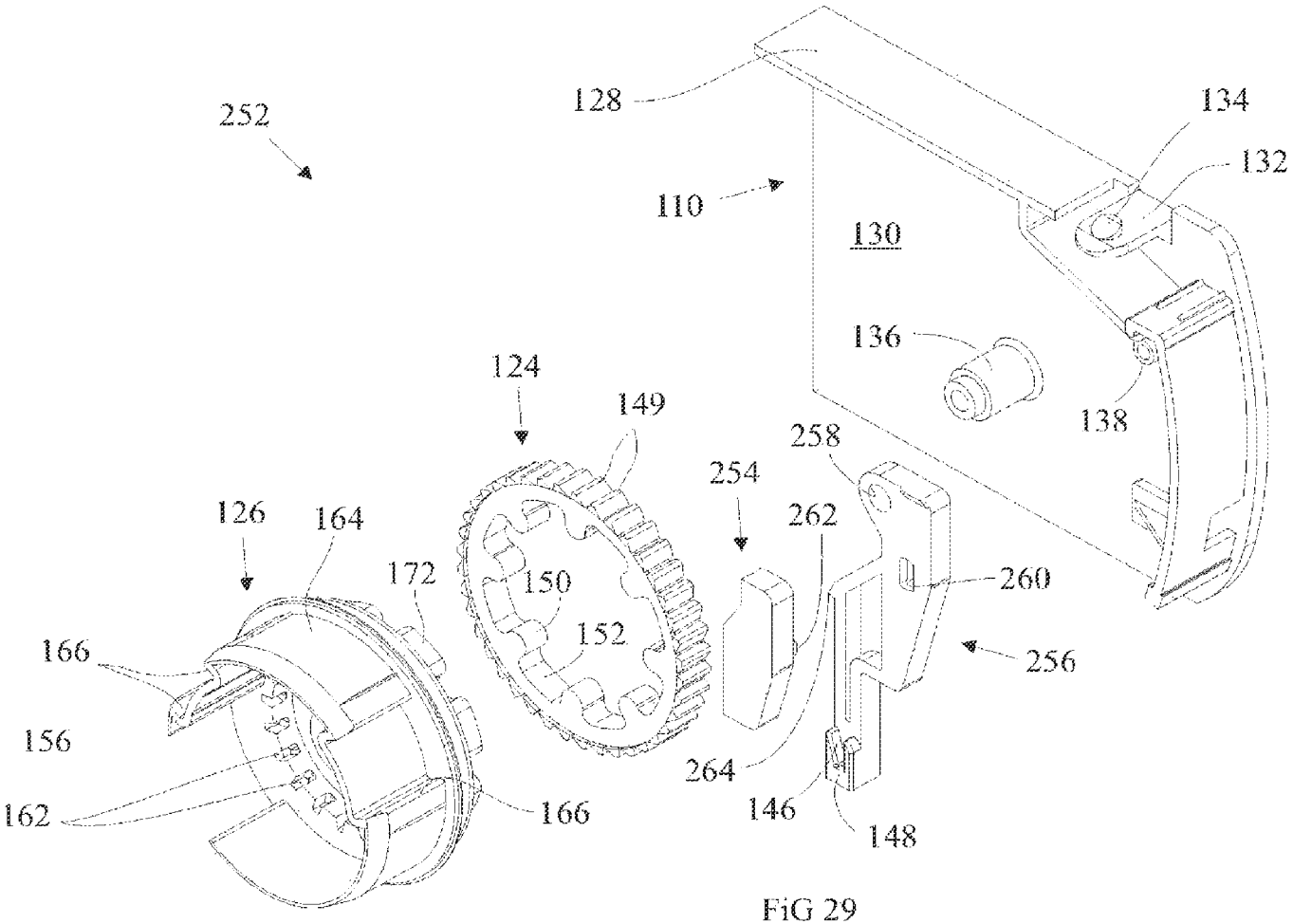
FIG. 29 is an exploded, perspective view of the weight assist brake mechanism used in the embodiment of FIG. 3.
Figures 30, 31:
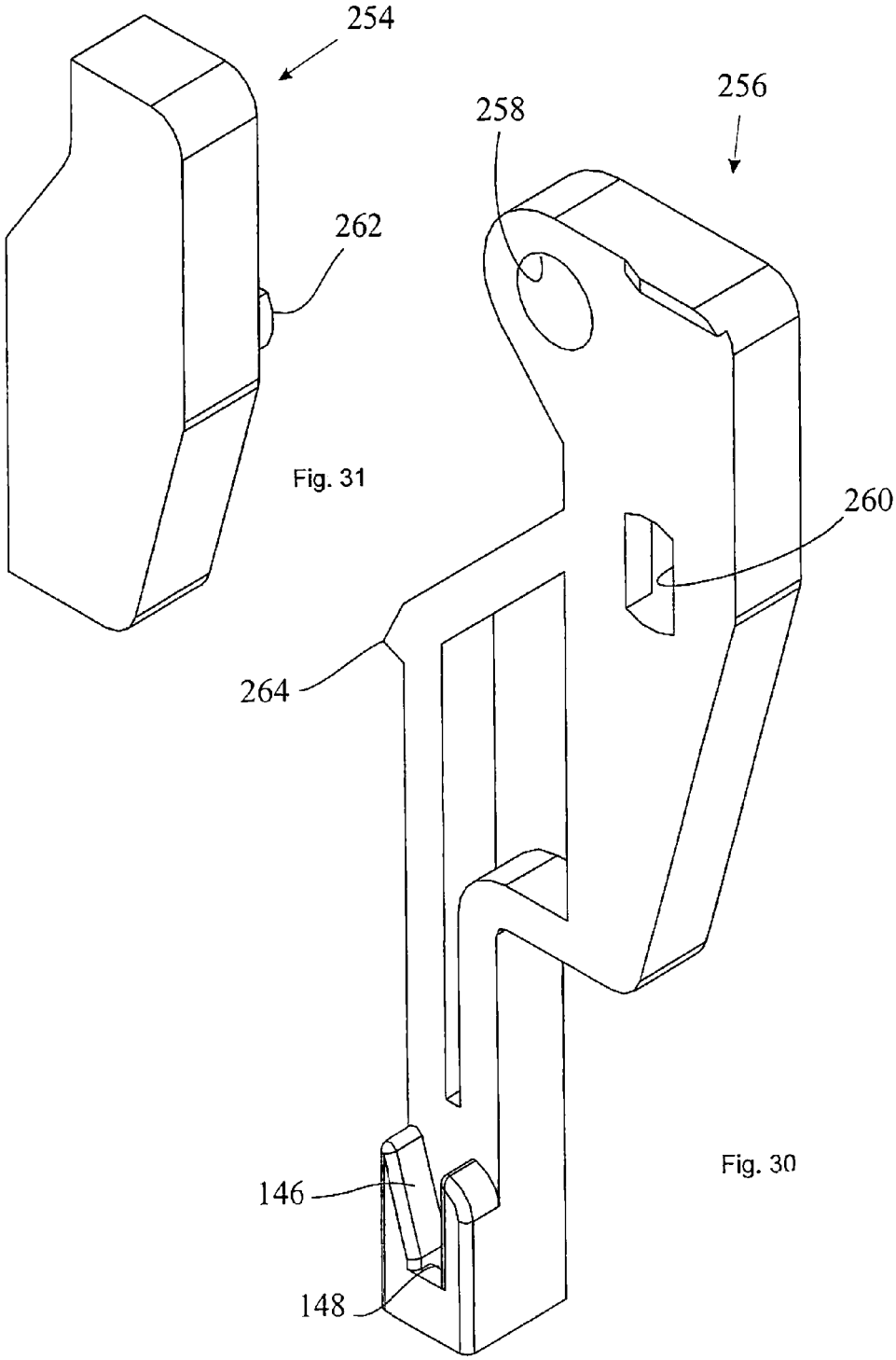
FIG. 30 is a perspective view of the brake release arm of FIG. 29.
FIG. 31 is a perspective view of the weight for the brake release arm of FIG. 30.

FIG. 3 shows a second embodiment of a shade 250 made in accordance with the present invention. All components of the shade 250 are identical to those of the first shade 100 described above except for the automatic brake 252, which is weight assisted instead of being spring assisted as was the brake 114 of the first embodiment 100. FIGS. 29, 30, and 31 show the weight assist brake 252 in more detail. The weight assist brake 252 is identical in its components and operation to the spring assist brake 114 described earlier, except that the biasing spring 122 is replaced by a weight 254, and the actuator arm 256 is different in order to accommodate the weight 254 instead of the spring 122.

The actuator arm 256 (See FIG. 30) is an elongated member with an opening 258 adjacent the upper portion of the arm 256. This opening 258 fits over the second stub shaft 138 of the end cap 110 such that the arm 256 may swing forward and aft, parallel to the inside surface 130 of the end cap 110. A cavity 260, partway down the arm 256 and offset to the right of the opening 258, receives a projection 262 on the weight 254 with a press fit so that, once the weight 254 is assembled to the arm 256, they will not readily come apart. With the weight 254 mounted on the arm 256 in this manner, being offset to the right from the axis of the stub shaft 138, the weight is cantilevered with respect to the stub shaft 138. The force of gravity on the cantilevered weight 254 creates a moment arm which biases the actuator arm 256 in a clockwise direction, causing it to swing aft about the stub shaft 138 of the end cap 110, pressing the nose projection 264 against the ratchet drive plug 124 in the same manner that the biasing spring 122 did for the spring assist brake 114, as already described above. The rest of the actuator arm 256 is the same as the arm 120 already described with respect to the spring assist brake 114.

As indicated, the operation of the weight assist brake 252 is identical to the spring assist brake 114 except that the biasing of the actuator arm against the ratchet drive plug 124 is accomplished by a biasing spring 122 in the instance of the spring assist brake 114 and by the cantilevered weight 254 in the instance of the weight assist brake 252. It should be noted that, while the weight 254 is a separate piece from the actuator arm 256 in this particular embodiment, it could be made as an integral part of the arm 256.

Spring Clamp Automatic Brake

Figure 5:
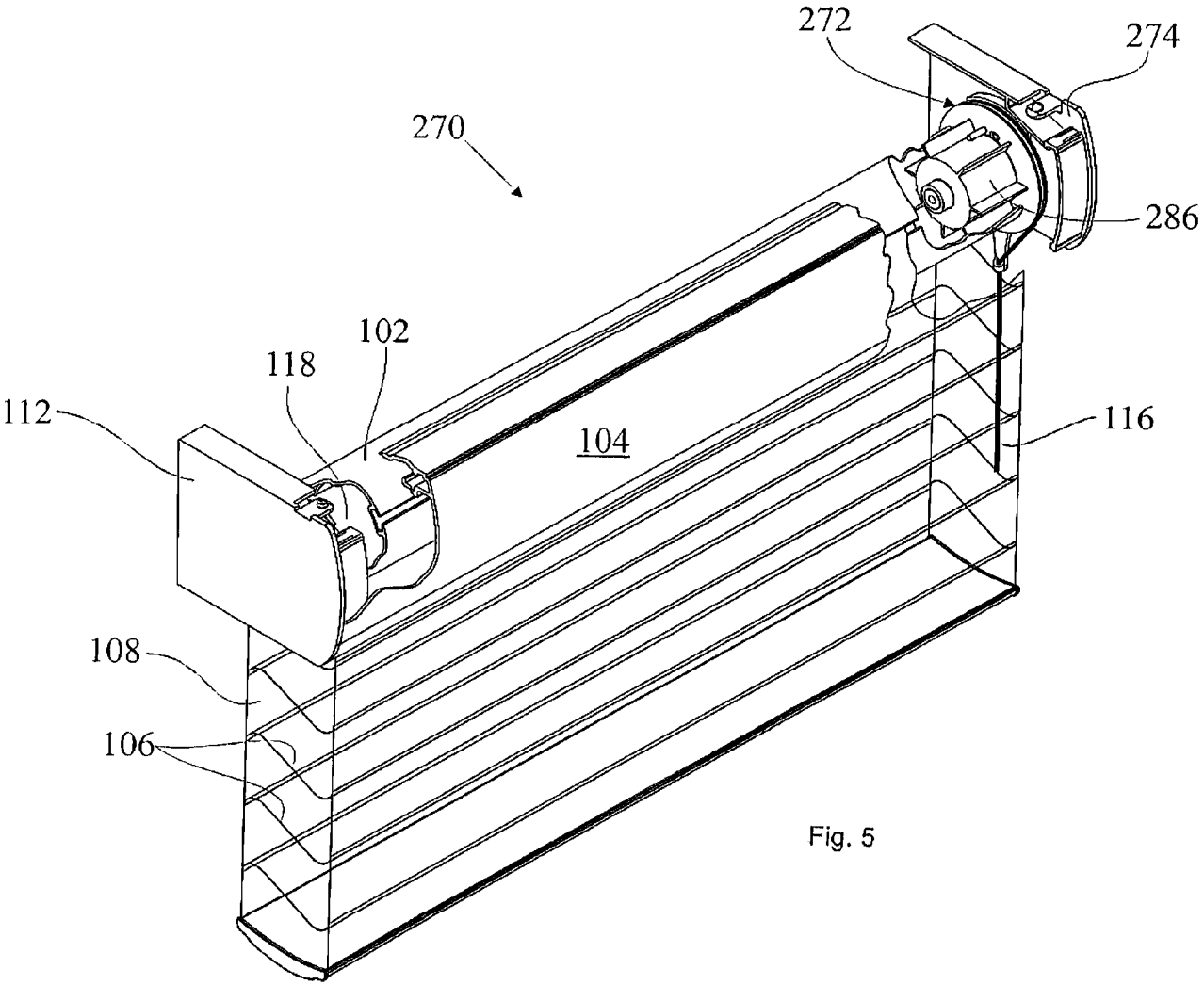
FIG. 5 is a partially broken away perspective view of another variable light control shade incorporating a cord drive with a spring clamp brake and a clock spring assembly made in accordance with the present invention.
Figure 13:
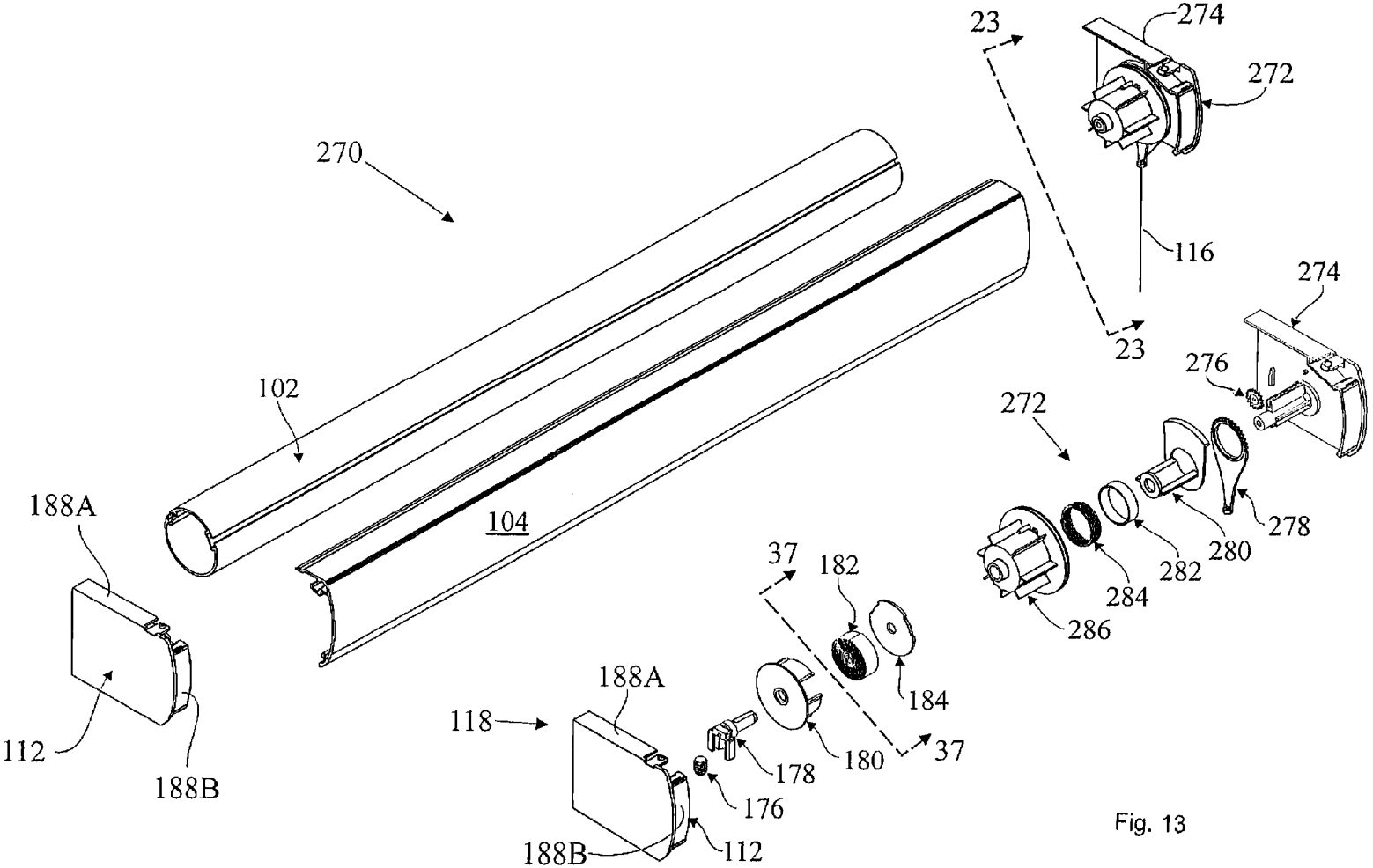
FIG. 13 is an exploded, perspective view of the blind of FIG. 5, with the spring clamp brake and clock spring also exploded.

FIG. 5 shows another embodiment of a shade 270 made in accordance with the present invention. FIG. 13 shows a detailed exploded view of this embodiment 270. All components of the shade 270 are identical to those of the shade 100 described above except for the automatic brake which is a spring clamp action automatic brake 272 instead of the spring assist brake 114 of the first embodiment 100. The end cap 274 is slightly different from the previous end cap 110 to accommodate the spring clamp action brake 272.

Figure 11:
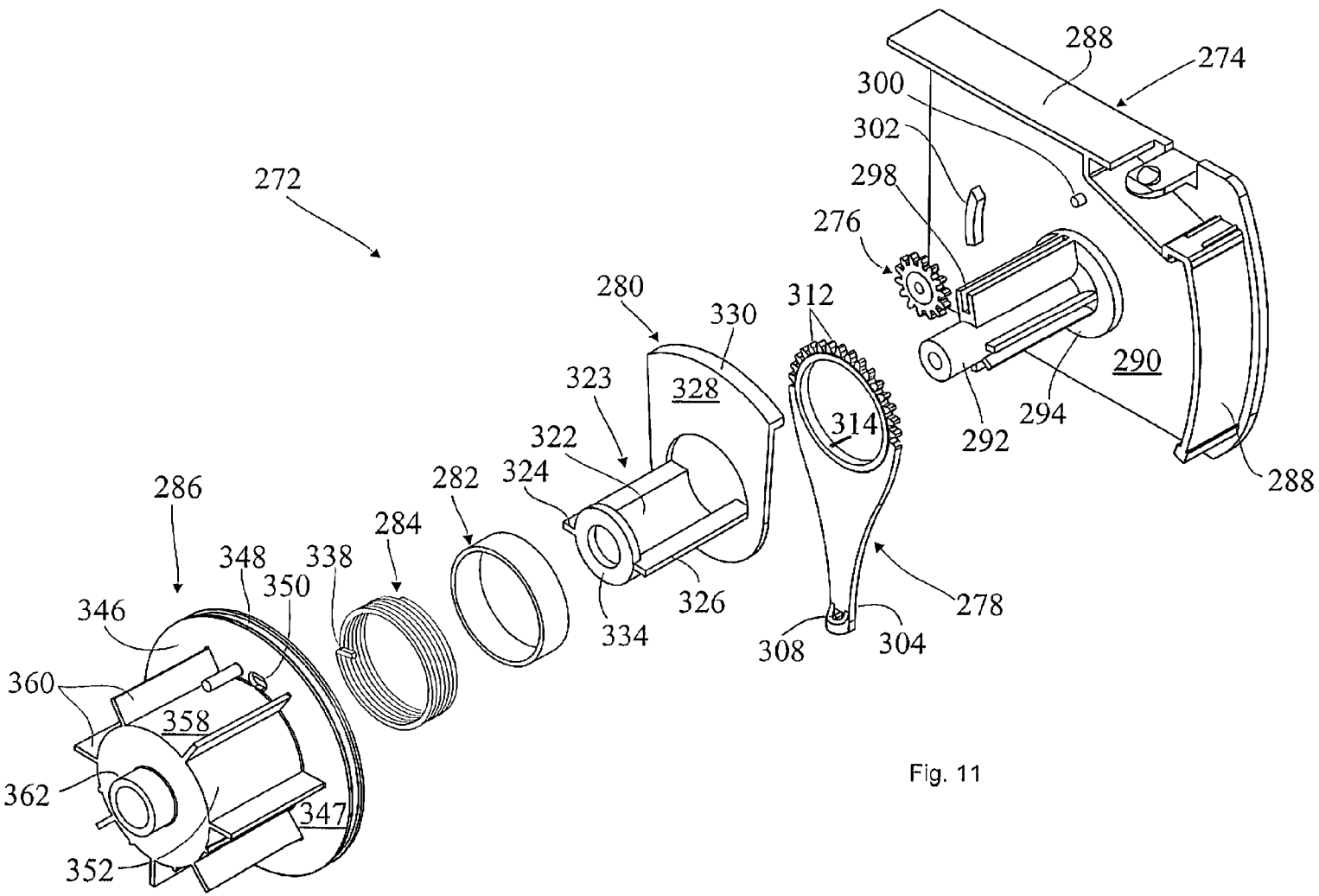
FIG. 11 is an exploded, perspective view of the spring clamp brake which is one of the components of the embodiments of FIGS. 5 and 6.

Referring now to FIG. 11, the spring clamp brake 272 includes an end cap 274, a transform gear 276, an actuator arm 278 (or release arm 278), a brake spring actuator 280, a spacer 282, a spring 284, a drive cord spool and rotator rail adapter 286 (hereinafter referred to as a drive cord spool 286), as well as the drive cord 116 as shown in FIG. 5.

Figure 15:
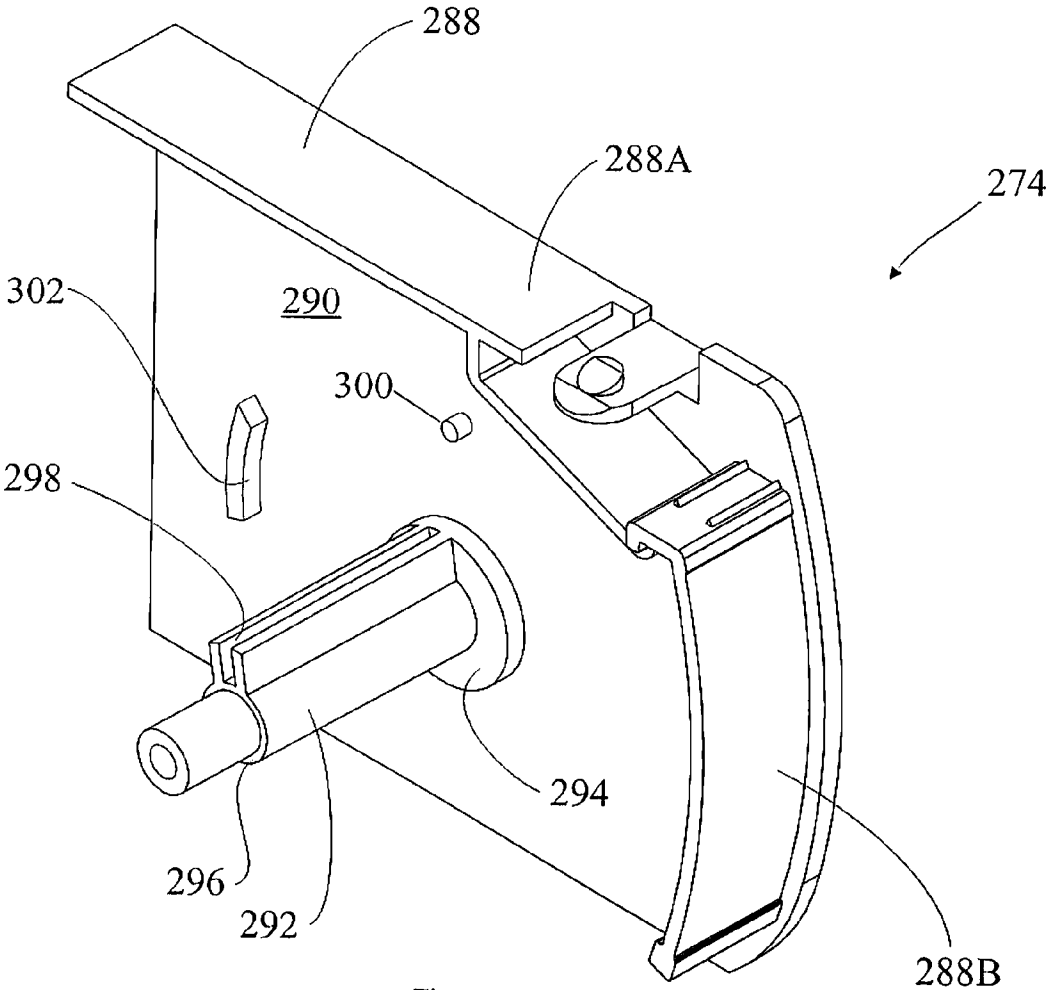
FIG. 15 is a perspective view of the spring clamp brake end cap of FIG. 11.

As seen in FIG. 15, the end cap 274 includes a flange 288 projecting from and perpendicular to the inside surface 290 of the end cap 274, including an upper flange portion 288A and a front flange portion 288B. As has already been described above in relation to the first embodiment of the shade 100, the flange 288 is used to attach and secure the head rail cover 104 to the end cap 274. Also projecting from the inside surface 290 of the end cap 274 is a first shaft 292, which provides an axis of rotation for the drive cord spool 286 as described later. This shaft 292 has a first shoulder 294 proximate the inside surface 290 of the end cap 274, where the shaft 292 attaches to the end cap 274, and a second shoulder 296 offset inwardly a short distance from the free end of the shaft 292. A channel projection 298 extends longitudinally along the shaft 292 between the first and second shoulders 294, 296, and this channel projection 298 is open at the end proximate the second shoulder 296. Projecting inwardly on the inner surface 290 of the end cap 274 is a short stub shaft 300, which provides an axis of rotation for the transform gear 276 (as explained below). Also projecting inwardly from the inner surface 290 of the end cap 274 is a limit stop 302, which limits the extent of rotation of the actuator arm 278 and of the brake spring actuator 280 (as explained below).

Figure 17:
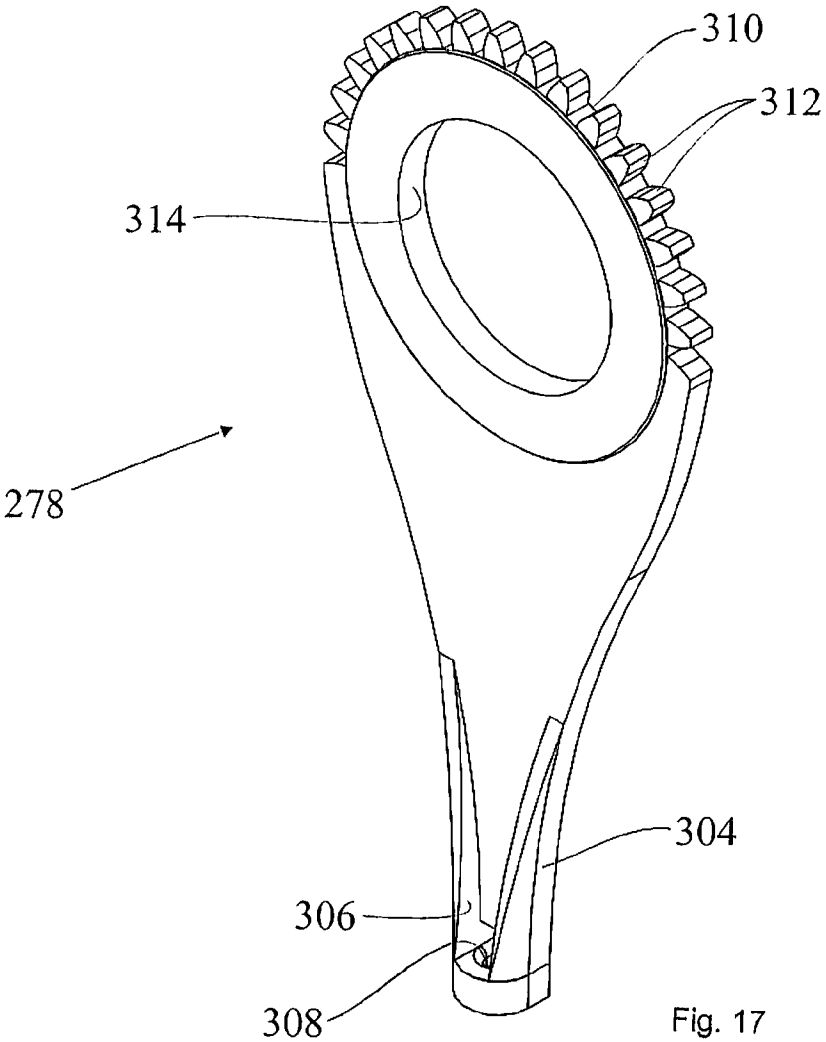
FIG. 17 is a perspective view of the spring clamp brake actuator arm (also referred to as a release arm) of FIG. 11.

Referring to FIGS. 11 and 17, the actuator arm 278 is shaped like a racket, including a handle 304, which includes a saddle 306 and an opening 308 in the saddle 306 through which the drive cord 116 is routed (as seen in FIG. 5). The opposite end of the actuator arm 278, corresponding to the head of the racket, is circular and includes gear teeth 312 along its perimeter 310. The head portion has a smooth, circular cross-section inside contour 314 sized to slide over the first shoulder 294 of the first shaft 292 of the end cap 274, such that this shoulder 294 provides a bearing surface for rotation of the actuator arm 278 about the axis of the shaft 292.

Figure 16:
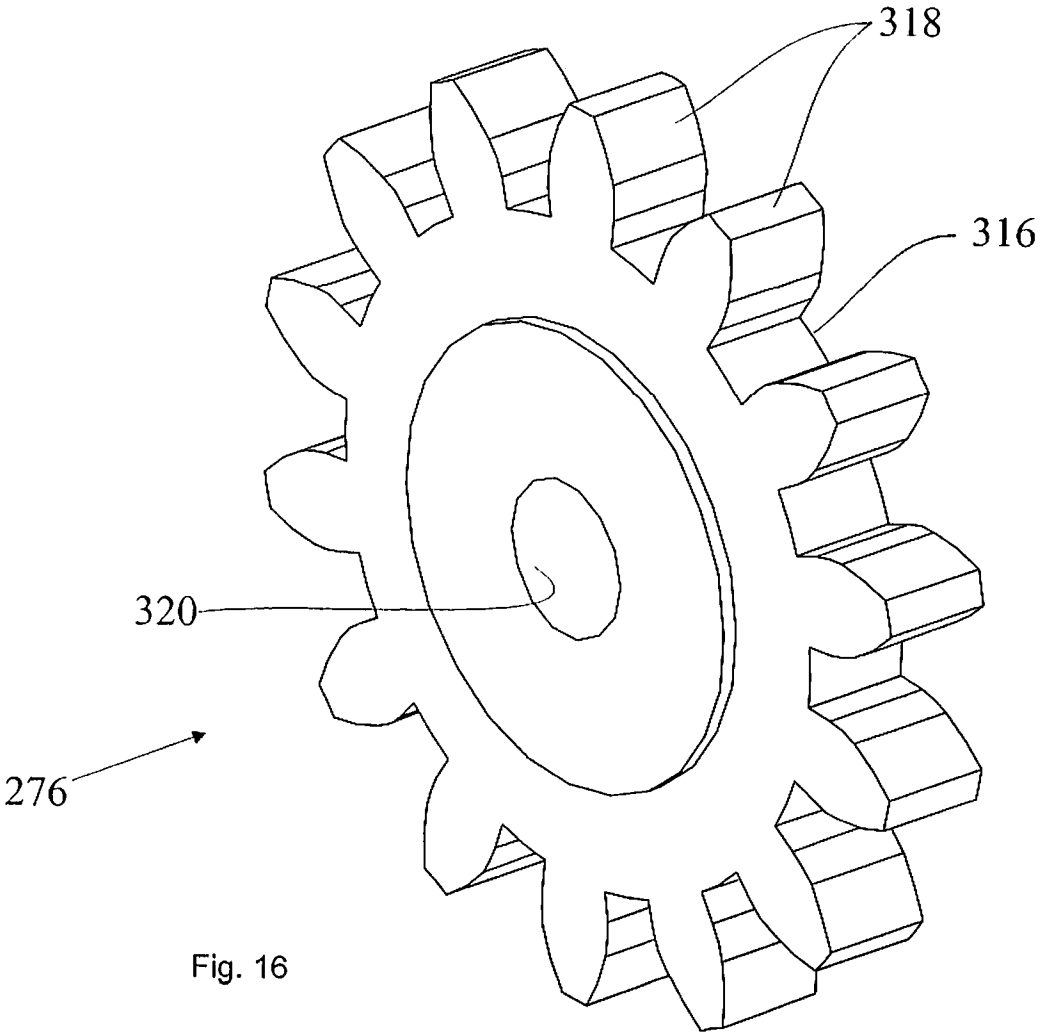
FIG. 16 is a perspective view of the spring clamp brake transform gear of FIG. 11.

Referring to FIG. 16, the transform gear 276 is a flat disk with a geared outer perimeter 316, including a plurality of gear teeth 318 and a smooth, circular central opening 320 sized to slide over and rest upon the second stub shaft 300 of the end cap 274, such that this shaft 300 provides a bearing surface for rotation of the transform gear 276 about the axis of this shaft 300. The size of the transform gear 276 is such that, when the brake 272 is assembled, its teeth 318 mesh with the teeth 312 of the actuator arm 278 and also with the teeth 322 of the brake spring actuator 280 as described below.

Figure 12:
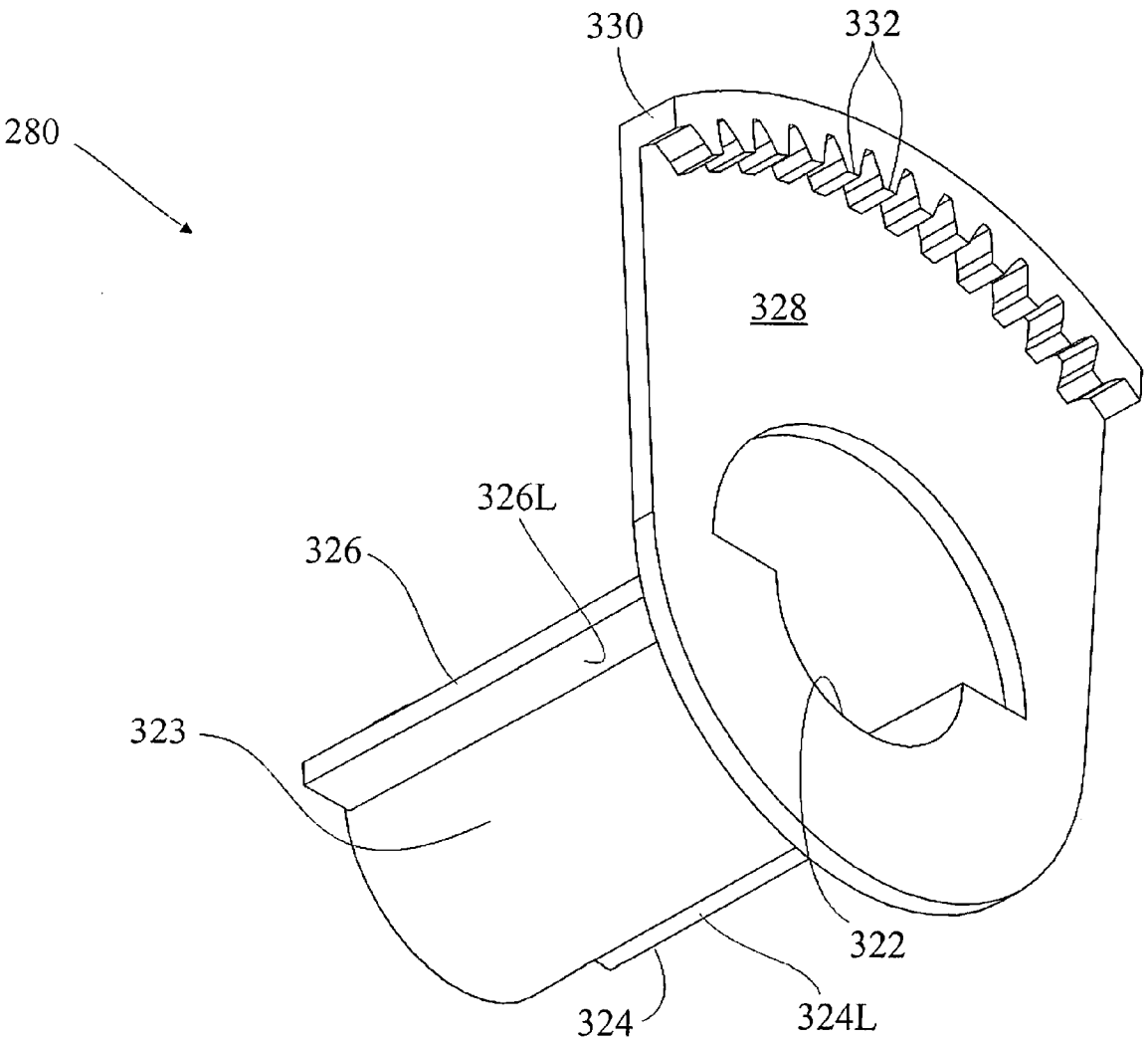
FIG. 12 is a perspective view of the spring actuator of the spring clamp brake of FIG. 11.
Figure 18:
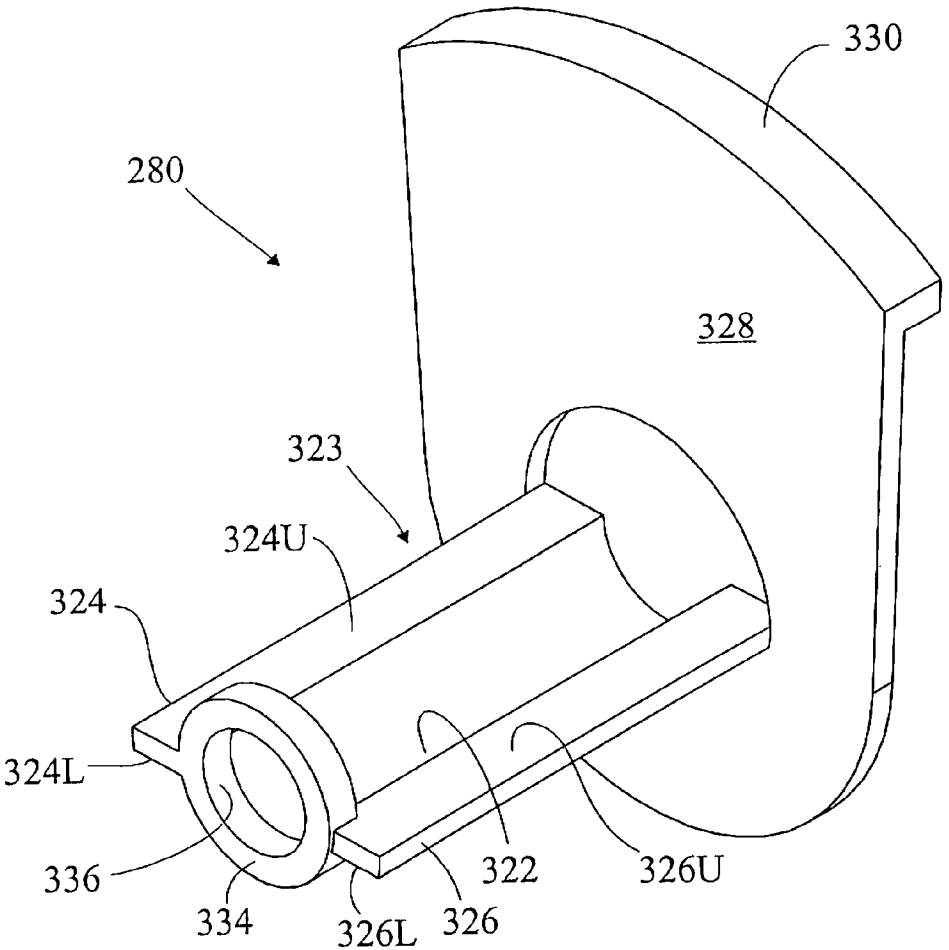
FIG. 18 is a perspective view of the spring clamp brake spring actuator of FIG. 11 (taken from the opposite end from what is shown in FIG. 12)

Referring to FIGS. 12 and 18, the brake spring actuator 280 includes a semi-cylindrical member 323 which defines an open-ended trough 322, with longitudinally-extending left and right flanges 324, 326, respectively, and each flange 324, 326 defines upper and lower surfaces 324U, 324L, 326U, 326L, respectively. The brake spring actuator 280 is mounted for rotation about the first shaft 292 of the end cap 274 as explained later. A first (outer) end of the semi-cylindrical member 323 terminates in a vertical wall 328, which is perpendicular to the longitudinal axis of the trough 322. An arcuate flange 330 projects outwardly from the top of the vertical wall 328 and defines a plurality of gear teeth 332 on its concave side. These gear teeth 332 are designed to mesh with the teeth 318 of the transform gear 276 when the brake 272 is assembled, such that, when the actuator arm 278 is rotated, say in a counter-clockwise direction (as seen from the vantage point of FIG. 11), the transform gear 276 (which meshes with the actuator arm 278 via the teeth 312, 318) rotates in a clockwise direction, and the brake spring actuator 280 (which meshes with the transform gear 276 via the teeth 318, 322) also rotates in a clockwise direction. The second or inner end of the semi-cylindrical member 323 terminates in an annular disk 334, which defines an inside circular cross-section surface 336 which is supported by the first shaft 292 for rotation about its axis. The annular disk 334 abuts the second shoulder 296 of the shaft 292, and the wall 328 abuts the first shoulder 294 of the shaft 292, such that the actuator arm 278 is able to rotate about the shaft 292 without frictional contact with the brake spring actuator 280, which is also mounted for rotation on the same shaft 292. The gear teeth 332 on the brake spring actuator 280 are offset outwardly from the vertical plane of the wall 328 so that all three sets of gear teeth 332 (on the brake spring actuator 280), 318 (on the transform gear 276), and 312 (on the actuator arm 278) lie in the same plane. Once the brake 272 is assembled, the shaft 292 extends through and beyond the disk 334 of the brake spring actuator 280 and into the central opening of the drive cord spool 286 so as to provide a bearing surface for the drive cord spool 286 to rotate about the axis of the shaft 292, as described below.

Figure 19:
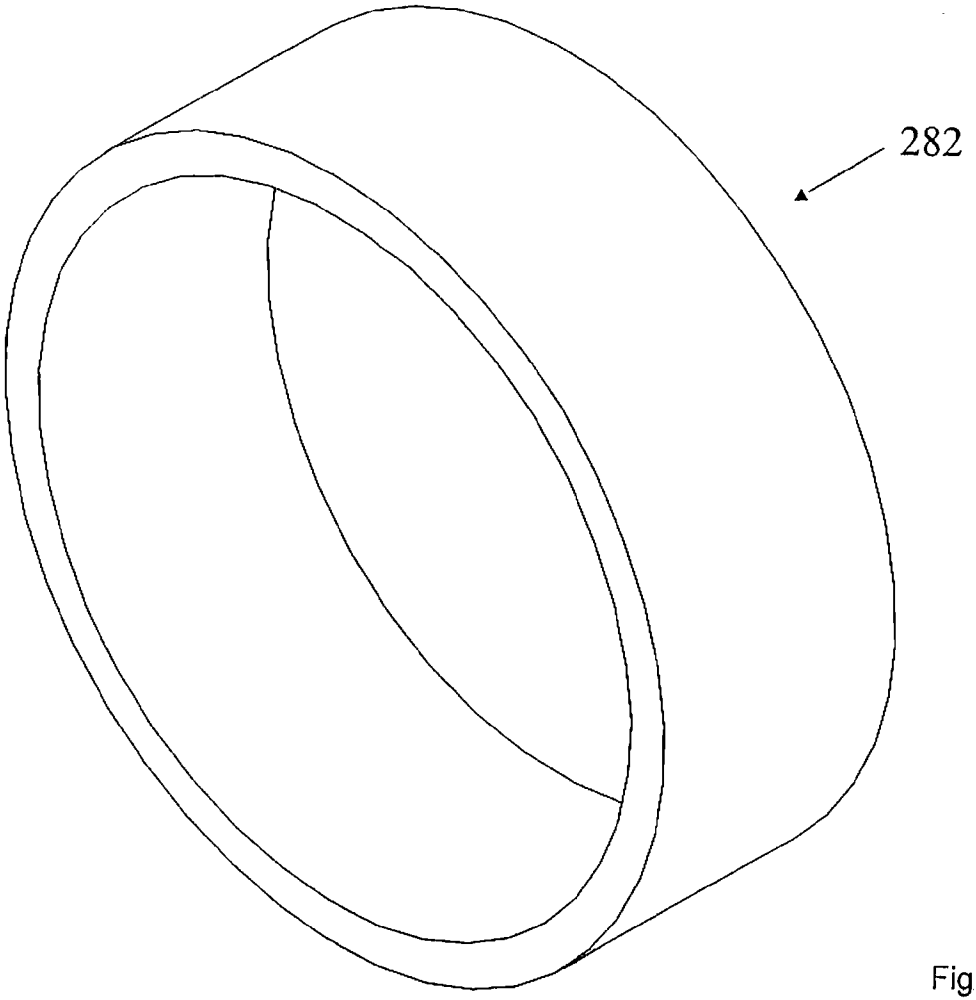
FIG. 19 is a perspective view of the spring clamp brake spacer of FIG. 11.
Figure 20:
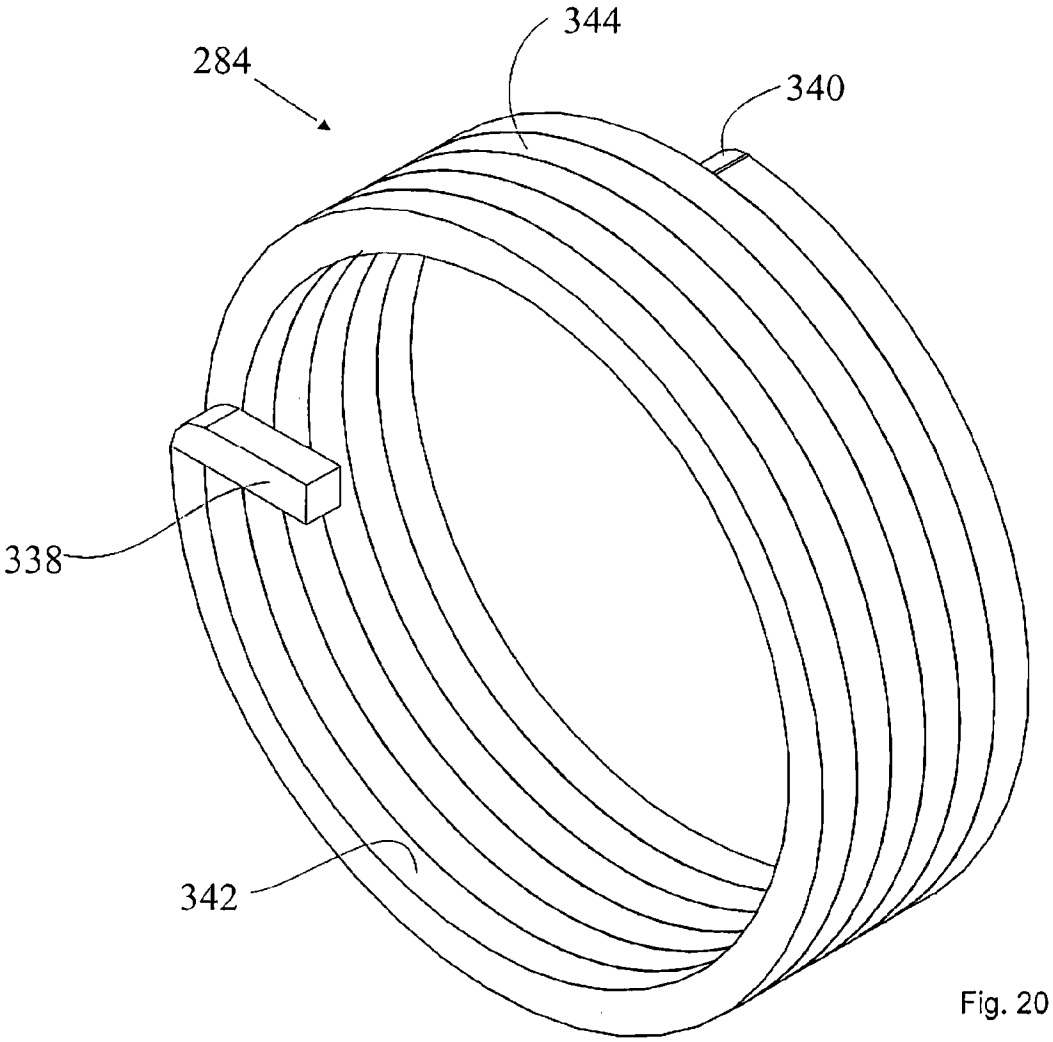
FIG. 20 is a perspective view of the spring used in the spring clamp brake of FIG. 11.

FIG. 20 depicts the relatively tightly wound spring 284 of the spring clamp brake 272 of FIG. 11, including a first (inner) end 338 and a second (outer) end 340. The coiled spring 284 has a generally cylindrical shape and defines an inner surface 342 and an outside surface 344. The spring 284 mounts over the semi-cylindrical member 323 of the spring brake actuator 280, with the inner surface 342 of the spring 284 being just large enough to allow the spring 284 to slide over the left and right flanges 324, 326. The spring 284 is oriented so that the second end 340 of the spring 284 slides into and along the channel 298 of the shaft 292, and the first end 338 of the spring 284 rests against the upper surface 324U of the left flange 324. Therefore, as the spring brake actuator 280 rotates clockwise about the shaft 292, the second end 340 of the spring 284 remains stationary while the first end 338 rotates clockwise with the flange 324 of the spring brake actuator 280 (as seen from the vantage point of FIG. 11), causing the spring 284 to become compressed, reducing its effective outside diameter, and, at the same time, creating a biasing force to rotate the brake spring actuator 280 back counter-clockwise as the spring 284 returns to its natural relaxed condition. The spacer 282 of FIG. 19 is simply a collar of the same dimensions as the spring 284 when the spring 284 is in its relaxed condition. This spacer 282 is used instead of a second spring 284 when only one spring 284 is required, and it is used in order to keep the spring 284 from becoming skewed as it is being compressed. The spacer 282 is replaced by a second spring 284 when a second spring 284 is required to provide the braking power on heavier shades 270.

Figure 21:
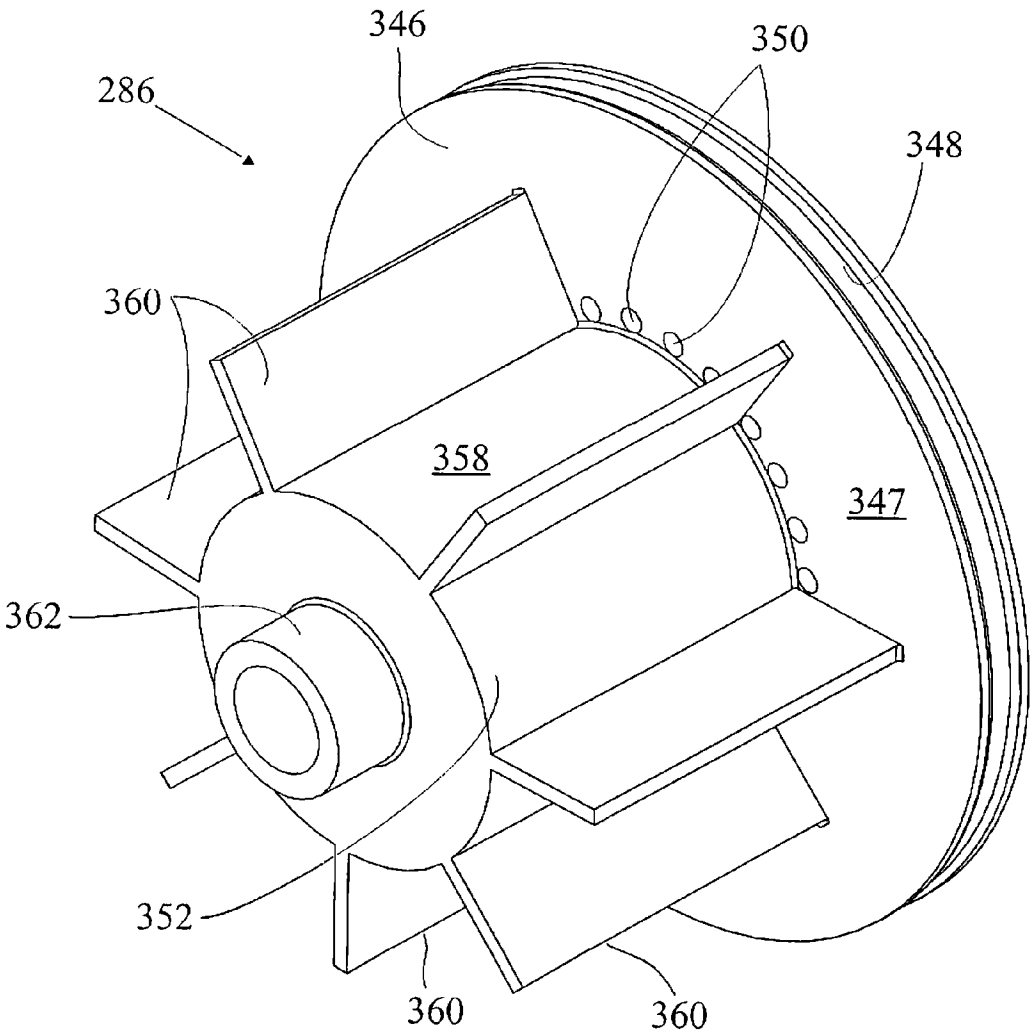
FIG. 21 is a perspective view of the spring clamp brake drive cord spool of FIG. 11.
Figure 22:
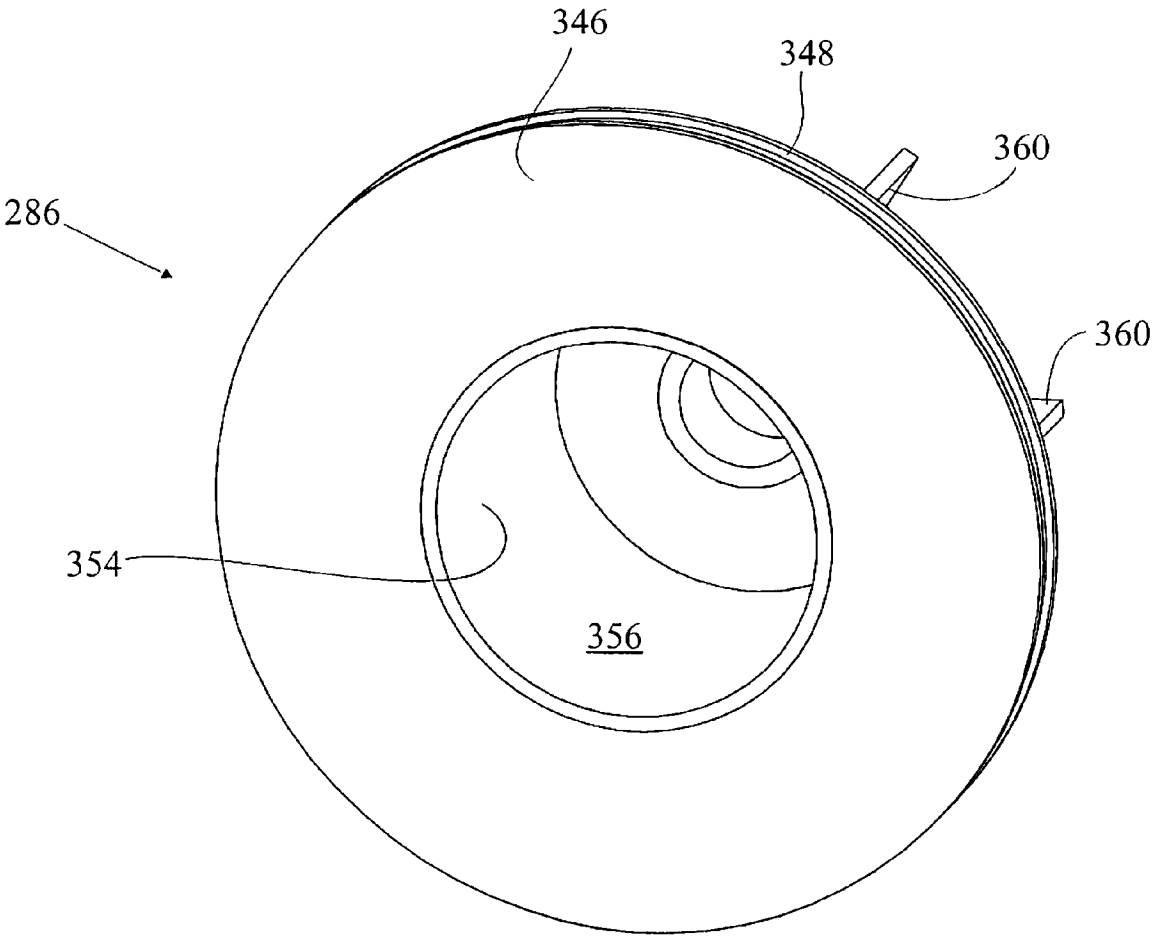
FIG. 22 is a perspective view of the drive cord spool of FIG. 21 taken from the opposite end.

FIGS. 21 and 22 depict the drive cord spool 286 of FIG. 11. The drive cord spool 286 includes an annular disk 346, which defines a groove 348 along its perimeter, where the drive cord 116 winds up onto the drive cord spool 286. A plurality of openings 350 extend from the inner surface 347 of the disk 346 to the groove 348, so the drive cord 116 may be threaded through one of the openings 350 and tied off with a knot or grommet (not shown).

A hollow cylindrical projection 352 projects inwardly from the inner surface 347 of the disk 346. The cylindrical projection 352 is wide open at its outer end (see FIG. 22), where it attaches to the disk 346 to define a cavity 354 with an inside surface 356 having a diameter which is slightly smaller than the outside diameter of the spring 284 when the spring is in its relaxed (uncompressed) condition. The outside surface 358 of the cylindrical projection 352 includes a plurality of radially extending wings 360 sized to slide into and engage the inside wall of the rotator rail 102 (See FIG. 33) such that some of the wings 360 contact the shoulders 230 of the rotator rail 102 to provide positive engagement for rotation between the drive cord spool 286 and the rotator rail 102.

Preferably, the drive cord 116 is secured through an opening 350 which is closest to the bottom of the drive cord spool 286 when the shade 270 is drawn all the way up (rolled onto the rotator rail 102) and the drive cord 116 is fully extended (uncoiled from the spool 286) so that the drive cord 116 is unable to exert any further rotational moment to the spool 286 when the shade 270 is all the way up. A hollow shaft projection 362 at the inner end of the hollow cylindrical projection 352 receives the shaft 292 and provides a bearing surface for rotation of the drive cord spool 286 about the shaft 292.

Spring Clamp Brake Assembly and Operation

Referring back to FIG. 11, the transform gear 276 is mounted onto the second shaft 300, and the actuator arm 278 is mounted onto the shoulder 294 of the first shaft 292 of the end cap 274. The brake spring actuator 280 is also mounted onto the first shaft 292 and the spring 284 mounts over the semi-cylindrical portion 323 of the brake spring actuator 280, with the second end 340 of the spring 284 sliding into the channel 298 of the shaft 292, and the first end 338 of the spring 284 resting on the upper surface 324U of the brake spring actuator 280, as has already been described. The spacer 282 is used when only one spring 284 is required, and it slides onto the brake spring actuator 280 before the spring 284. The drive cord spool 286 mounts over the spring 284 such that the spring 284 lies inside the cavity 354 of the drive cord spool 286, and the shaft 292 of the end cap 274 supports the hollow shaft 362 of the drive cord spool 286 for rotation about the shaft 292. It may be necessary to swing the actuator arm 278 forward (in a counter-clockwise direction), causing the spring 284 to compress and thus reducing its outside diameter in order to create enough clearance for the cavity 354 of the drive cord spool 286 to slide over the spring 284. One end of the rotator rail 102 slides over the wings 360 of the drive cord spool 286, and the rest of the shade 270 is assembled in the same manner as described earlier for the first embodiment shade 100. It should be noted that the spring 284 remains slightly compressed inside the cavity 354 even when no forces are exerted on either of the ends 338, 340 of the spring 284. We refer to this position of the spring 284 as the "relaxed" position of the spring 284 despite the fact that the spring 284 is in a slightly compressed position. In fact, the degree to which the spring 284 remains compressed when in this "relaxed" position to a large extent dictates how much braking force is applied.

Figure 23:
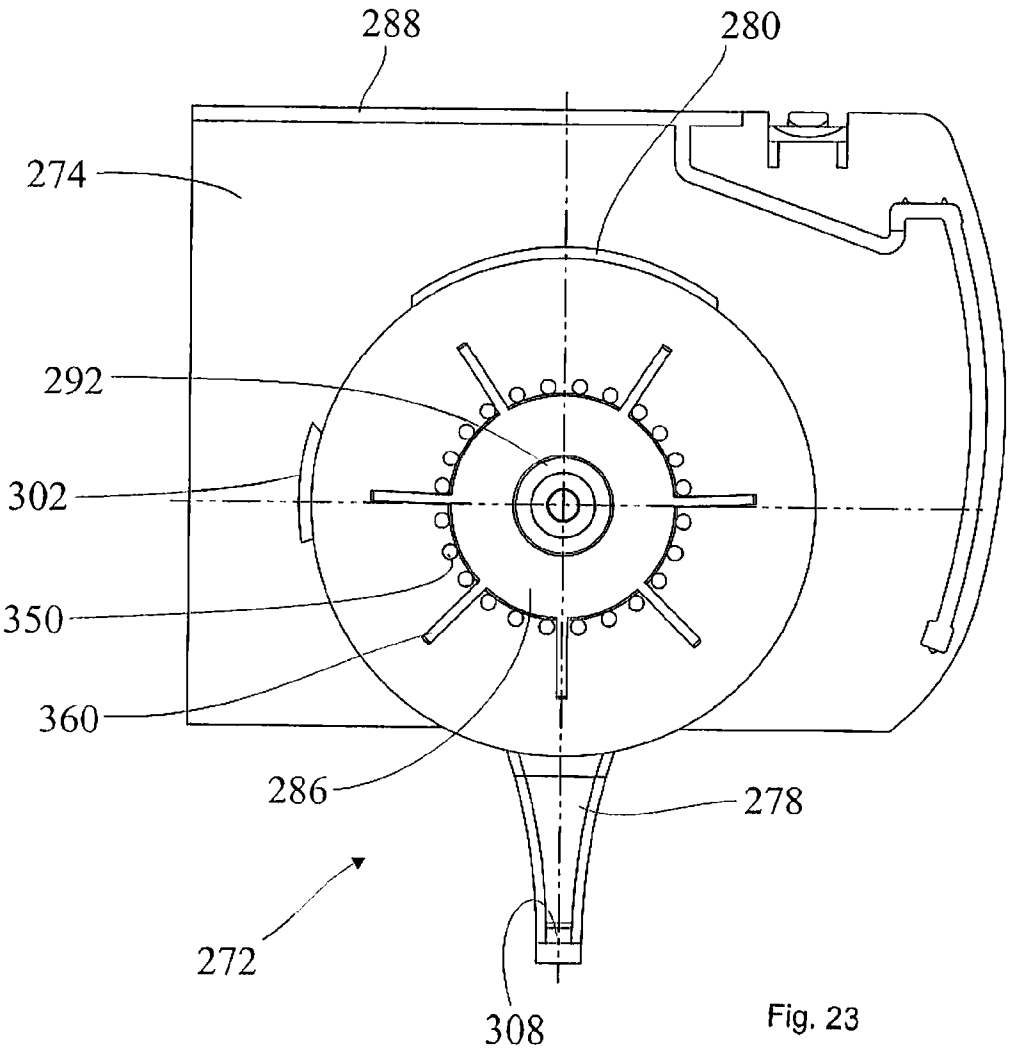
FIG. 23 is an end view of the spring clamp brake assembly and rotator rail taken along line 23-23 of FIG. 13.

FIG. 23 shows the assembly of the spring clamp brake 272 with the rotator rail 102 and the drive cord 116 removed for clarity.

The operation of the shade 270 of FIG. 5 (with the spring clamp brake 272) is very similar to the operation of the shade 100 with the spring assist brake 114 of FIG. 1. When the spring 284 is in its relaxed state, it contacts the inner surface of the drive cord spool 286, serving as a brake to interfere with the rotation of the drive cord spool 286 and of the rotator rail 102. When the user pulls forward on the drive cord 116, the drive cord 116 pulls on the handle 304 of the actuator arm 278, rotating it counter-clockwise about the shaft 292, engaging the transform gear 276, which rotates clockwise about the shaft 300, and which, in turn, engages the gear teeth 332 on the brake spring actuator 280, causing the brake spring actuator 280 to rotate clockwise about the shaft 292 of the end cap 274. As the brake spring actuator 280 rotates clockwise, the upper surface 324U of the flange 324 pushes up against the first end 338 of the spring 284, thus compressing the spring 284. As the spring 284 is compressed, its effective outside diameter is reduced to the point where it disengages from the inside surface 356 of the cavity 354 of the drive cord spool 286, allowing the drive cord spool to rotate freely about the shaft 292 of the end cap 274.

If the user also pulls down on the drive cord 116, the drive cord 116 unwinds from the drive cord spool 286 which rotates clockwise, winding the ladder tapes 108 onto the rotator rail 102 (which is positively engaged to the drive cord spool 286 via the wings 360 on the drive cord spool 286 and the shoulders 230 in the rotator rail 102). If the user eases up on the tension on the drive cord 116 but does not completely release the drive cord 116 such that the actuator arm 278 is still rotated forward, the spring clamp brake 272 remains disengaged, and the drive cord 116 winds up onto the drive cord spool 286 as the drive cord spool 286 and the rotator rail 102 rotate counter-clockwise and the shade 270 unwinds from the rotator rail 102 impelled by the force of gravity acting to close the shade 270. As soon as the user releases the drive cord 116, the spring 284 returns to its relaxed state. The outside diameter of the spring 284 expands slightly, back to its uncompressed state, and the outer surface 344 of the spring presses against the inside surface 356 of the cavity 354 of the drive cord spool 286. As the spring 284 expands, it rotates slightly in the counter-clockwise direction (reversing the action it took when it was compressing), thereby causing the brake spring actuator 280, the rotator rail 102 and the shade 270 to rotate counter-clockwise very briefly about the shaft 292 of the end cap 274, and causing the actuator arm 278 to rotate clockwise, until either the brake spring actuator 280 or the actuator arm 278 impacts against the stop 302 on the end cap 274. This brings the entire assembly to a full stop until the spring clamp brake 272 is once again released by the user.

Spring Motor Assembly

Figure 2:
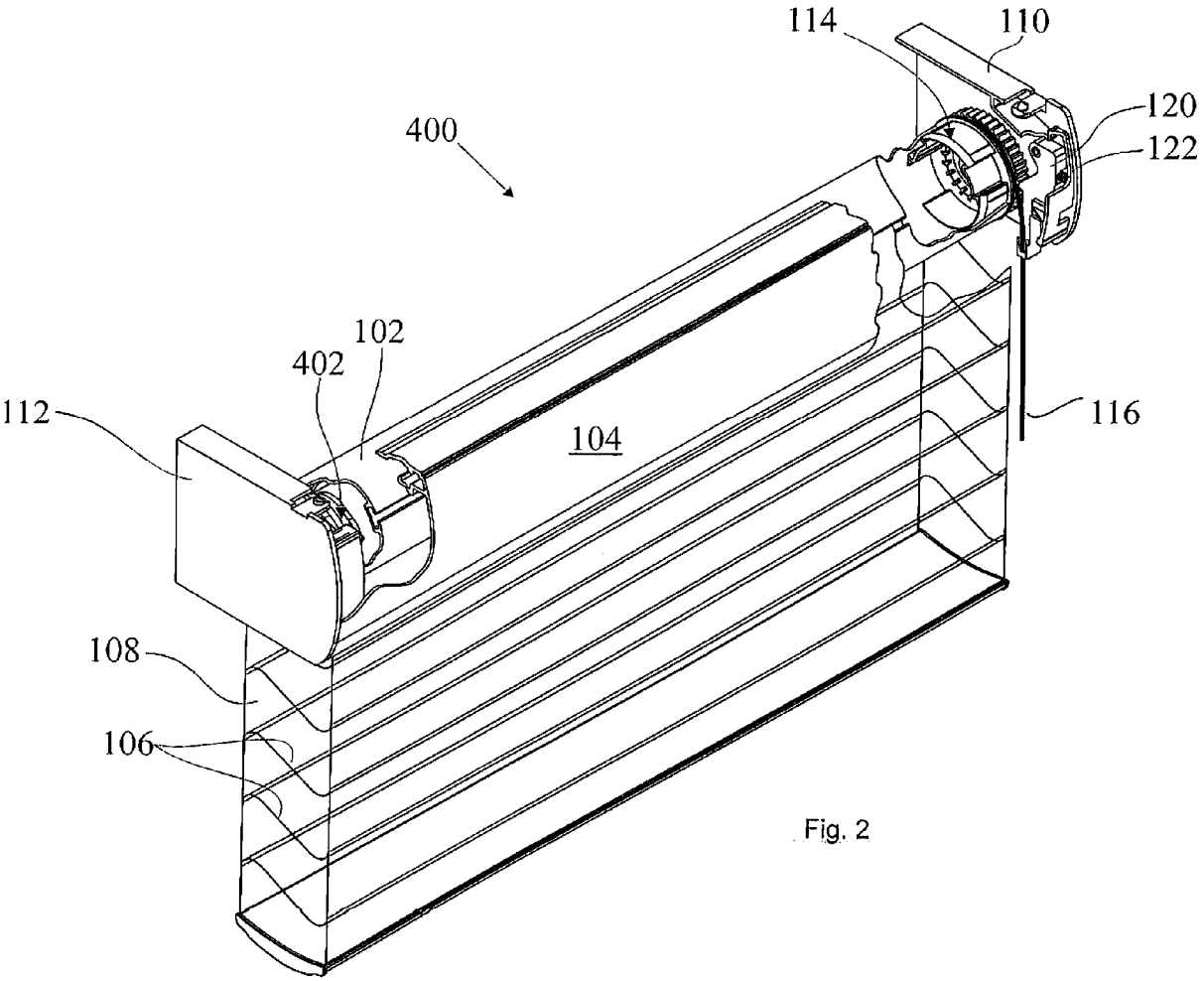
FIG. 2 is a partially broken away perspective view of another variable light control shade incorporating a cord drive with a spring assist brake and a spring motor assembly made in accordance with the present invention.

FIG. 2 shows a fourth embodiment of a shade 400 made in accordance with the present invention. All components of the shade 400 are identical to those of the first shade 100 described above except for the spring motor assembly 402, which utilizes a different type of spring motor to help unwind and tilt the shade open instead of the clock spring assembly 118 of the first embodiment 100.

Figure 9:
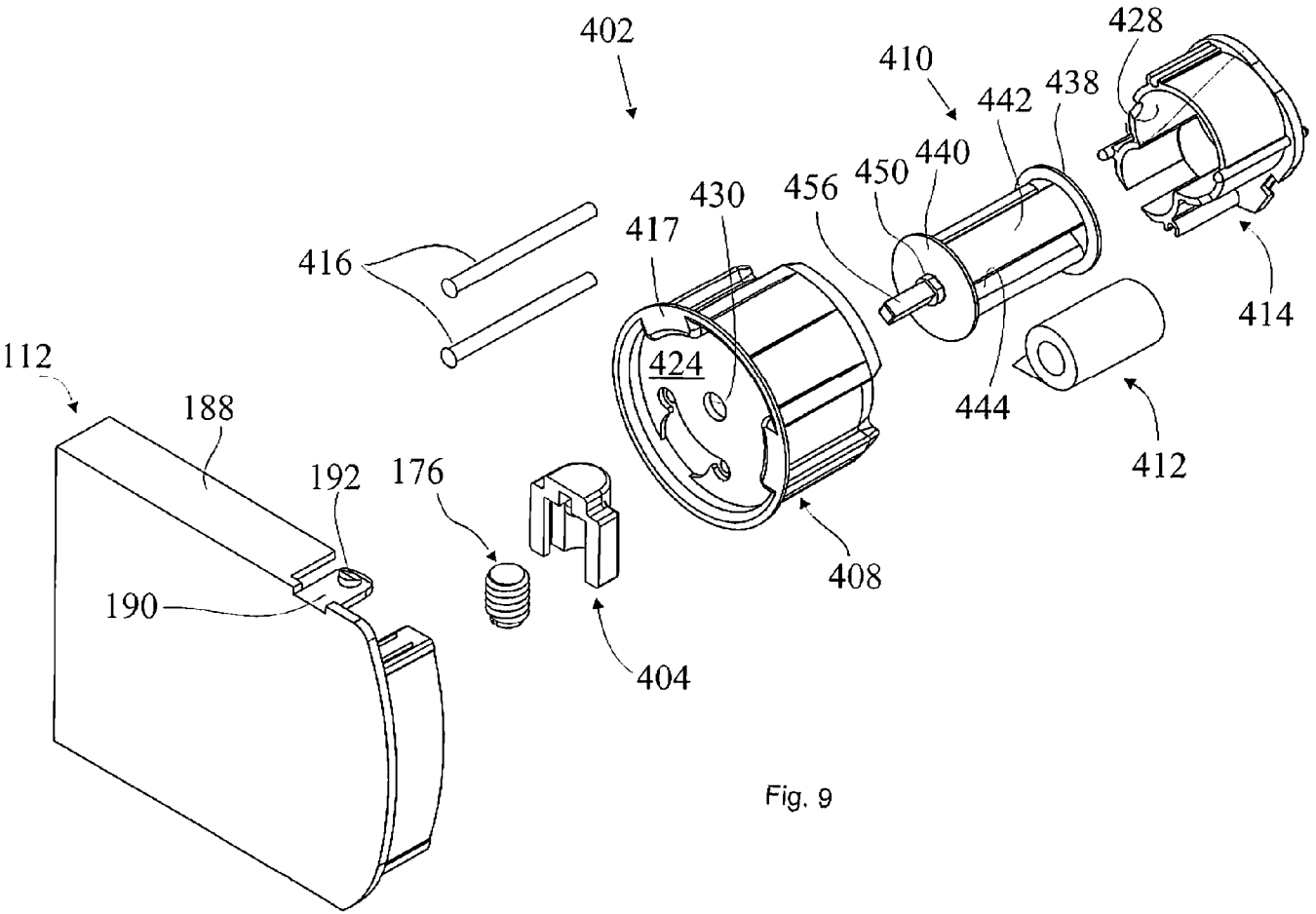
FIG. 9 is an exploded, perspective view of the spring motor mechanism which is one of the components of the embodiments of FIGS. 2, 4, and 6.
Figure 10:
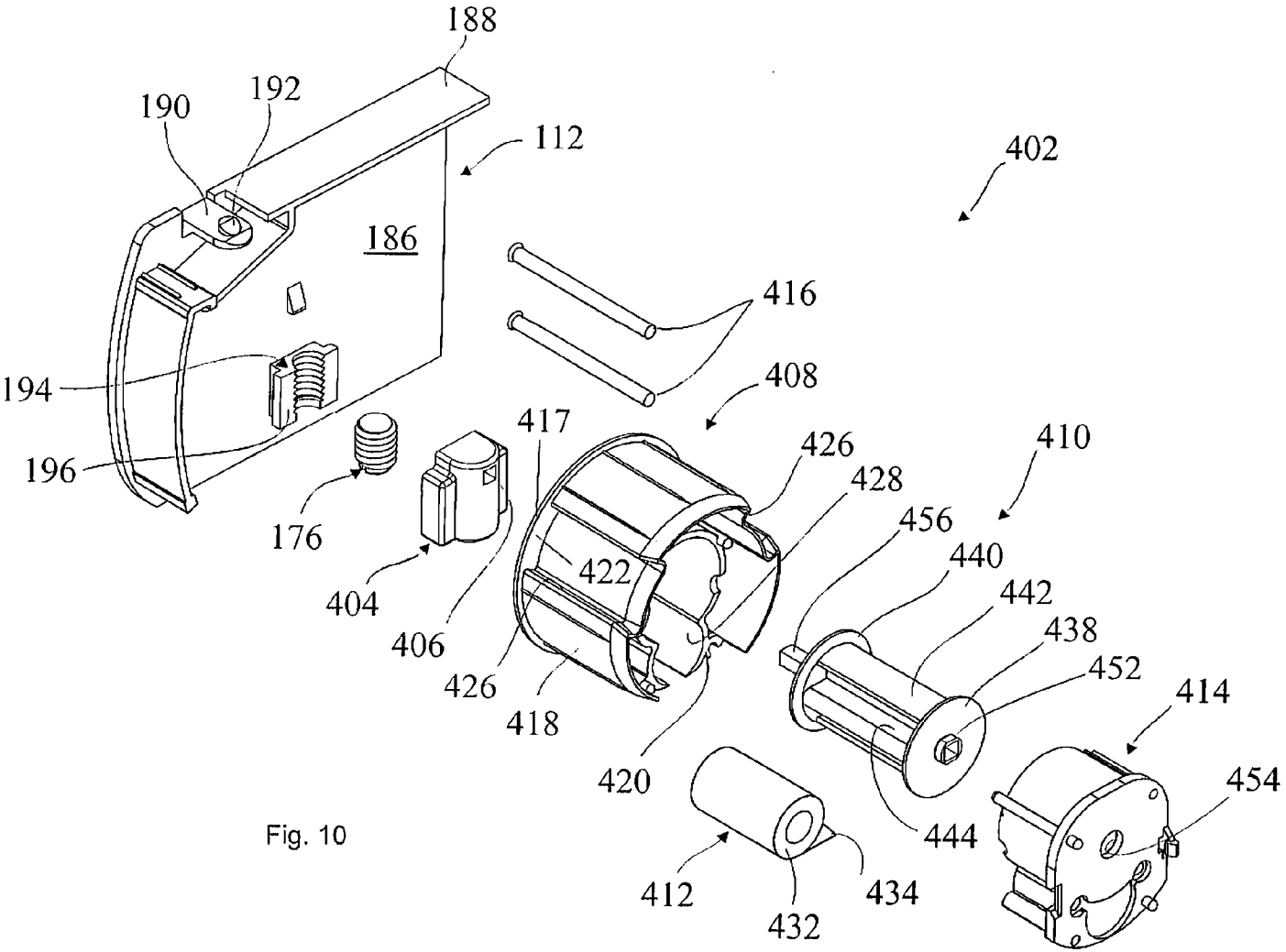
FIG. 10 is an exploded, perspective view of the spring motor mechanism of FIG. 9, but seen from the opposite end.

Referring now to FIGS. 9 and 10, the spring motor assembly 402 utilizes some components already described in relation to the clock spring assembly 118, such as the end cap 112 and the skew adjustment screw 176. The skew adjustment screw cover 404 is very similar to the skew adjustment screw cover 178 of the clock spring assembly 118, except that, instead of having a split stub shaft 204, it has a non-circular cross-section (in this embodiment a rectangular) cavity 406 for receiving the output shaft 456 of the spring motor assembly described below. Other components of the spring motor assembly 402 include a spring-to-rail adapter 408, an output spool 410, a spring 412, a spring motor housing 414, and two rivets 416.

Figure 40:
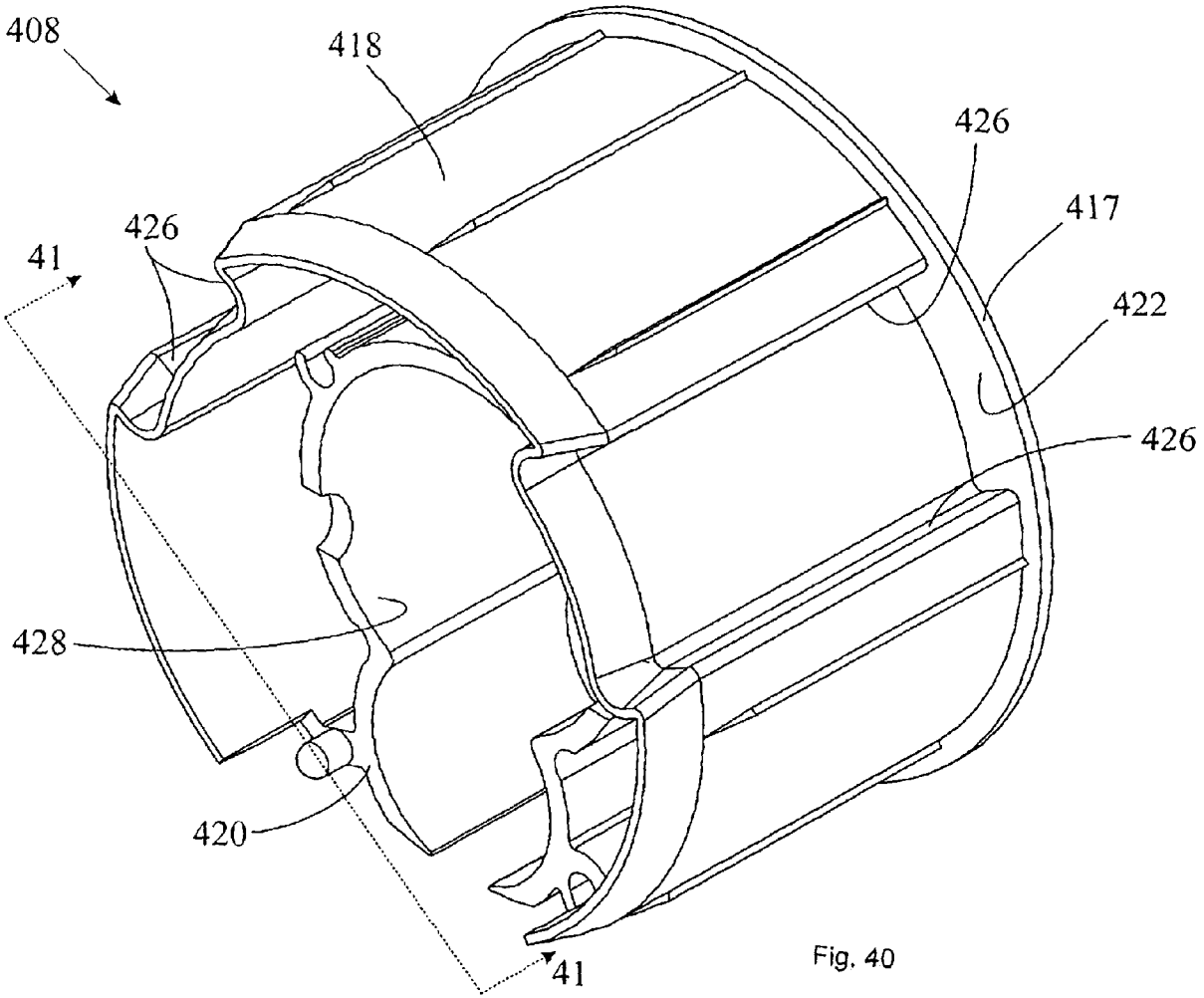
FIG. 40 is a perspective view of the spring-to-rail adapter of FIGS. 9 and 10.
Figure 41:
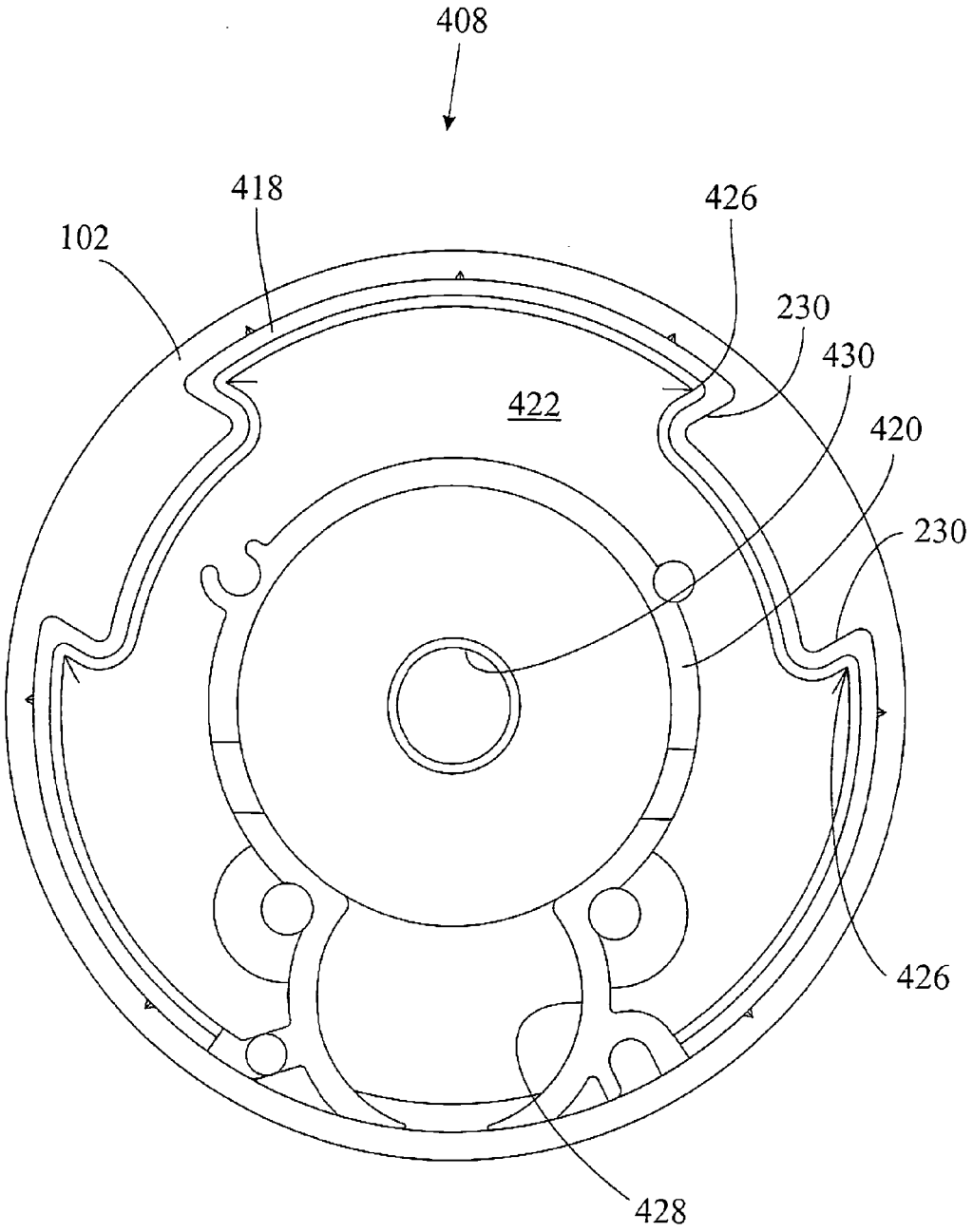
FIG. 41 is an end view, along line 41-41 of FIG. 40 but with the rotator rail added to show how the rail cooperates with the spring-to-rail adapter.

FIGS. 40 and 41 show the spring-to-rail adapter 408 in more detail. The spring-to-rail adapter 408 includes an annular disk 417, which defines an inside surface 422 and an outside surface 424. Projecting from the inside surface 422 are an outer skirt 418 and an inner skirt 420. The outer skirt 418 is very similar to the skirt 220 on the rotator rail adapter housing 180 of the clock spring assembly 118 described earlier. The outside shape of the outer skirt 418 matches very closely the inside shape of the rotator rail 102. The outer skirt 418 has shoulders 426, which receive the shoulders 230 in the rotator rail 102 (See FIG. 33) to ensure a positive engagement of the rotator rail 102 with the spring-to-rail adapter 408.

The inner skirt 420 is a an exact duplicate of the motor housing 414 (in fact, the inner skirt 420 can be manufactured by securing the motor housing 414 to the inside surface 422 of the spring-to-rail adapter 408 such that the motor housing 414 and the inner skirt 420, when assembled, create a cavity 428 which houses, and supports for rotation, the spring motor 412 and the output spool 410, as described below).

An opening 430 in the axial centerline of the annular disk 417 provides a passageway for the output shaft 456 of the output spool 410 to pass through and engage the non-circular cavity 406 in the skew adjustment screw cover 404.

Figure 43:
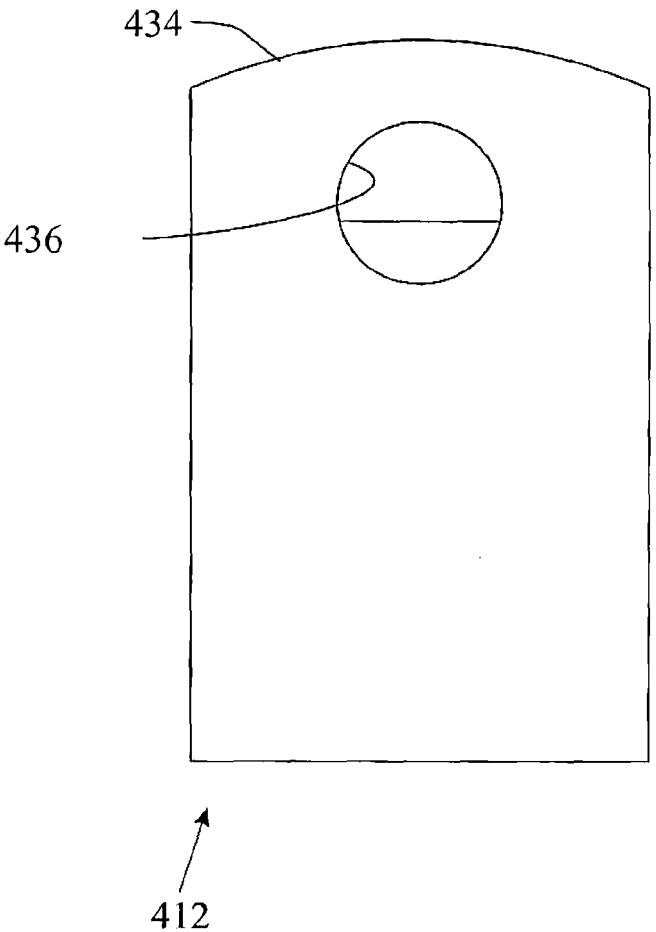
FIG. 43 is a view of the motor spring along line 43-43 of FIG. 42.
Figure 42:
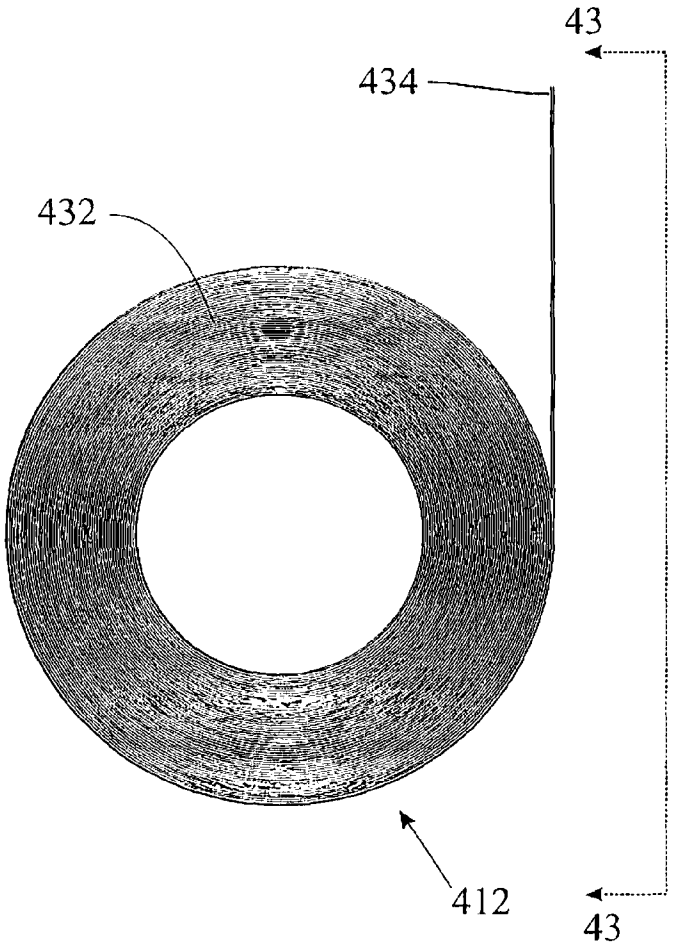
FIG. 42 is an end view of the spring of FIGS. 9 and 10.

FIGS. 42 and 43 show the spring 412, which is a flat, long strip of metal wound up on itself to form a coil 432, having an outer end and an inner end. The outer end 434 extends outwardly from the coil 432, and the spring defines a hole 436 proximate its outer end 434.

Figure 45:
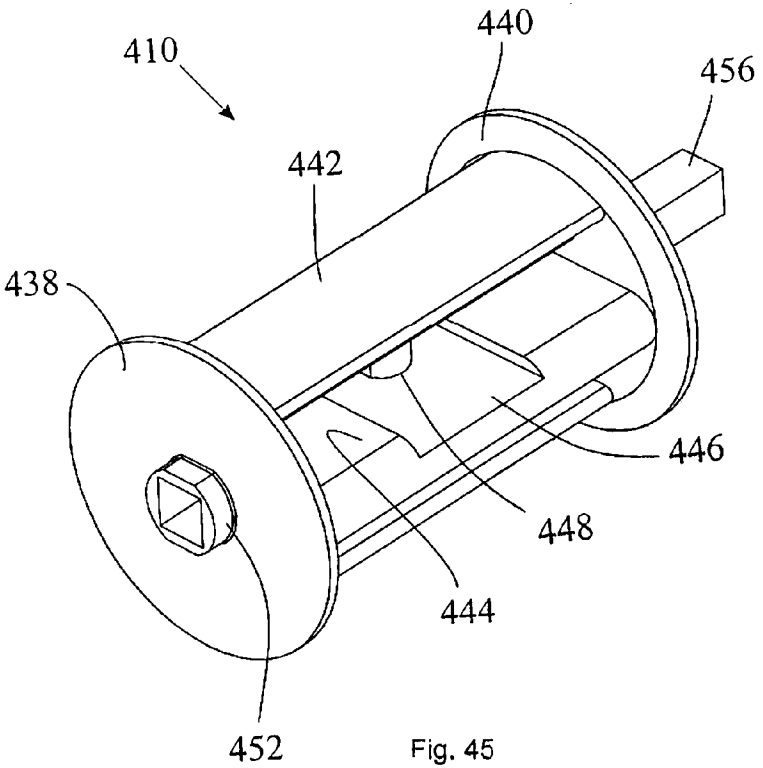
FIG. 45 is an opposite end perspective view of the output spool of FIG. 44.
Figure 44:
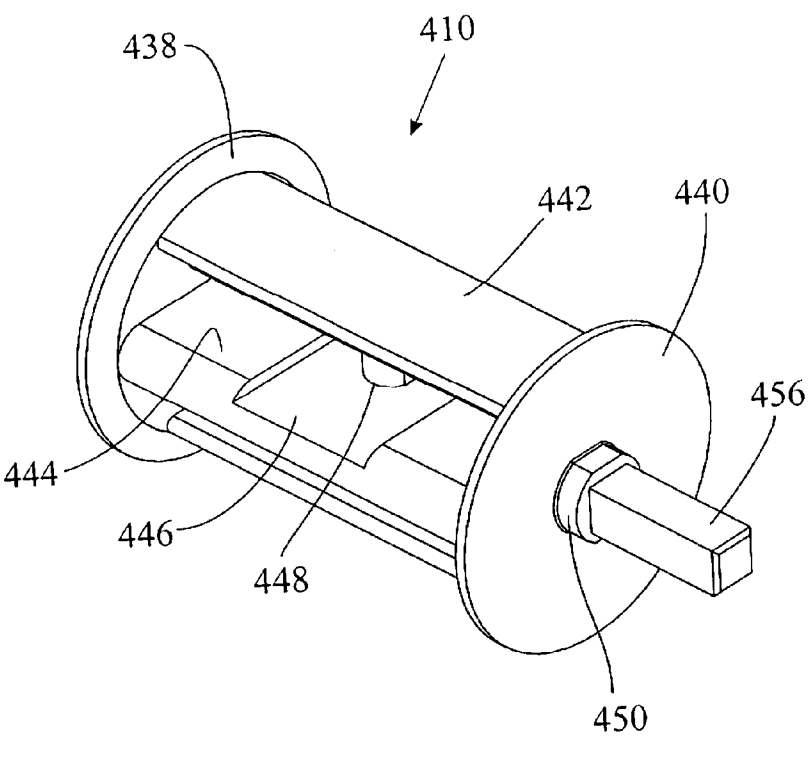
FIG. 44 is a perspective view of the output spool of FIGS. 9 and 10.

FIGS. 44 and 45 show the output spool 410, which includes two end flanges 438, 440 interconnected by a shaft 442. The shaft 442 defines a longitudinally extending channel 444 and a recessed flat 446, with a button 448 projecting downwardly toward the recessed flat 446. The first end 434 of the spring 412 slides inside the channel 444 and its central portion is depressed into the recessed flat 446 to slide the hole 436 under the button 448. When the central portion of the spring 412 returns to the normal level of the channel 444, the button 448 on the output spool 410 snaps through the hole 436 on the spring 412 to lock the spring 412 onto the output spool 410. The output spool 410 also includes short round shoulders 450, 452 just outside the end caps 440, 438 respectively, and these shoulders 450, 452 provide a bearing support for the spring-to-rail adapter 408 at its opening 430, permitting the spring-to-rail adapter 408 to rotate about the output spool 410.

An output shaft 456 projects beyond the shoulder 450, and this output shaft 456 slides into the cavity 406 in the skew adjustment screw cover 404 so that the output shaft 456 and thus also the output spool 410 are precluded from rotation relative to the adjustment screw cover 404 and therefore also precluded from rotation relative to the end cap 112.

The shoulder 452, opposite the output shaft 456, provides a bearing support for the motor housing 414 at the opening 454 of the motor housing, to permit the motor housing 414 to rotate about the output spool 410. (See FIG. 10) Finally, the rivets 416 attach the motor housing 414 to the inner skirt 420 of the spring-to-rail adapter 408, snugly trapping the spring motor 412 and the output spool 410 inside the "figure 8"-shaped cavity 428 of the spring-to-rail adapter 408.

Assembly and Operation of the Spring Motor Assembly

Referring to FIGS. 9 and 10, the spring motor 412 is assembled to the output spool 410 by inserting the first end 434 of the spring 412 into the channel 444 until the button 448 in the output spool 410 snaps into the hole 436 in the spring 412, locking these two items 410, 412 together. This subassembly is then inserted into the cavity 428 defined by the inner skirt 420 of the spring-to-rail adapter 408 such that the output shaft 456 extends through the opening 430 in the spring-to-rail adapter 408. The motor housing 414 is attached, by means of the rivets 416 (or other fastening means), to the inner skirt 420 of the spring-to-rail adapter 408 in order to enclose the output spool 410 and spring motor 412 subassembly. The output shaft 456, which is projecting beyond the spring-to-rail adapter 408, is inserted into the cavity 406 in the skew adjustment screw cover 404, which is already attached to the end cap 112 as was described in relation to the clock spring assembly 118. One end of the rotator rail 102 slides over the outer skirt 418 of the spring-to-rail adapter 408, such that the shoulders 426 on the spring-to-rail adapter 408 provide positive rotational engagement with the shoulders 230 in the rotator rail 102.

Figure 36:
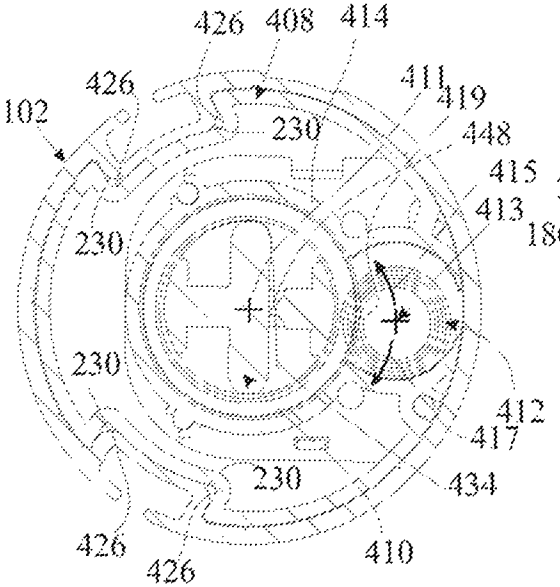
FIG. 36 is a sectional view taken along line 36-36 of FIG. 14 depicting a spring motor assist mechanism to tilt open the shade once it is fully lowered.
Figure 38:
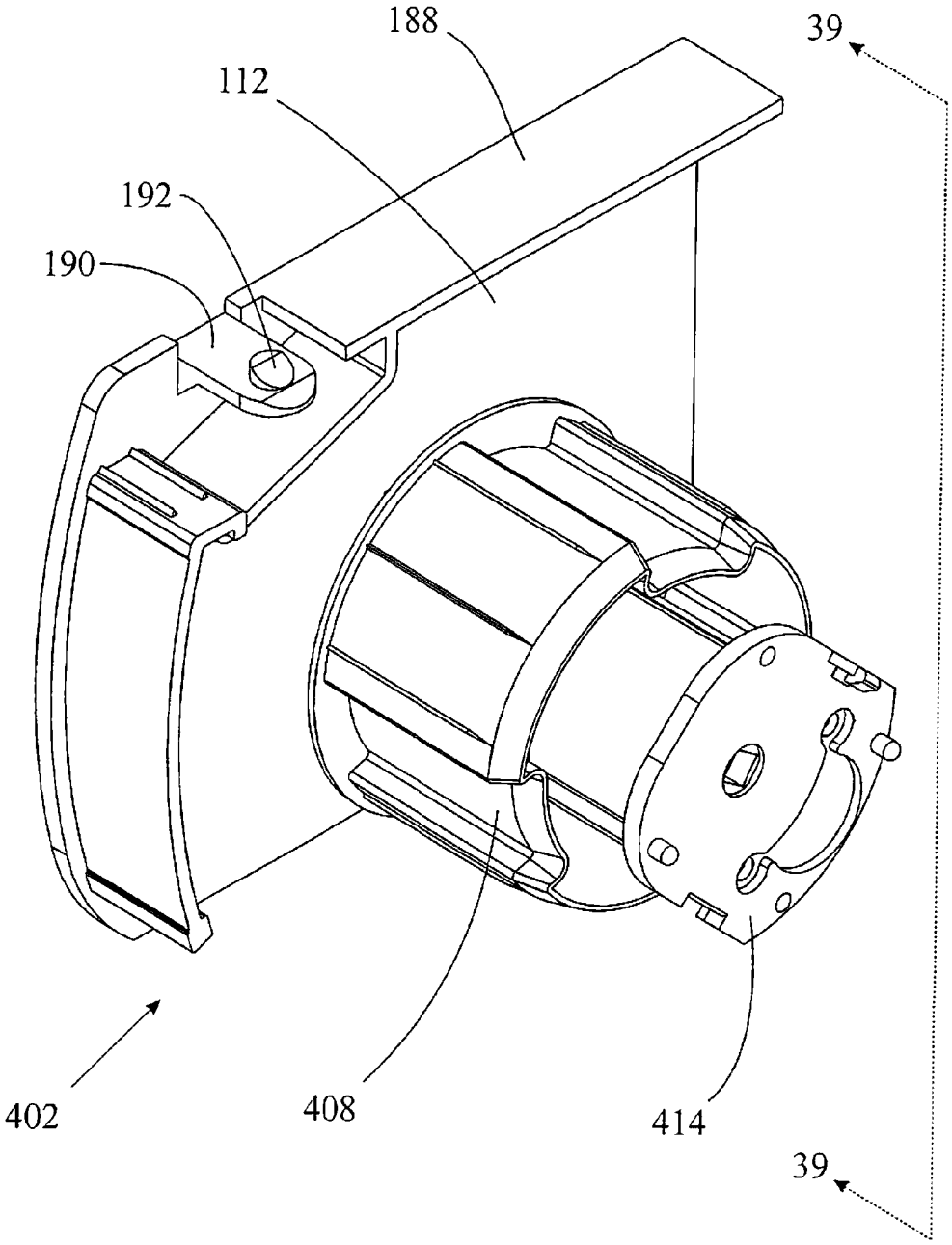
FIG. 38 is an assembled, perspective view of the spring motor assist mechanism of FIGS. 9 and 10.
Figure 39:
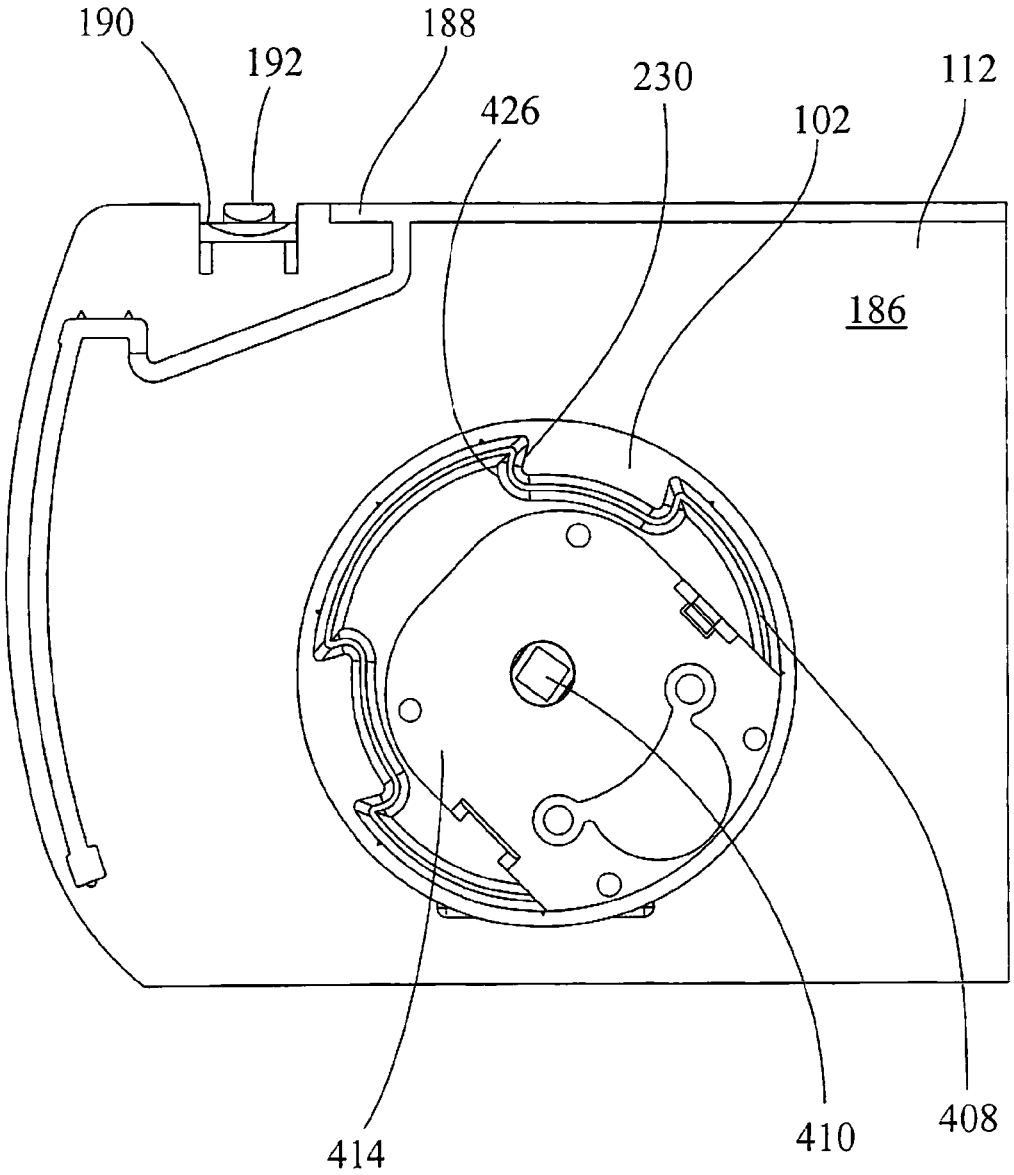
FIG. 39 is a view along line 39-39 of FIG. 38, but with the rotator rail added in this view while it is not present in FIG. 38.

FIG. 36 shows the assembled spring 412, output spool 410, motor housing 414, spring-to-rail adapter 408, and rotator rail 102, with the spring 412 partially wrapped onto the output spool 410.

As the drive cord 116 is pulled to raise the shade 400, it causes the rotator rail 102 to rotate clockwise (as seen from the vantage point of FIGS. 2 and 9), which also causes the spring-to-rail adapter 408 to rotate in a clockwise direction. Since the output shaft 456 and thus the output spool 410 are fixed relative to the end cap 112, they are unable to rotate with the spring-to-rail adapter 408. However, the inner skirt 420 and the motor housing 414, which together enclose the output spool 410 and the spring 412, push against the spring 412, causing it to rotate clockwise with the spring-to-rail adapter 408. Since the first end 434 of the spring 412 is attached to the fixed output spool 410, the spring 412 unwraps from itself and winds up onto the shaft 442 of the output spool 410. This creates a potential energy in the spring motor 402, as the spring 412 wants to return to its original coiled shape.

Figure 4:
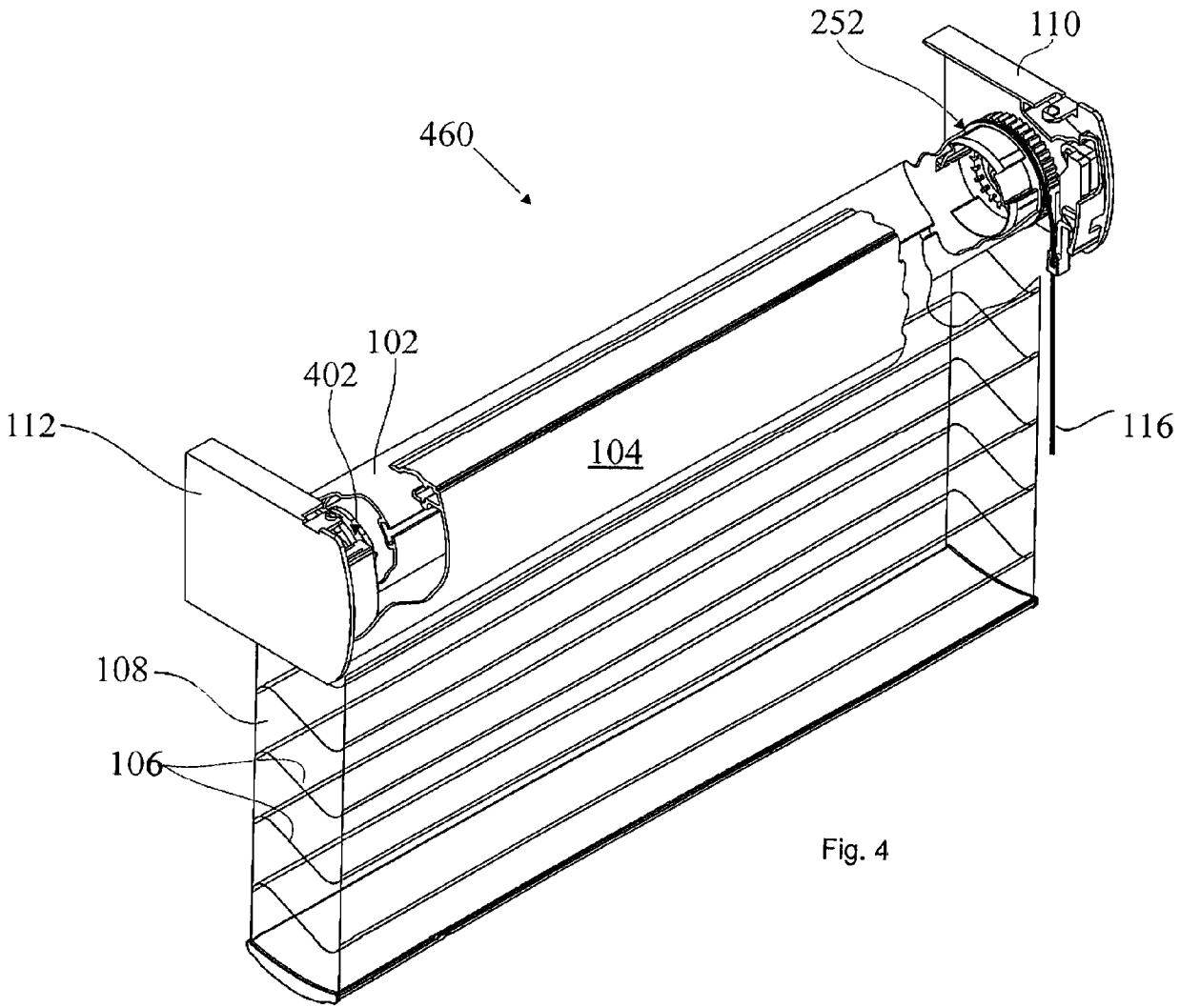
FIG. 4 is a partially broken away perspective view of another variable light control shade incorporating a cord drive with a weight assist brake and a motor spring assembly made in accordance with the present invention.

Then, when the drive cord 116 is pulled forward, releasing the spring assist brake 114, and allowing the ladder tapes 108 to unwind from the rotator rail 102, the rotator rail 102 and the spring-to-rail adapter 408 rotate counter-clockwise. The spring 412 assists that counter-clockwise rotation and lowering of the blind, as it unwinds from the shaft 442 of the output spool 410 and wraps back onto itself, returning to its original, relaxed state. The spring 412 is installed in the spring motor assembly 402 in such a manner that, as the shade 400 reaches its fully lowered position, the spring 412 is not yet fully unwound from the output spool 410, leaving enough potential energy in the spring 412 to push the spring-to-rail adapter 408 (and thus also the rotator rail) to "kick" over far enough to tilt open the slats 106. As noted with respect to the clock spring mechanism described earlier, the spring motor mechanism may also be readily reversed such that as the shade is being raised, the spring motor is being coiled back onto itself (instead of being uncoiled), assisting in raising the shade Other Embodiments FIG. 4 depicts a fifth embodiment of a shade 460 made in accordance with the present invention. The shade 460 includes the weight assist brake 252 of the second embodiment 250 and the spring motor assembly 402 of the fourth embodiment 400. These components 252, 402 operate in the same manner in this embodiment 460 as they do in the context of their respective embodiments 250, 400.

Figure 6:
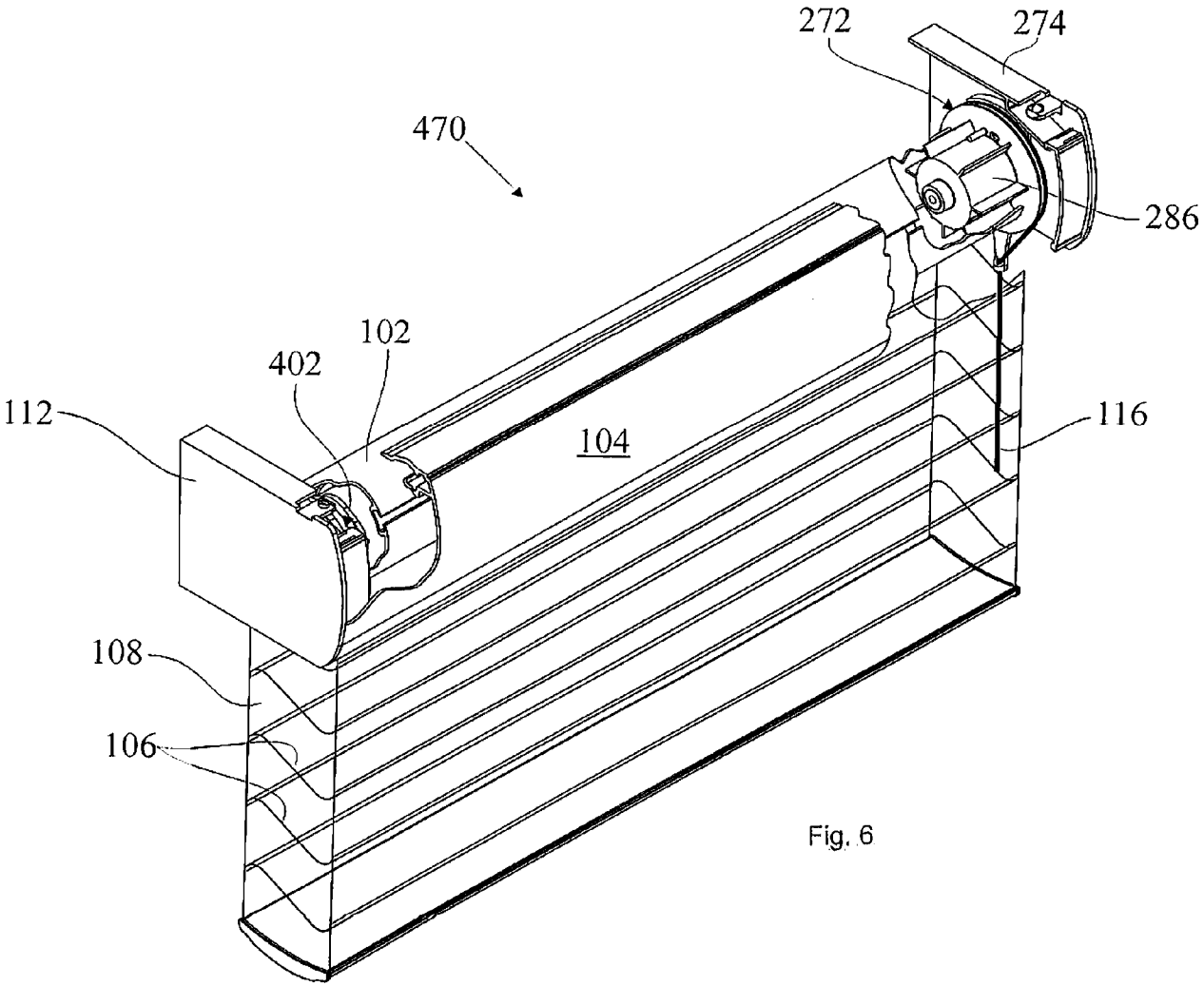
FIG. 6 is a partially broken away perspective view of another variable light control shade incorporating a cord drive with a spring clamp brake and a spring motor assembly made in accordance with the present invention.

FIG. 6 depicts a sixth embodiment of a shade 470 made in accordance with the present invention. The shade 470 includes the spring clamp automatic brake 272 of the third embodiment 270 and the spring motor assembly 402 of the fourth embodiment 400. These components 272, 402 operate in the same manner in this embodiment 470 as they do in the context of their respective embodiments 270, 400.

Figure 46:
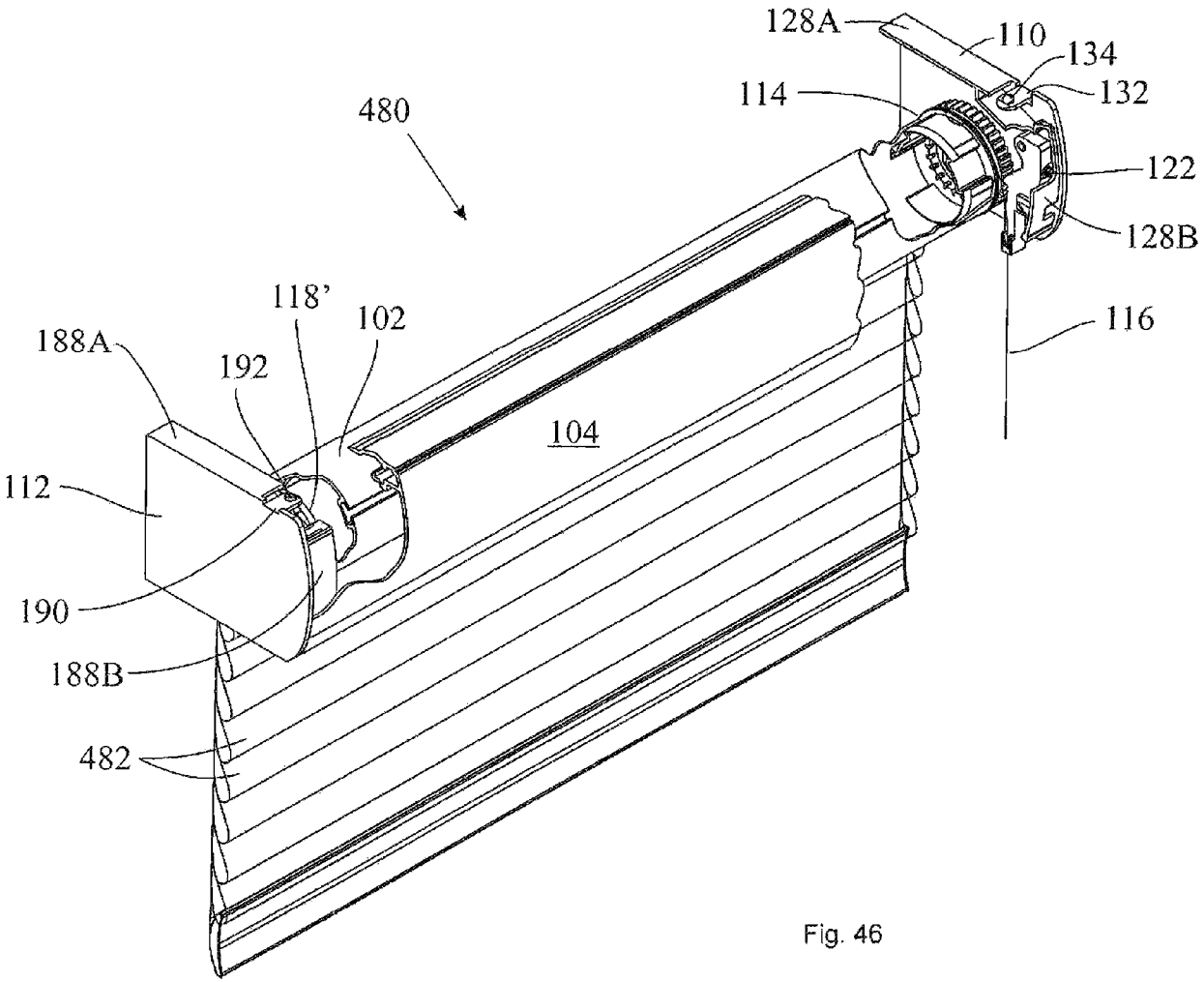
FIG. 46 is a perspective view of an embodiment of a non-variable light control shade, similar to the embodiment of FIG. 1, utilizing a spring assist brake and a clock spring housing assembly but without a clock spring, since there is no need to "kick" the rotator rail over when the shade is fully extended to tilt the slats open, as there are no slats.

FIG. 46 depicts a seventh embodiment 480 of a shade made in accordance with the present invention. The shade 480 is a non-variable light control shade, typically referred to as a Roman shade 480, which includes folds 482 which hang down into the room side of the shade 480. The Roman shade 480 includes the spring assist brake 114 and a clock spring assembly 118', similar to the first embodiment 100 of FIG. 1, with the exception that the clock spring assembly 118' in this instance does not require the clock spring 182 itself. Thus, the clock spring 182 may be left out of the assembly 118' with no detrimental effect on the operation of the shade 480, as discussed below.

Figure 14:
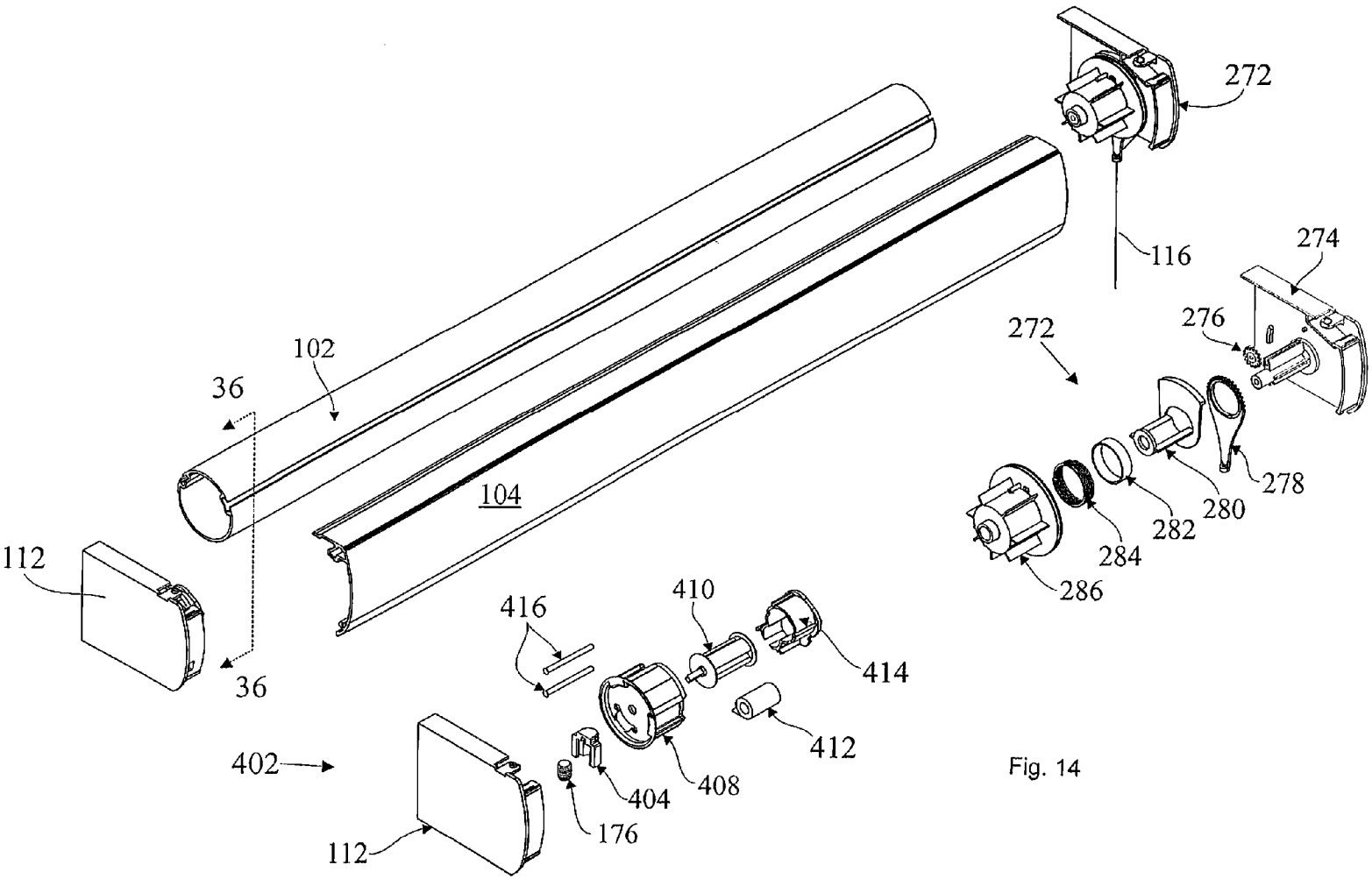
FIG. 14 is an exploded, perspective view of the blind of FIG. 6, with the spring clamp brake and spring motor assembly also exploded.
Figure 47:
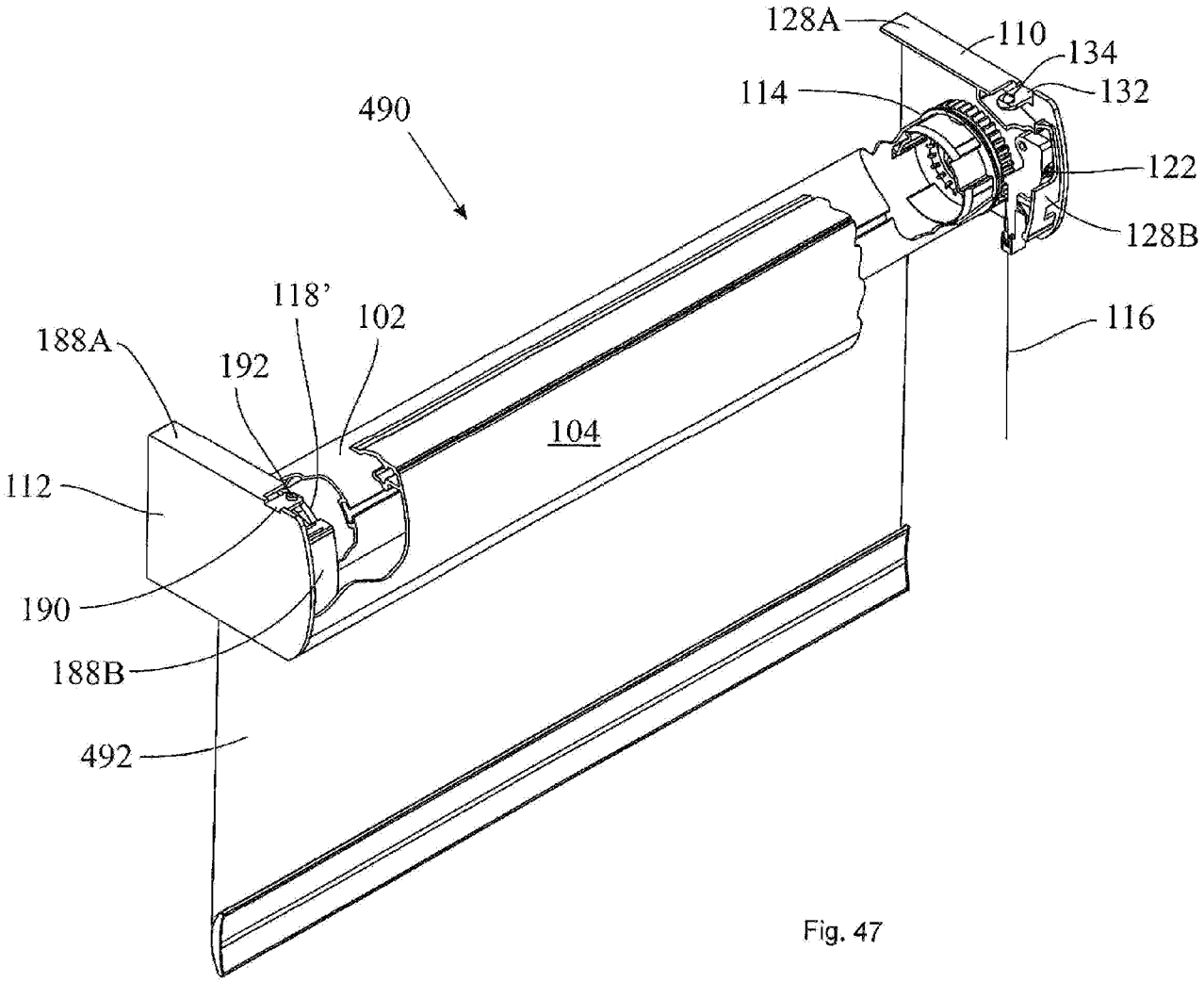
FIG. 47 is a perspective view of yet another non-variable light control shade, similar to that of FIG. 46, also utilizing a spring assist brake and a clock spring housing assembly but without a clock spring, since there is no need to "kick" the rotator rail over when the shade is fully extended to tilt the slats open as there are no slats.
Figure 48:
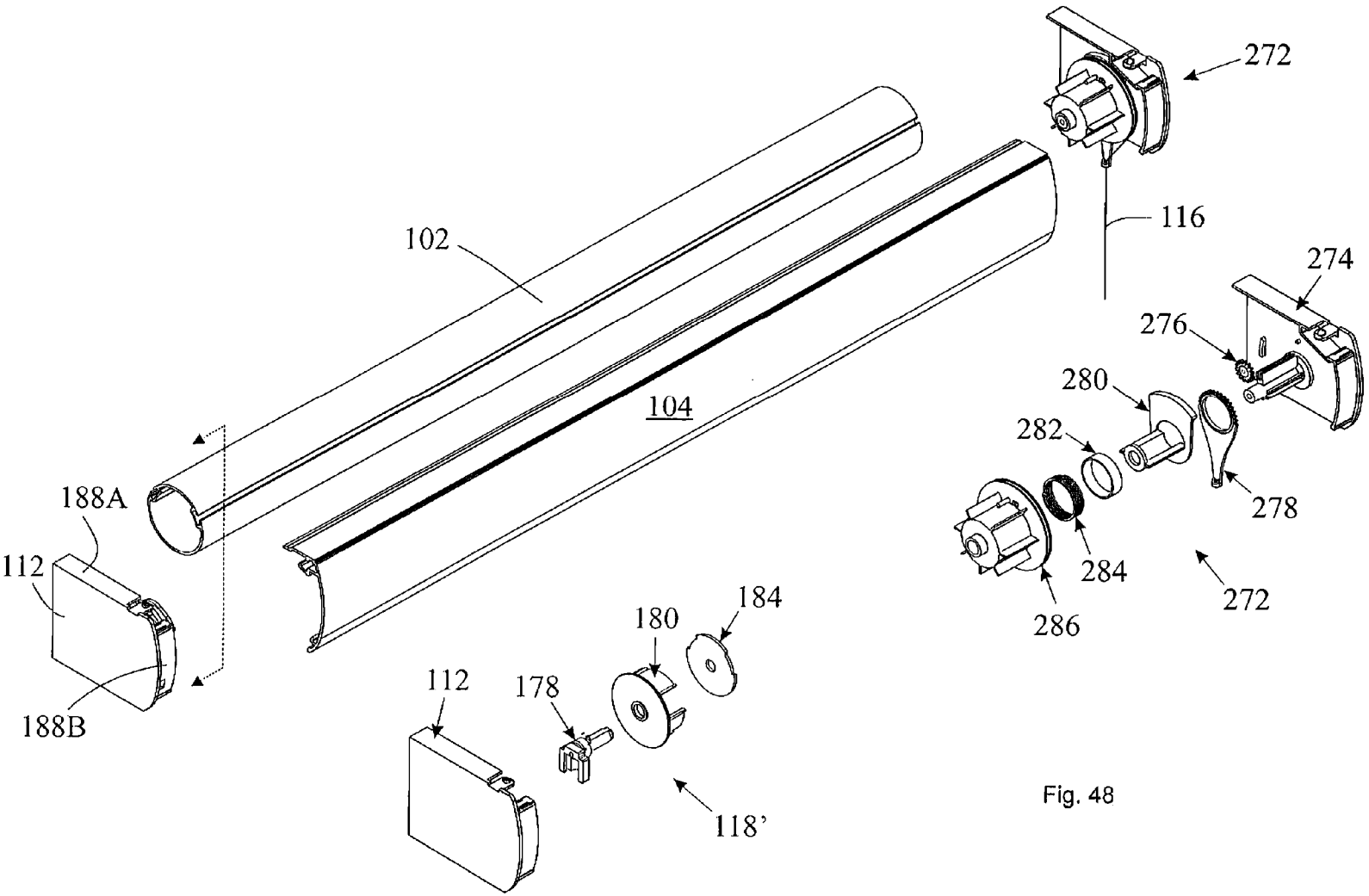
FIG. 48 is an exploded, perspective view of a non-variable light control shade assembly, similar to FIG. 13, but showing the absence of the clock spring which is not needed for non-variable light control shade such as those depicted in FIGS. 46 and 47.
Figure 49:
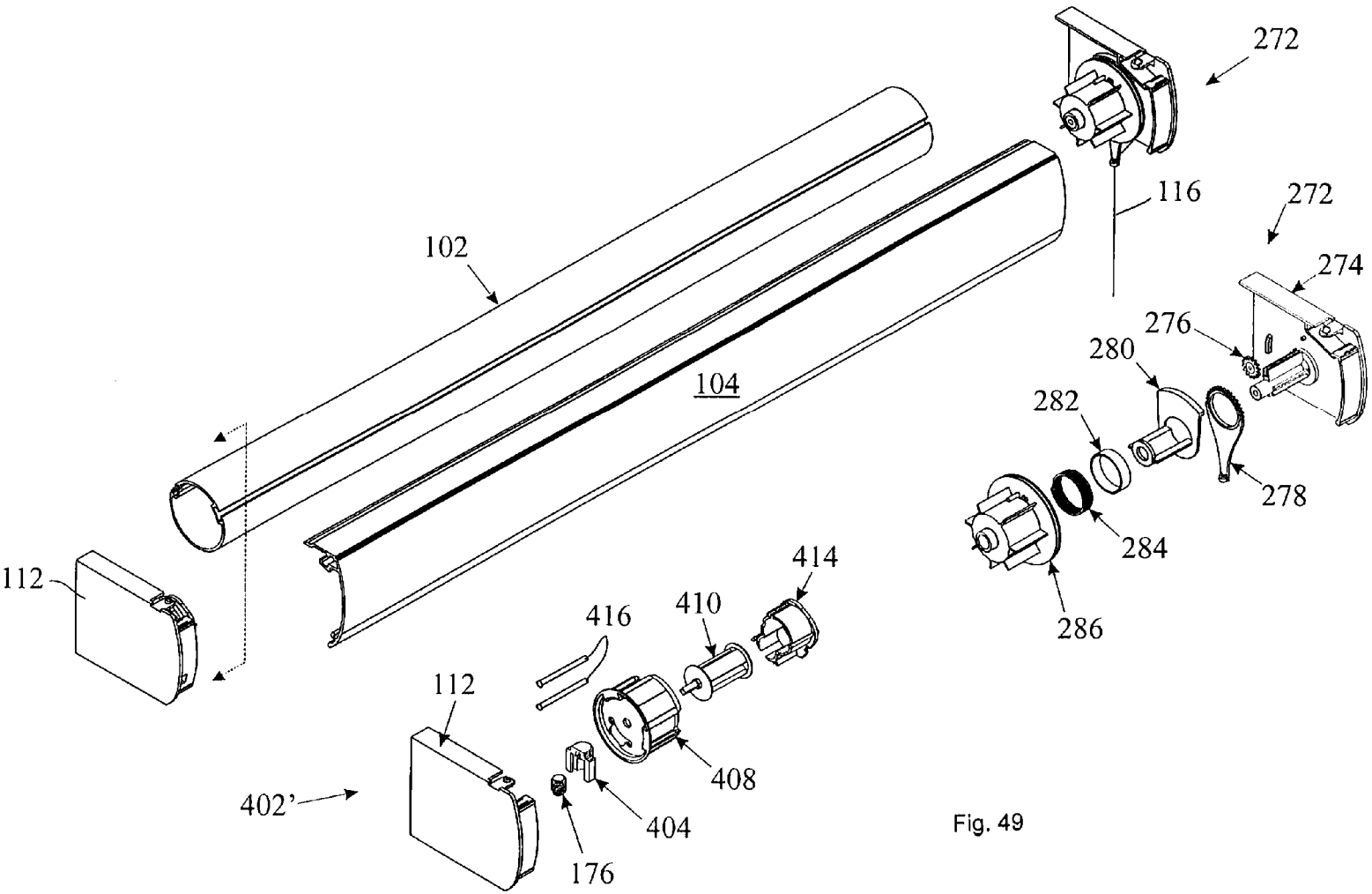
FIG. 49 is an exploded, perspective view of a non-variable light control shade assembly, similar to FIG. 14 but showing the absence of the spring motor which is not needed for non-variable light control shade such as those depicted in FIGS. 46 and 47.

FIG. 47 depicts an eighth embodiment 490 of a shade made in accordance with the present invention. The shade 490 is a non-variable light control shade, typically referred to as a roller shade 490. As in the case of the Roman shade 480, the roller shade 490 includes the spring assist brake 114 and a clock spring assembly 118' similar to the first embodiment 100 of FIG. 1, with the exception that the clock spring assembly 118' once again does not require the clock spring 182 itself. Thus, the clock spring 182 may be left out of the assembly 118' with no detrimental effect on the operation of the shade 490. For both the Roman shade 480 and the roller shade 490, there are no slats 106 as in the case of the variable light control shades described earlier. A panel 492 (See FIG. 47) extends down to cover the window opening or retracts by winding onto the rotator rail 102 to uncover the window opening. Since there are no slats 106 to tilt open or closed, there is no need for a spring assist to "kick over" the rotator rail 102 at the end of its run to ensure that the slats 106 are able to tilt fully open, as was the case with the variable light control shades described earlier. Thus, the spring assist assemblies, whether it be the clock spring assembly 118 of FIG. 7 or the spring motor assembly 402 of FIG. 9, may be used in the Roman shade 480 or in the roller shade 490, or the springs (182 and 412 respectively) may be omitted from the spring assist assemblies 118, 402 with no detrimental effect on the performance or operation of the shades 480, 490. This is depicted in FIGS. 48 and 49, which detail rotator rail assemblies similar to those shown in FIGS. 13 and 14 respectively, but where, in FIG. 48, the clock spring assembly 118' does not include the clock spring 182, and in FIG. 49 the spring motor assembly 402' does not include the spring motor 412.

If desired, simpler spring-to-rail adapter housings may be substituted for either of the "modified" spring assist assemblies 118', 402'. In fact, any of the shades disclosed may use any combination of brakes disclosed with any combination of spring assist assemblies disclosed (clock spring assembly 118, spring motor assembly 402, or their springless modifications 118', 402' respectively). Of course, other modifications and combinations will also be obvious to those skilled in the art. In the case of the variable light control shades, it may be desirable to use the "unmodified" spring assist assemblies 118, 402 in order to have control of the tilting of the slats 106 via the drive cord 116. In the case of the non-variable light control shades, such as the Roman shade 480 and the roller shade 490, it may be desirable to use the "modified" spring assist assemblies 118', 402', since the "kick over" feature the springs provide is not required in these shades.

Figure 50:
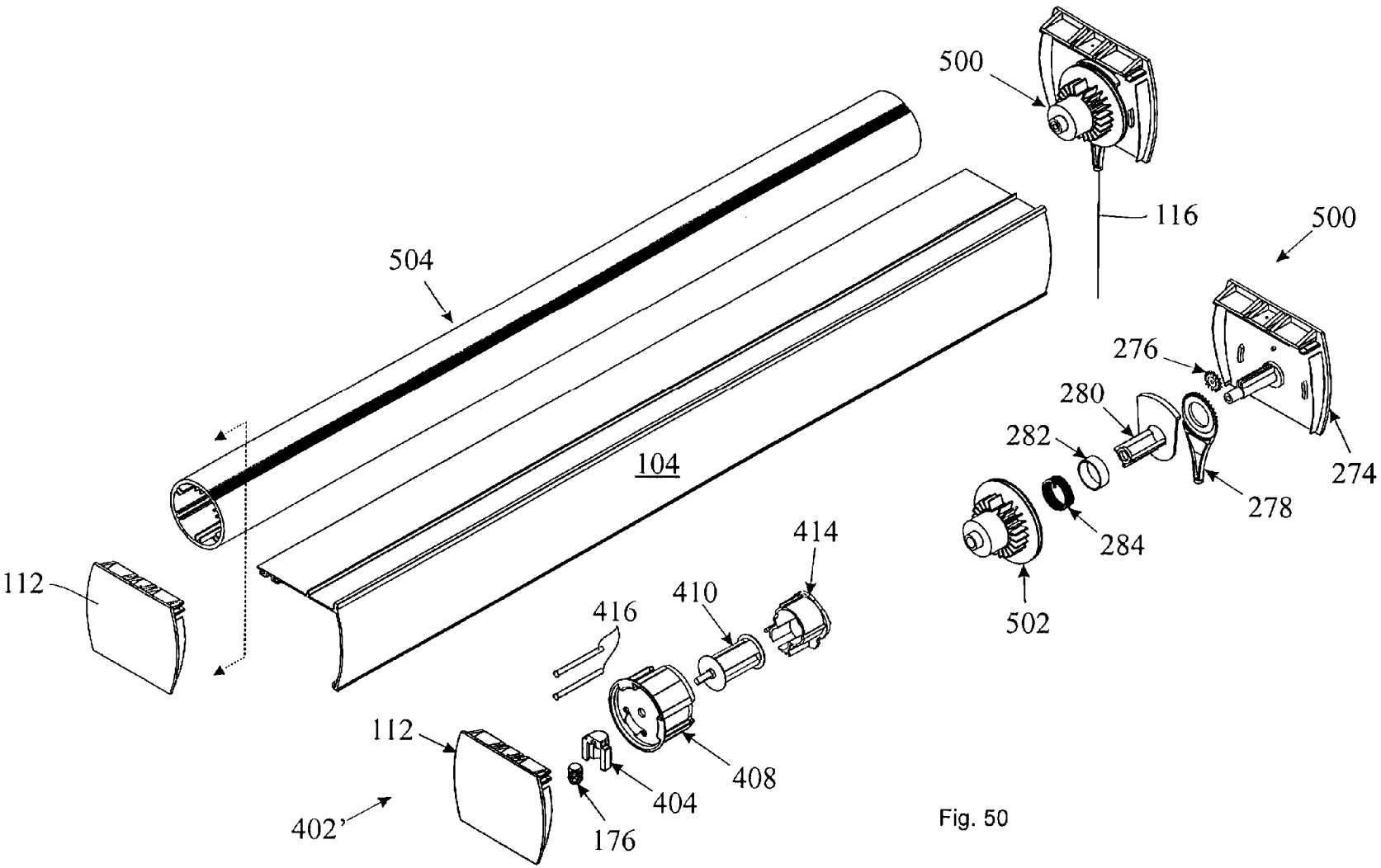
FIG. 50 is an exploded view of a non-variable light control shade assembly, similar to FIG. 49, but showing another embodiment of the spring clamp brake assembly wherein the drive-cord-spool-to-rotator-rail adapter is of slightly different design.

FIG. 50 depicts a second embodiment of a spring clamp brake 500 made in accordance with the present invention. This brake 500 is identical in its operation and of very similar manufacture to the clamp spring brake 272 of FIG. 11, the main difference being in the spool-to-rail adapter 502.

Figure 51:
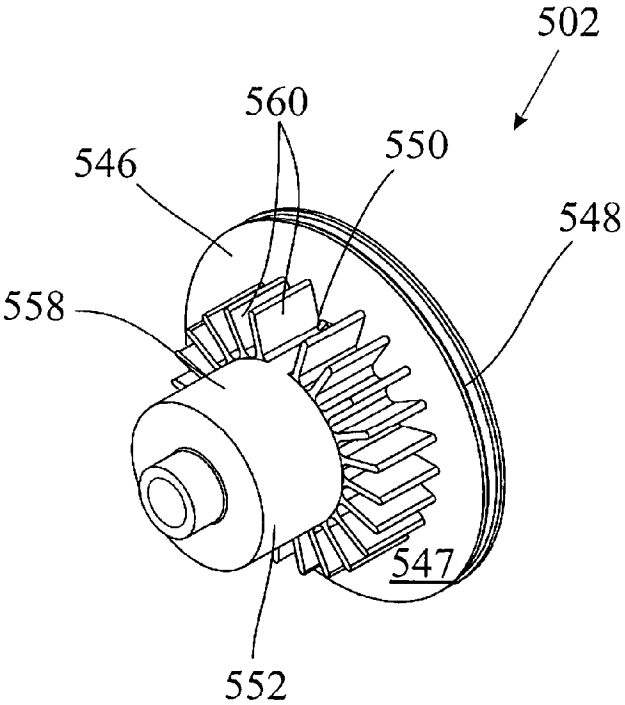
FIG. 51 is a perspective view of the drive-cord-spool-to-rotator-rail adapter of FIG. 50.

As seen in FIG. 51, the spool-to-rail adapter 502 (also called the drive cord spool 502) is similar to the adapter 286 of FIG. 11. It includes an annular disk 546, which defines a groove 548 along its perimeter, where the drive cord 116 winds up onto the drive cord spool 502. A single opening 550 extends from the inner surface 547 of the disk 546 to the groove 548, so the drive cord 116 may be threaded through the opening 550 and tied off with a knot or grommet (not shown).

Figure 52:
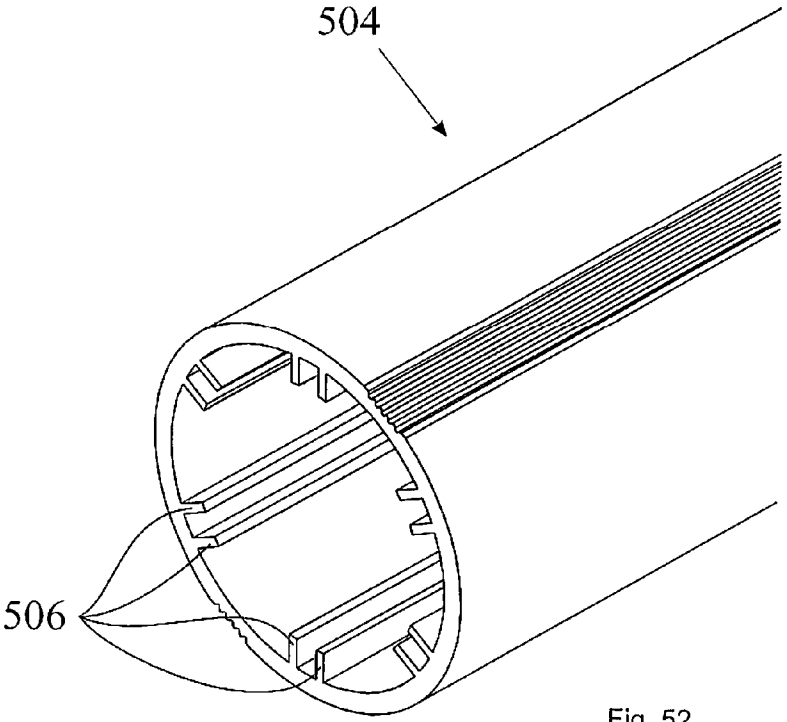
FIG. 52 is a perspective view of the rotator rail used with the drive-cord-spool-to-rotator-rail adapter of FIGS. 50 and 51.

A hollow cylindrical projection 552 projects inwardly from the inner surface 547 of the disk 546. The outside surface 558 of the cylindrical projection 552 includes a plurality of radially extending wings 560 sized to slide into and engage the inside wall of the rotator rail 504 (See FIG. 52) such that some of the wings 560 slide between and contact the shoulders 506 of the rotator rail 504 to provide positive engagement for rotation between the drive cord spool 502 and the rotator rail 504. The rest of the spool-to-rail adapter 502 is identical to the adapter 286 of FIG. 11.

Preferably, the drive cord 116 is secured through the opening 550, and the adapter 502 is then mounted into the rotator rail 504 such that the wings 560 of the adapter 502 engage the shoulders 506 in the rotator rail 504, and such that the opening 550 is closest to the bottom of the drive cord spool 502 when the shade is drawn all the way up (rolled onto the rotator rail 504) and the drive cord 116 is fully extended (uncoiled from the spool 502) so that the drive cord 116 is unable to exert any further rotational moment to the spool 502 when the shade is all the way up.

Figure 53:
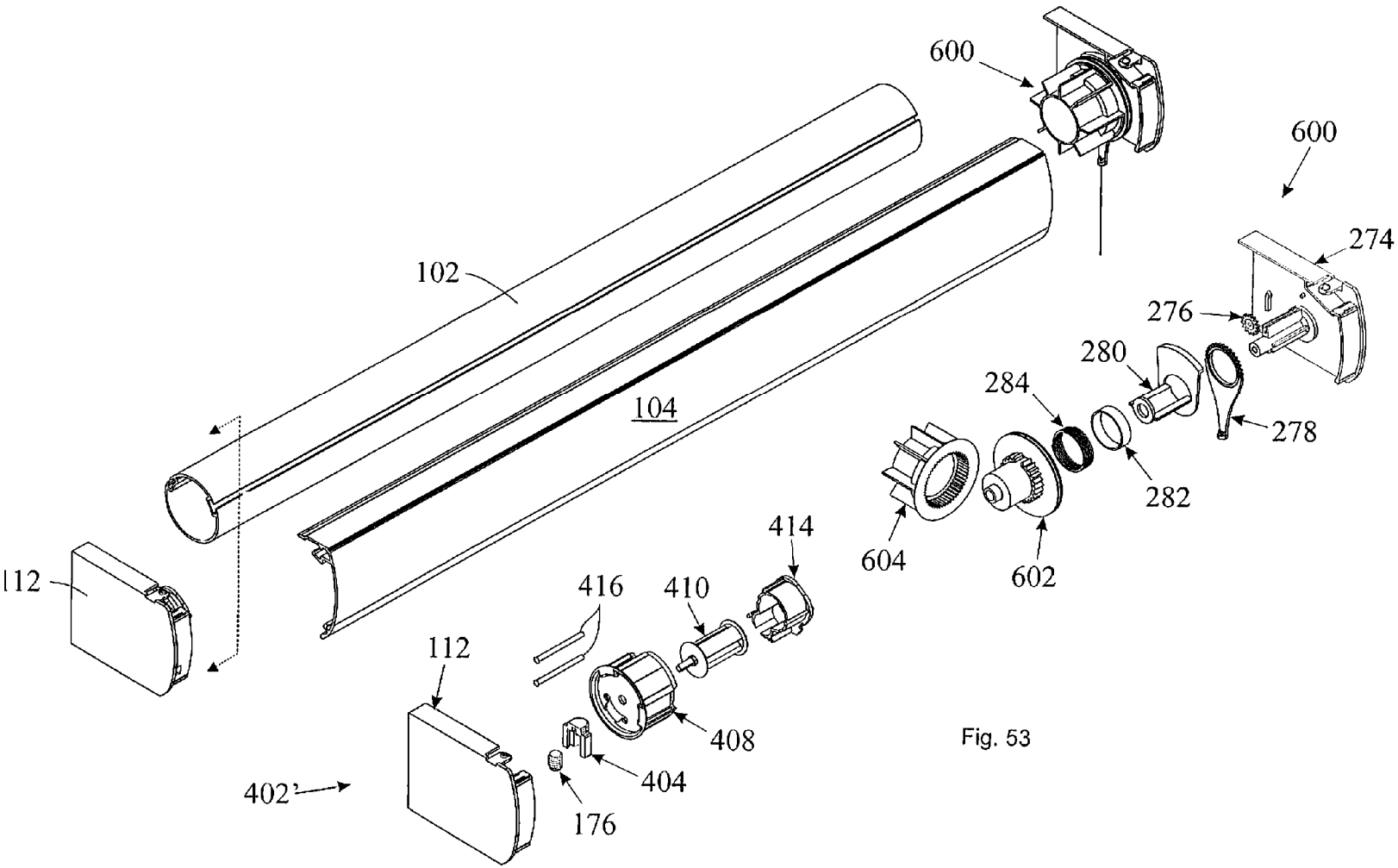
FIG. 53 is an exploded, perspective view of another shade assembly, similar to FIG. 50 but showing yet another embodiment of the spring clamp brake assembly wherein the drive-cord-spool-to-rotator-rail adapter is of a two-piece design.

FIG. 53 depicts a third embodiment of a spring clamp brake 600 made in accordance with the present invention. This brake 600 is identical in its operation and of very similar manufacture to the spring clamp brake 272 of FIG. 11, the main difference being in the two-piece, spool-to-rail adapter 602, 604.

Figure 54:
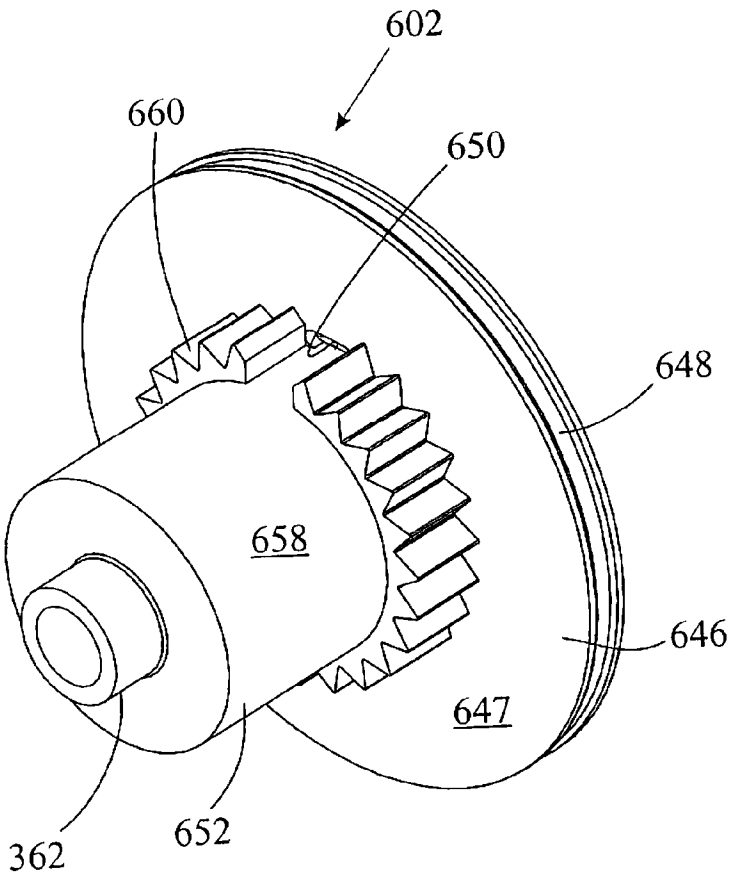
FIG. 54 is an exploded perspective view of the two-piece drive-cord-spool-to-rotator-rail adapter of FIG. 53.
Figure 54:
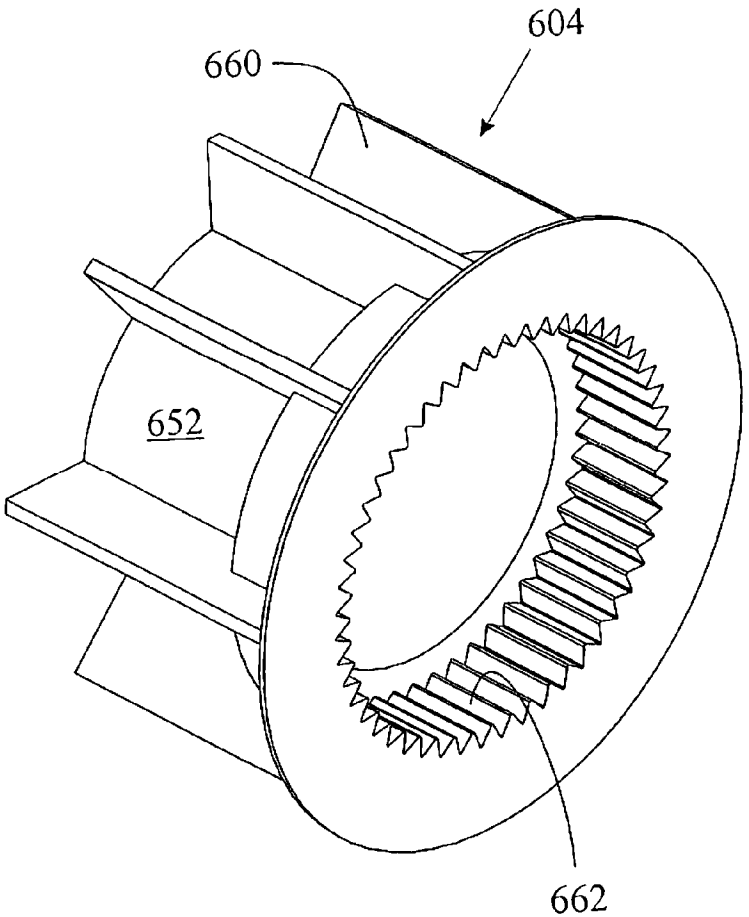

As seen in FIG. 54, the spool-to-rail adapter 602, 604 (also called the drive cord spool) is a two piece design which is similar to the single piece design 286 of FIG. 11. It includes an annular disk 646, which defines a groove 648 along its perimeter, where the drive cord 116 winds up onto the drive cord spool 602. A single opening 650 extends from the inner surface 647 of the disk 646 to the groove 648, so the drive cord 116 may be threaded through the opening 650 and tied off with a knot or grommet (not shown).

A hollow cylindrical projection 652 projects inwardly from the inner surface 647 of the disk 646. The outside surface 658 of the cylindrical projection 652 includes a plurality of radially extending gear teeth 660 sized to slide into and engage the inside gear teeth 662 of the adapter 604 (See FIG. 54) such that the spool 602 and the adapter 604 engage each other rotationally. The adapter 604 is thus a sleeve which fits over the spool 602 such that this two-piece design ultimately very much resembles the one piece adapter 286 of FIG. 11, but wherein the spool 602 and the adapter 604 may be aligned independently of each other. Thus, the adapter 604 may be mounted to the rotator rail 102 in the same manner as the adapter 286 of FIG. 11 is mounted to the same rotator rail 102. The spool piece 602 is in turn mounted to the adapter 604 such that the opening 650 is closest to the bottom of the drive cord spool 602 when the shade is drawn all the way up (rolled onto the rotator rail 102) and the drive cord 116 is fully extended (uncoiled from the spool 602) so that the drive cord 116 is unable to exert any further rotational moment to the spool adapter assembly 602, 604 when the shade is all the way up.

Figure 55:
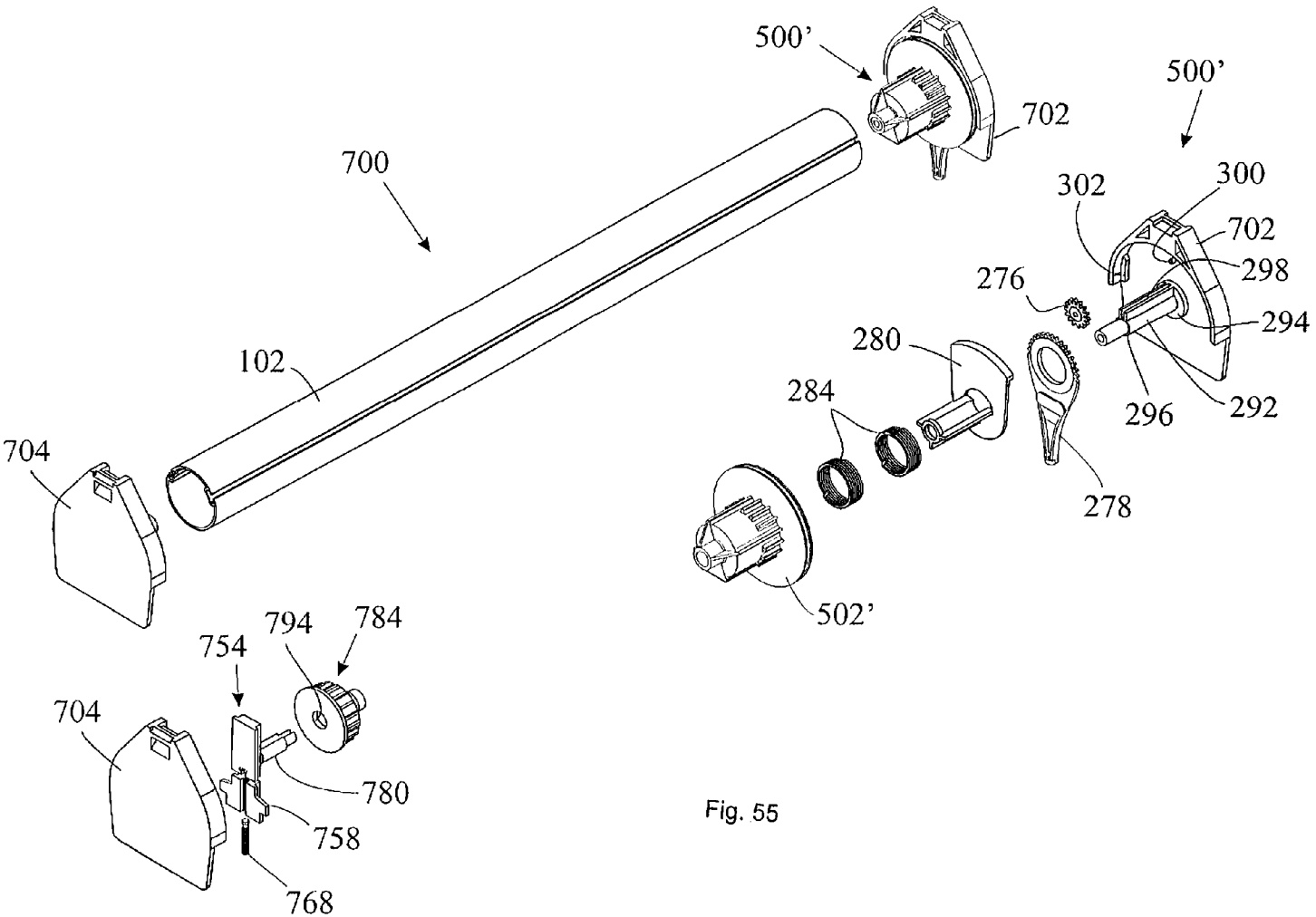
FIG. 55 is an exploded view of a non-variable light control shade assembly, similar to FIG. 50, but showing another embodiment of the end caps as well as another embodiment of the spring clamp brake assembly wherein the drive-cord-spool-to-rotator-rail adapter is of very slightly different design.

FIG. 55 shows yet another embodiment of a shade 700 made in accordance with the present invention, which is very similar to the shade depicted in FIG. 50 except that the spool-to-rail adapter 502' of the spring clamp brake 500' is slightly different (but identical in its operation), and the end caps 702, 704 are different, including the skew adjustment mechanism and the idler-end rotator rail adapter 784, as described below.

As depicted in the exploded view of FIG. 55, the control-end end cap 702 has many of the same features of the end cap 274 (See FIG. 15) already described, including the shaft 292, the first shoulder 294, the second shoulder 296, the channel 298, the second stub shaft 300, and the limit stop 302, all of which are used in the same manner for mounting and operation of the components of the spring clamp brake 500' as are used for the spring clamp brake 500 already described, including the transfer gear 276, the actuator arm 278, the brake spring actuator 280, the springs 284, and the spool-to-rail adapter 502'. The difference between this control-end end cap 702 and the end cap 274 of FIG. 15 is described below.

Figure 56:
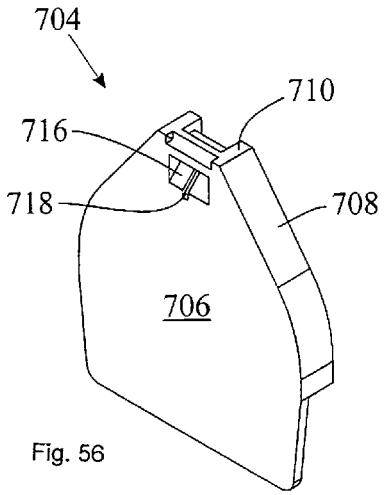
FIG. 56 is a perspective view of the idler-end end cap and skew adjustment mechanism of FIG. 55.
Figure 57:
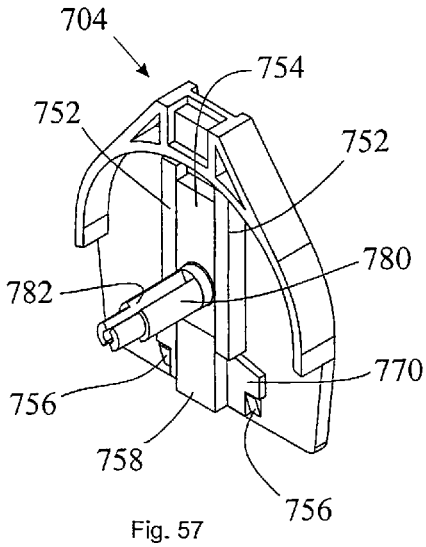
FIG. 57 is a perspective view of the opposite side of the idler-end end cap and skew adjustment mechanism of FIG. 55.
Figure 58:
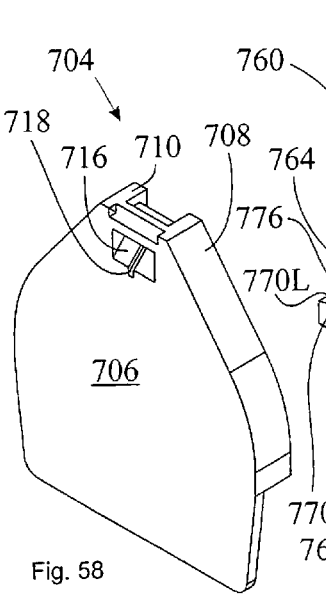
FIG. 58 is an exploded, perspective view of the end cap and skew adjustment mechanism of FIG. 56.

FIGS. 56-59A show the idler-end end cap 704. Referring briefly to FIG. 56 for an idler-end end cap 704 and to FIG. 69 for a control-end end cap 702, the features which they have in common are the flat back surface 706, the arcuate flanges 708 with a blunt nosed peak 710, a first ramped surface 712, a rectangular cavity 714 including a second ramped surface 716, a slot 718 on the second ramped surface 716, and ribs 720 also on the second ramped surface 716. How these end caps 702, 704 mount to brackets 722, 724 (See FIGS. 60 and 61) is explained below.

Figure 59A:
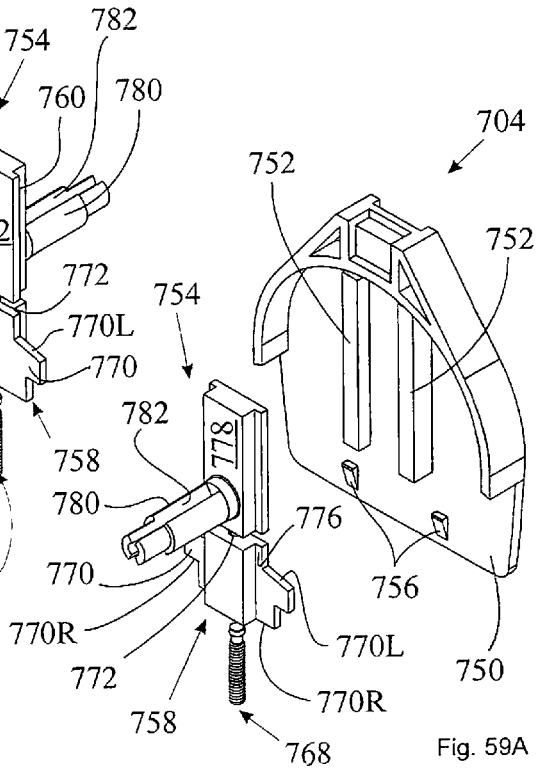
FIG. 59A is an exploded, perspective view of the end cap and skew adjustment mechanism of FIG. 57.
Figure 59B:
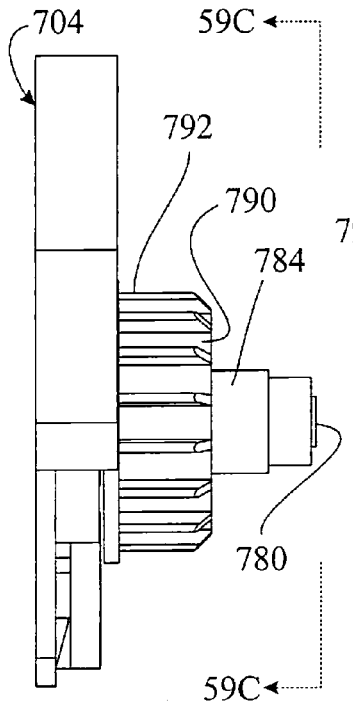
FIG. 59B is an end view of the end cap and skew adjustment mechanism of FIG. 55, including the rotator rail adapter.
Figure 59C:
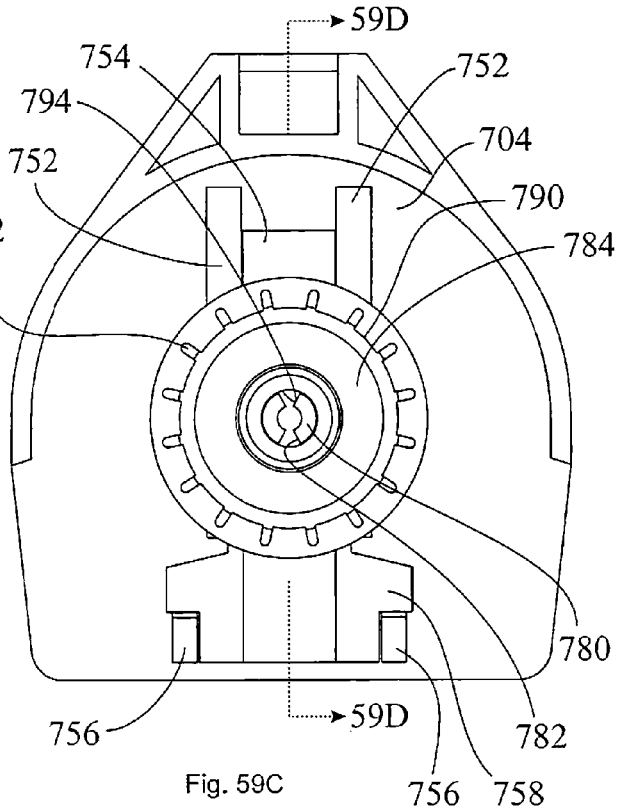
FIG. 59C is a view along line 59C-59C of FIG. 59B.
Figure 59D:
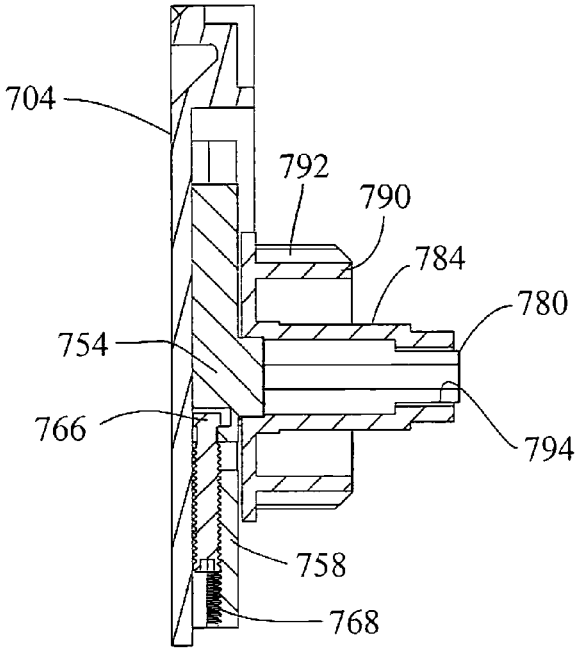
FIG. 59D is a sectional view along line 59D-59D of FIG. 59C.

FIGS. 59B, 59C, and 59D show the idler-end end cap 704 with its respective rotator rail adapter 784 (See also FIG. 55). This idler-end rotator rail adapter 784 is similar to the spool-to-rotator-rail adapter 502' of the spring clamp brake 500' of FIG. 55 in that it includes a cylindrical body with a plurality of radially projecting vanes 792 designed to engage the interior profile of the rotator rail 102, and a through opening 794 (See FIG. 55) to be received by and for rotation about the shaft 780 of the adjustment pad 754 of the skew adjustment mechanism.

Figure 60:
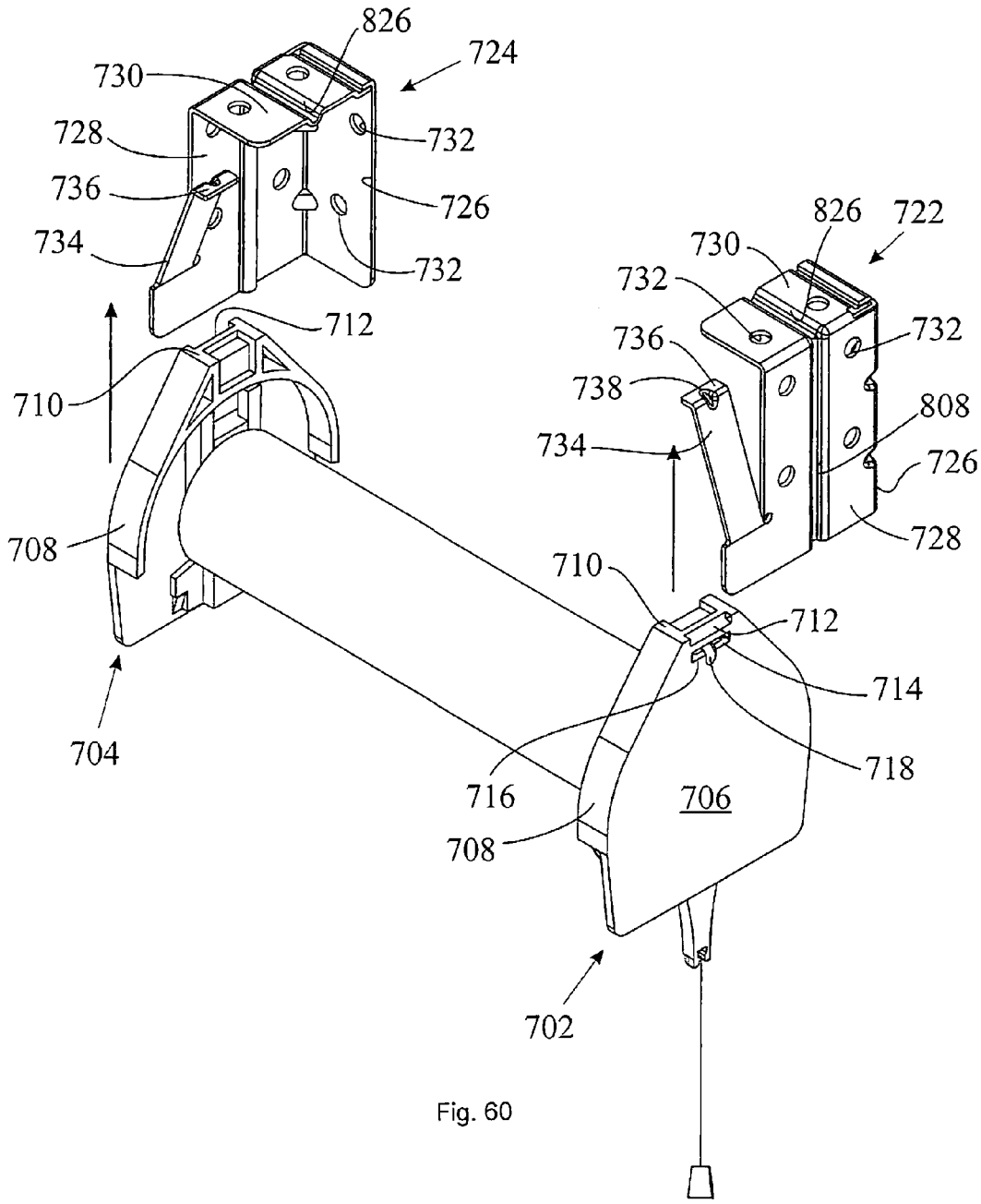
FIG. 60 is a partially exploded, perspective view of a roller shade made in accordance with the present invention with the end caps of FIG. 55 and their respective mounting brackets.

Referring to FIG. 60, the mounting brackets 722, 724 are mirror images of each other, so only one such bracket 722 is described in detail. The bracket 722 includes a rear wall 726, a side wall 728, and a top wall 730. Each of these walls 726, 728, 730 has through openings 732 to accommodate mounting screws (not shown) or to accommodate the mounting of end covers 786 (See FIGS. 72 and 73), and these walls are joined together to form a right angled mounting bracket as is well known in the industry. However, extending from the side wall 728 is a sloping arm 734 with a finger 736 projecting away from the side wall 728 and parallel to the top wall 732. At the interface between the arm 734 and the finger 736 and extending perpendicular to this interface, a rib 738 is pressed which serves to reinforce the arm/rib bend. The bottom 740 of the rib 738 (See FIG. 61) serves as a ramp to help the end caps 702, 704 slide onto the mounting brackets 722, 724, and also serves to center and retain the end caps 722, 724 onto the mounting brackets 722, 724 as described below.

Figure 61:
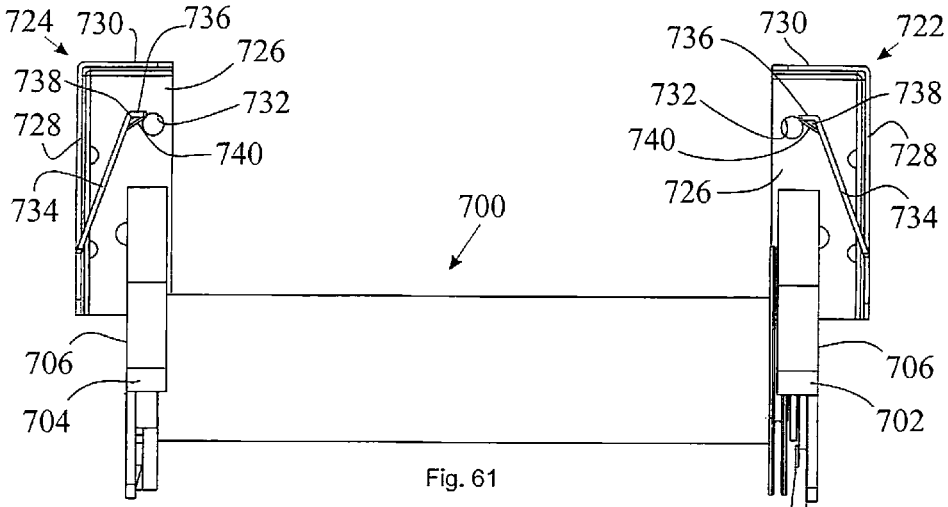
FIG. 61 is a front view of the roller shade of FIG. 60, just before it is assembled onto the mounting brackets.
Figure 62:
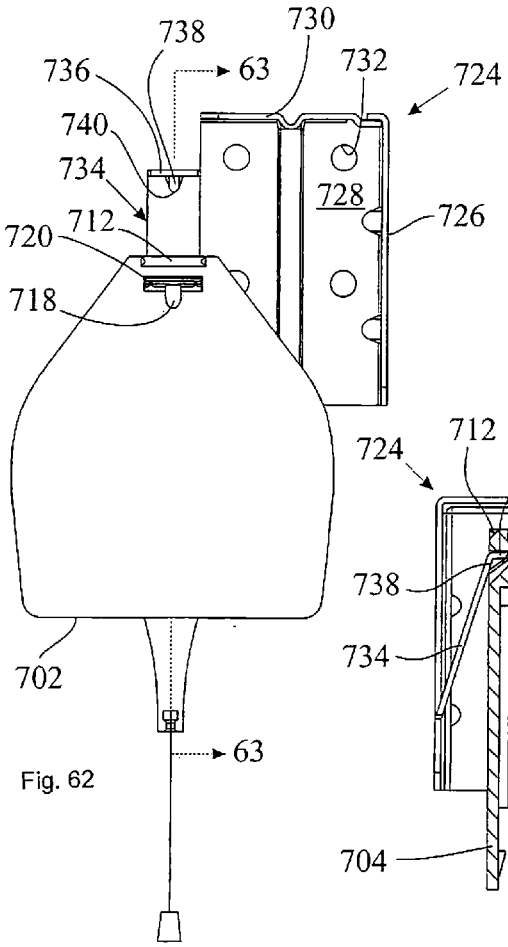
FIG. 62 is an end view of the right side of FIG. 61 with the control-end mounting bracket removed for clarity.

FIGS. 61 and 62 show the initial step in the installation of the shade 700 onto the mounting brackets 722, 724 which will already have been mounted, as by screws through the holes 732, to the window opening to be covered by the shade 700. The brackets 722, 724 are installed so that the flat back surface 706 of the end caps 702, 704 may align fairly closely with the interface between the arms 734 and the fingers 736 of the brackets 722, 724, as seen in FIG. 61. The shade 700 is further positioned so that the slot 718 in the end caps 702, 704 lines up fairly closely with the bottom 740 of the rib 738 in the arm/finger interface as seen in FIG. 62.

Figure 63:
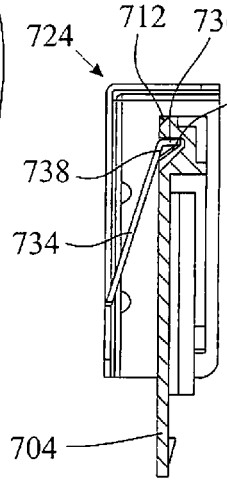
FIG. 63 is a sectional view of the idle-end and control-end end caps and their respective mounting brackets of FIG. 61, taken along line 63-63 of FIG. 62 (but when the end caps are locked into the mounting brackets, and excluding all components other than the end caps and their respective mounting brackets)
Figure 63:
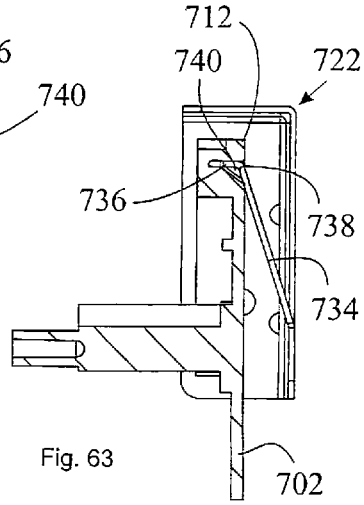
Figure 67:
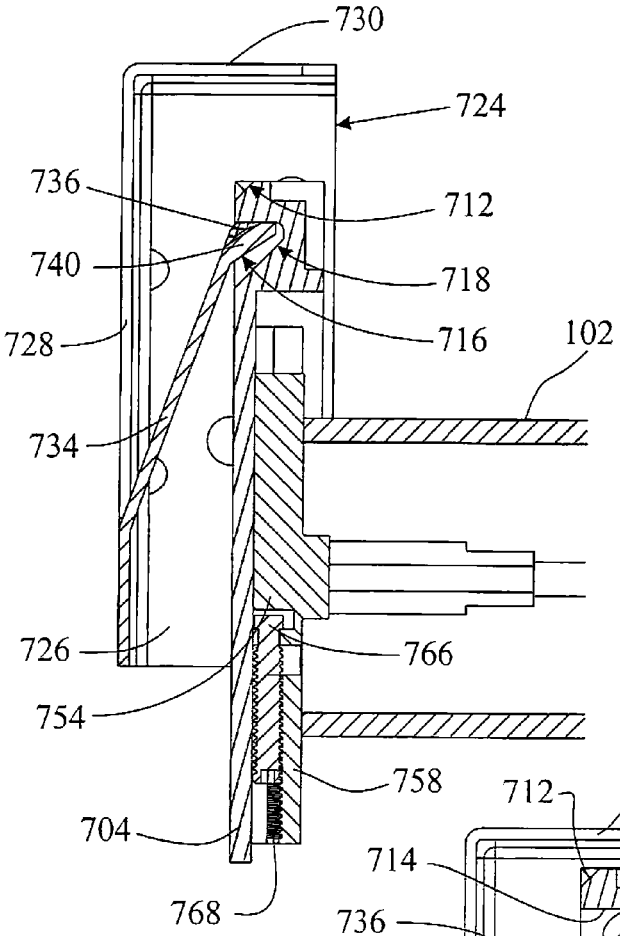
FIG. 67 is a detailed, sectional view, similar to that of FIG. 63, of the idler-end end cap and mounting bracket, showing how the bracket secures the end cap when the shade is mounted as in FIG. 64 (with the rotator rail adapter removed for clarity)

Once the shade 700 is lined up as described above and shown in FIGS. 61 and 62, the shade 700 is pushed up. The bottom 740 of the rib 738 contacts the first ramped surface 712 of the end caps 702, 704. As the ramped surface 712 rides up, it pushes the arm 734 back toward the side wall 728 of the bracket 722, 724 until both the arm 734 and the finger 736 are pushed far enough back that they clear the end caps 702, 704, and the end of the finger 736 is scraping the flat back surface 706 of the end cap 722, 724. The end cap 702, 704 is pushed up a little further until the finger 736 reaches the cavity 714. The arm 734 then snaps forward, pushing the finger 736 into the cavity 714. The bottom 740 of the rib 738 snaps into the slot 718 in the second ramped surface 716 as shown in FIG. 67. The compression ribs 720 (See FIG. 70) help to provide a tight fit between the finger 736 and the cavity 714 and this, together with the matching fit of the rib 738 with the slot 718 help prevent shifting or rocking of the end caps 702, 704 when mounted to the brackets 722, 724 respectively, as shown in FIG. 63.

Figure 64:
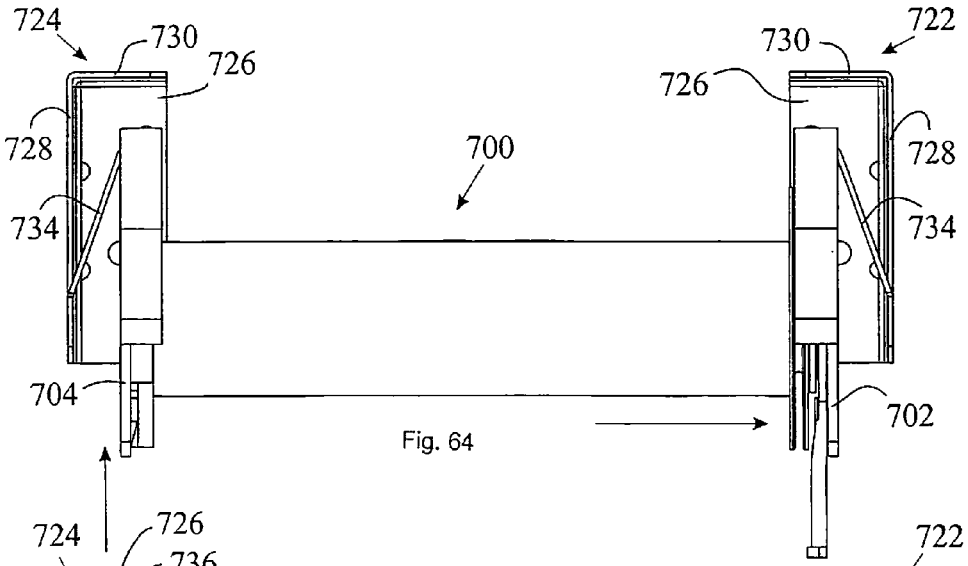
FIG. 64 is a front view, similar to that of FIG. 61, but with the shade mounted to the mounting brackets, illustrating the first step in removing the shade from the mounting brackets.
Figure 65:
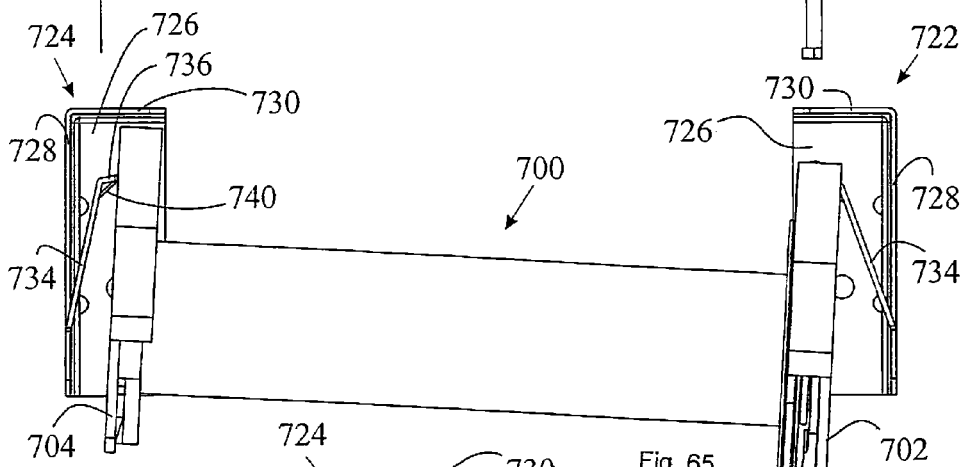
FIG. 65 is the same view as that of FIG. 64, illustrating the second step in removing the shade from the mounting brackets.
Figure 66:
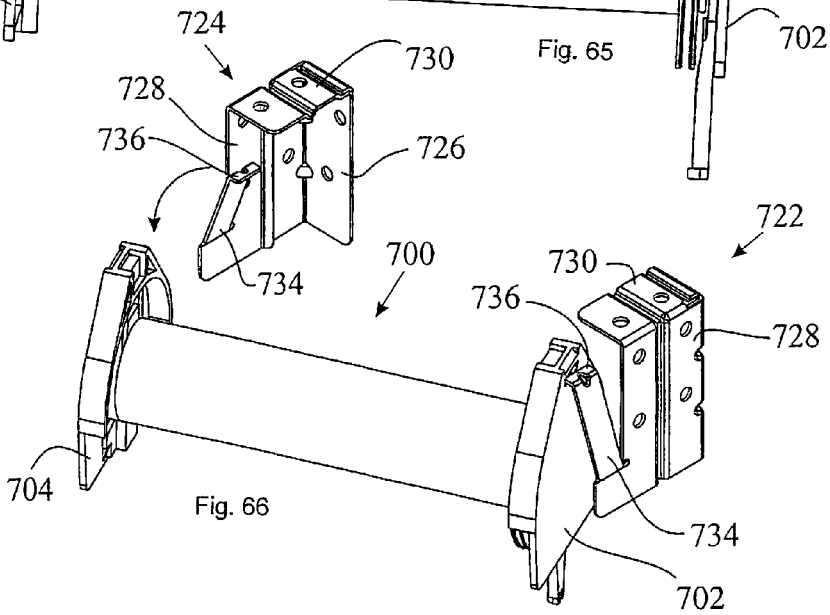
FIG. 66 is a perspective view of the shade of FIG. 65, illustrating the last step in removing the shade from the mounting brackets.
Figure 68:
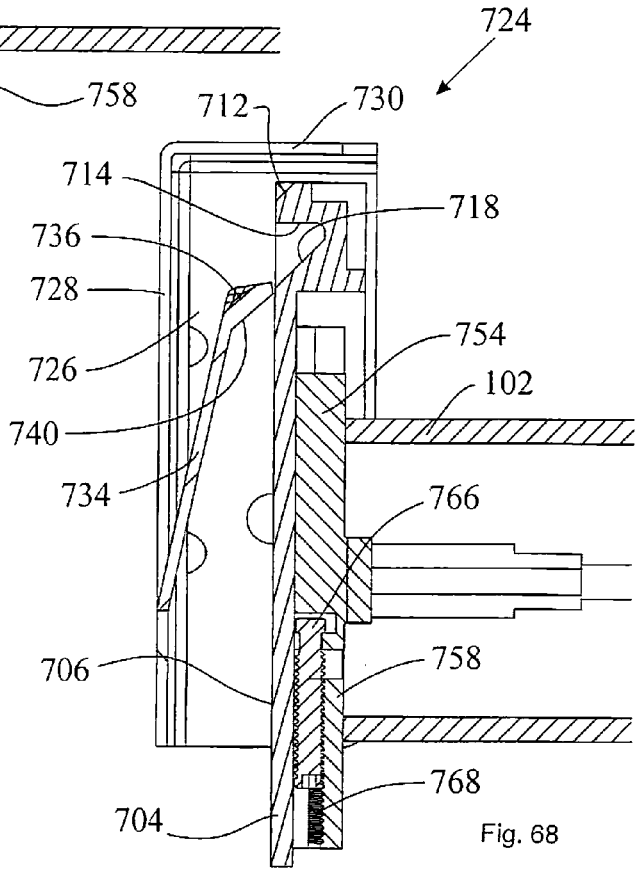
FIG. 68 is the same view as that in FIG. 67, but when the shade is being removed as in the position shown in FIG. 65.

FIGS. 64, 65, and 66 show the steps in the removal of the shade 700 from the mounting brackets 722, 724. The first step is to push the shade 700 in the directions shown by the arrows. By pushing up on one side (in this case the idler-end side) and against the opposite side, the bottom 740 of the rib 738 of the finger 736 is able to slide past the second ramped surface 716, extracting the finger 736 from the cavity 714 so that the end of the finger 736 is once again scraping against the flat back surface 706 of the end cap 704 as seen in FIG. 65 and shown in greater detail in FIG. 68. The shade 700 is then pulled away from the rear wall 726 of the bracket 724 until the shade 700 breaks free as seen in FIG. 66.

Figures 71, 72:
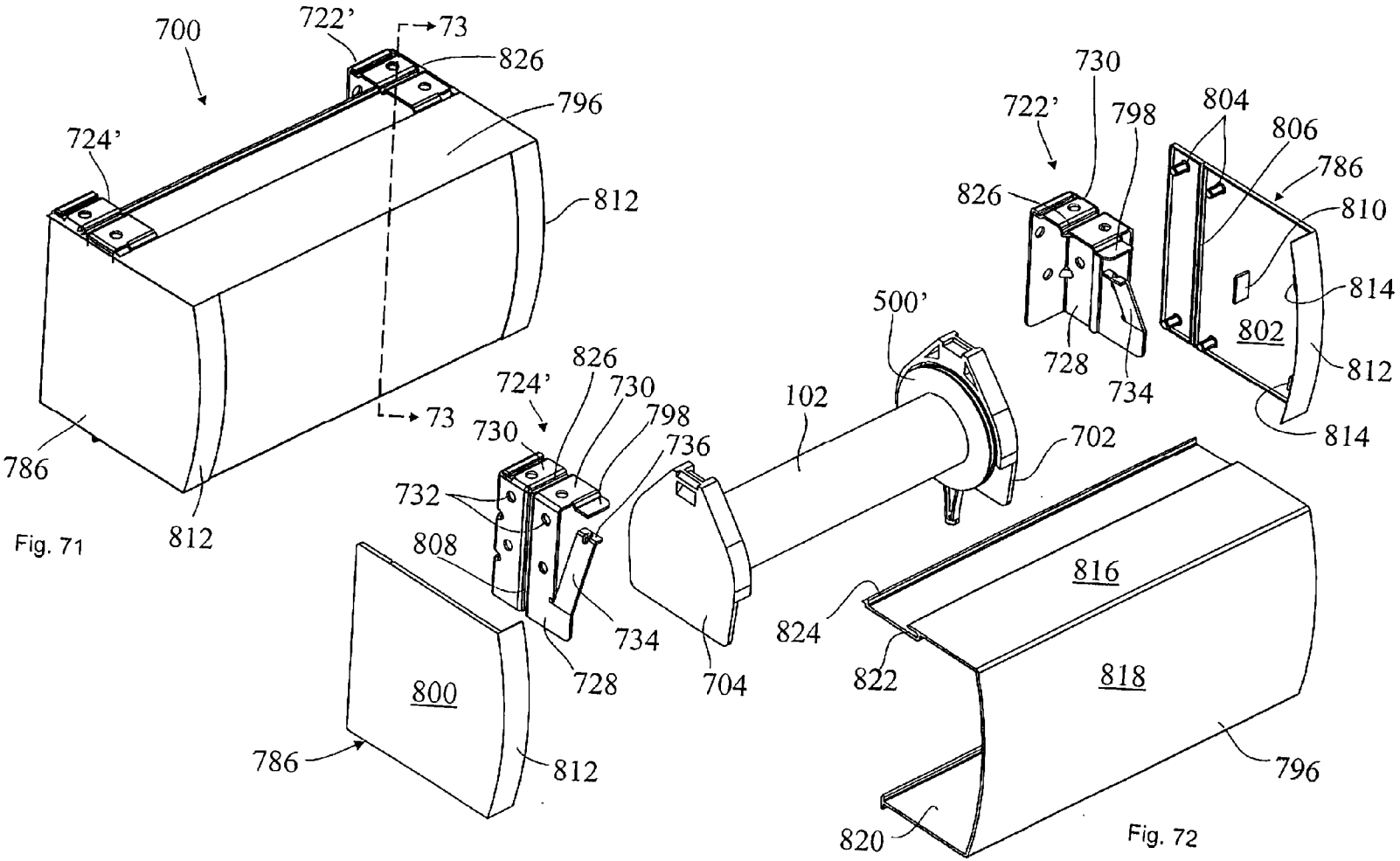
FIG. 71 is a perspective view of the shade assembly of FIG. 55, but including end covers and head rail cover.
FIG. 72 is an exploded perspective view of the shade assembly of FIG. 71.

FIGS. 71-74 depict the shade 700 of FIG. 55 but with the addition of end covers 786 and a head rail cover 796. To add this head rail cover 796, mounting brackets 722', 724' are used, which are practically identical to the brackets 722, 724 described earlier, except that each bracket 722', 724' includes an ear 798 attached to and projecting forwardly from the top wall 730 (as seen in FIG. 72).

Figure 73:
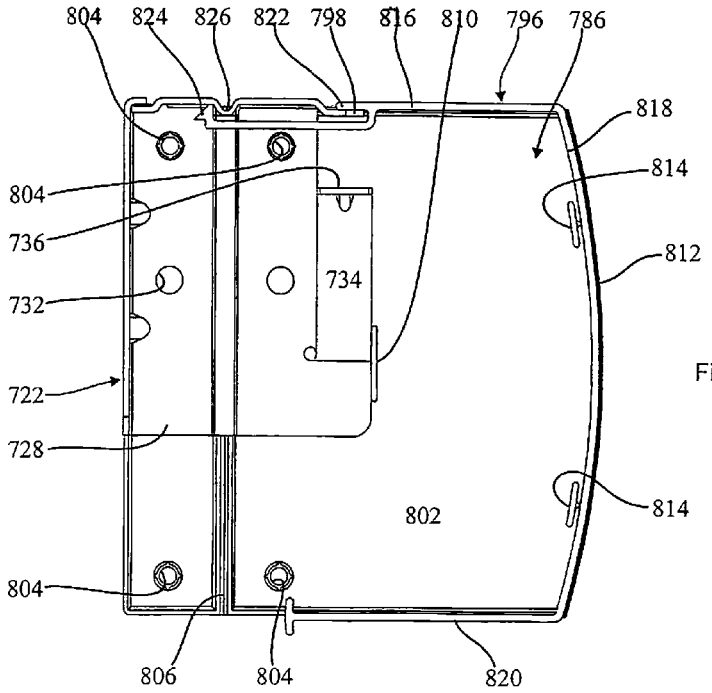
FIG. 73 is a view along line 73-73 of FIG. 71 showing only the mounting bracket, the end cover and the head rail cover.
Figure 74:
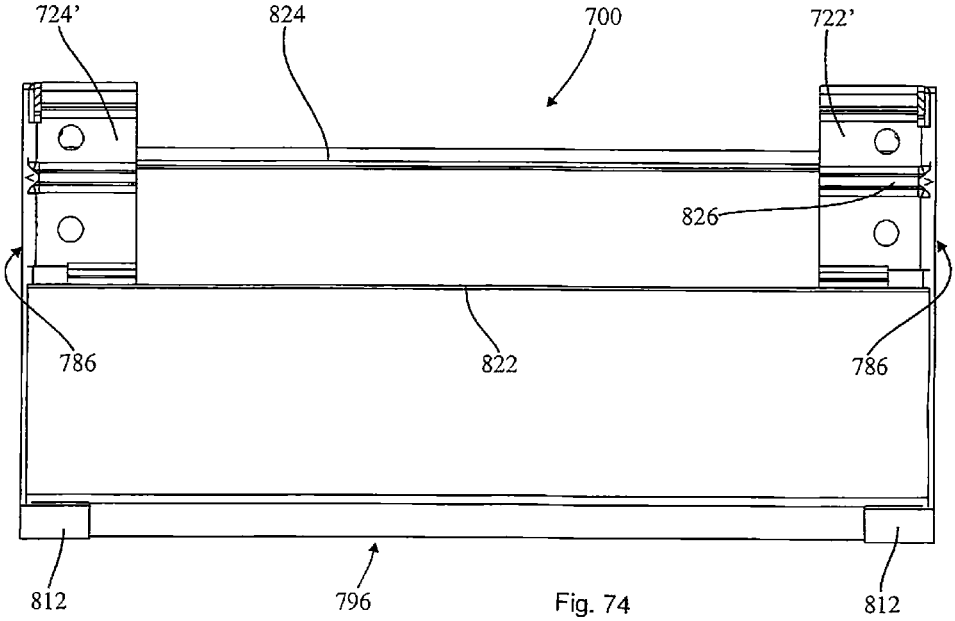
FIG. 74 is a top view of the shade assembly of FIG. 71.

The end cover 786 has a flat outer face 800 and an inner face 802 with four pins 804 projecting inwardly from the inner face 802, as well as a rib 806 extending vertically and also projecting inwardly from the inner face 802. The pins 804 fit snugly through the two top holes 732 on the respective side walls 728 of the mounting brackets 722', 724', and the rib 806 snaps into a matching slotted crevice 808 on the side wall 728 of the mounting bracket 722', 724'. The end cover 786 has a limit stop 810, which contacts the side wall 728 of the mounting brackets 722', 724' as seen in FIG. 73. Finally, the end cover 786 has a flange 812 also projecting inwardly from one end of the inner face 802, and this flange 812 has two short clips 814 to engage and retain the head rail cover 796 as described below.

The head rail cover 796 (See FIGS. 72, 73, and 74) is a U-shaped element including a top portion 816, a front portion 818, and a bottom portion 820. The top portion 816 includes a notch 822 and a lip 824, both of which extend the width of the head rail cover 796. As seen in FIG. 73, the head rail cover 796 is first installed onto the mounting brackets 722', 724' by sliding the ear 798 of the mounting brackets 722', 724' into the notch 822 until the lip 824 hooks under and around the crevice 826 on the top wall 730 of the mounting brackets 722', 724'. The end covers 786 are then installed onto the mounting brackets 722', 724', making sure the pins 804 extend through the holes 732, the rib 806 snaps into the crevice 808, the limit stop 810 abuts the side wall 728, and the edges of the front portion 818 of the head rail cover 796 slide in between and are retained by the flange 812 and the clips 814 of the end covers 786.

Figure 70:
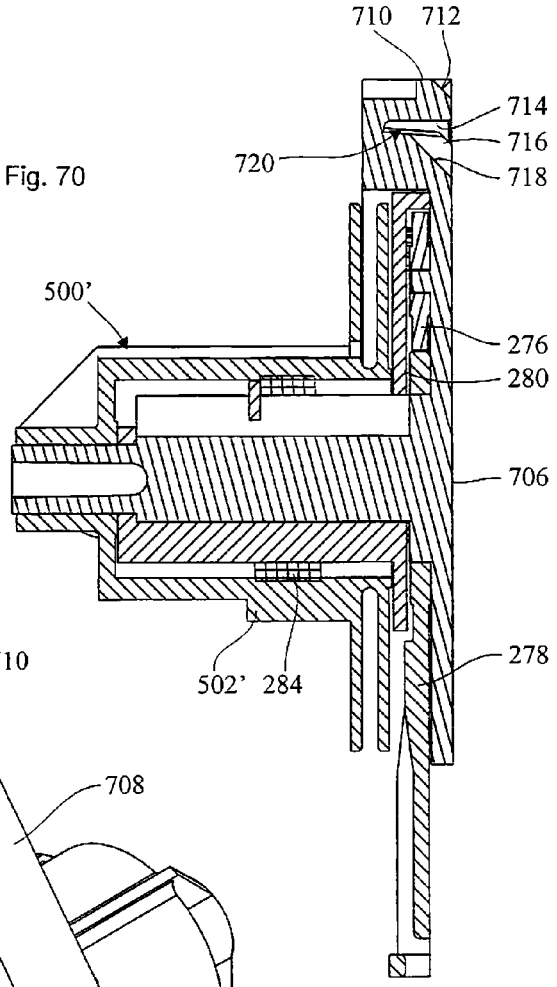
FIG. 70 is a sectional view along line 70-70 of FIG. 69.
Figure 69:
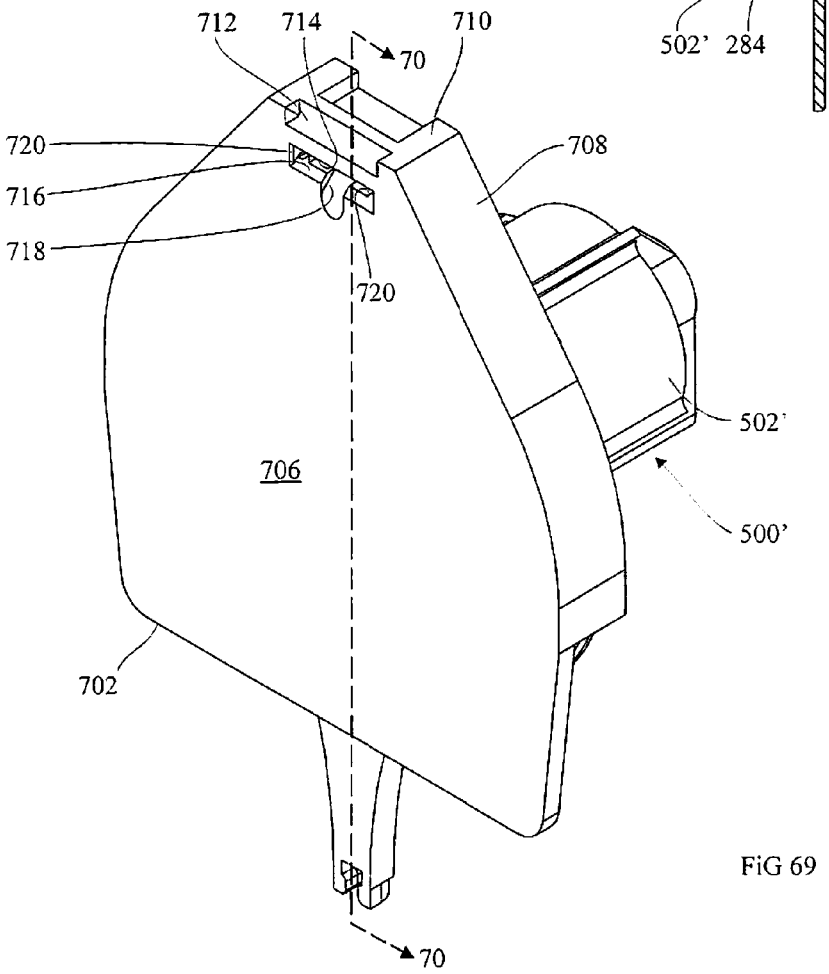
FIG. 69 is a perspective view of the control-end end cap and spring clamp brake assembly of FIG. 55.
Figure 75:
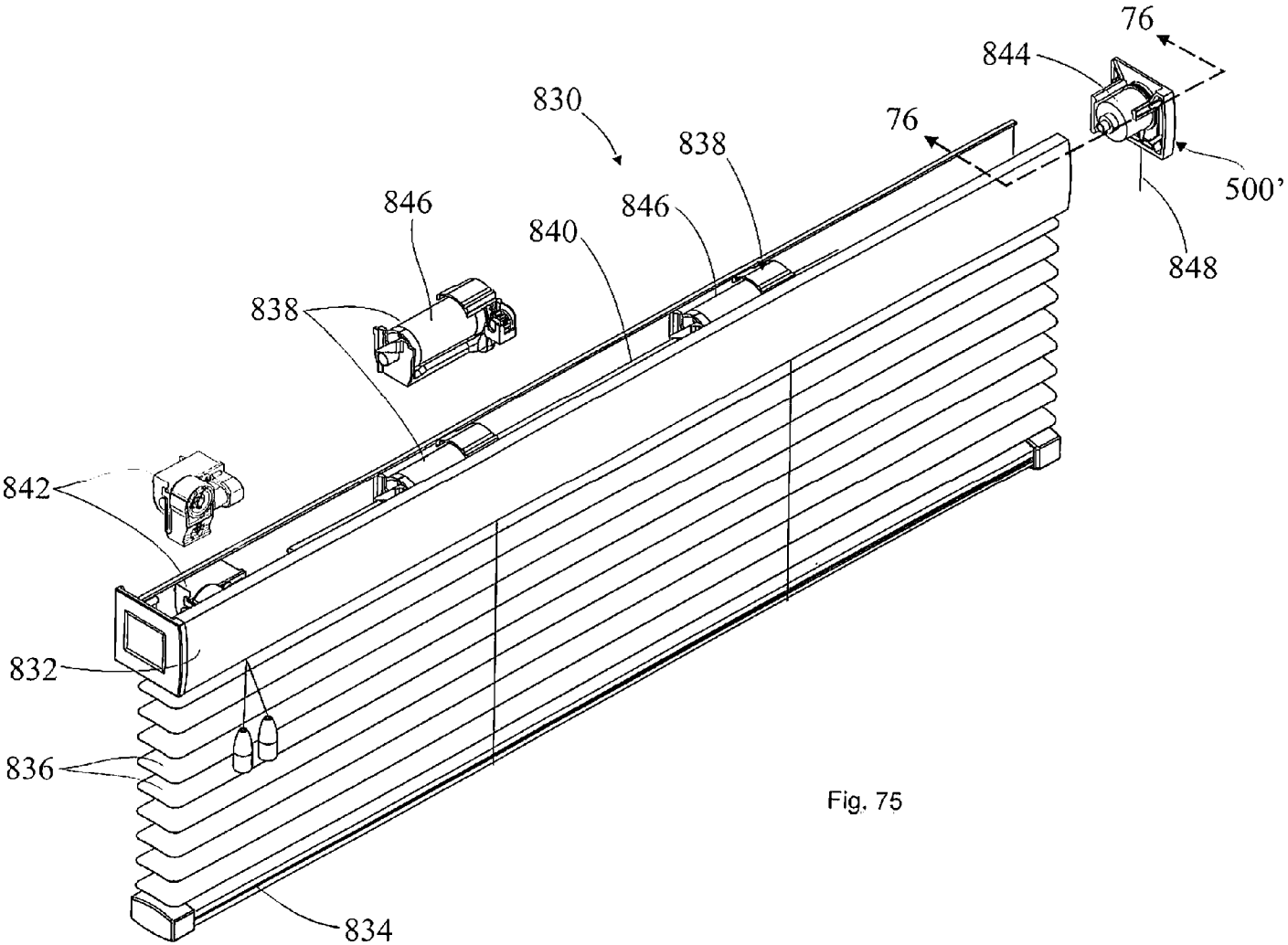
FIG. 75 is a partially exploded, perspective view of a blind utilizing a cord drive of the present invention.

FIG. 75 depicts a blind 830 which utilizes the spring clamp brake assembly 500' of FIGS. 69 and 70. A blind similar to this blind 830, but using a different cord drive mechanism, is disclosed in the referenced U.S. Pat. No. 6,536,503, Modular Transport System for Coverings for Architectural Openings, which should be referred to for details of any elements that are not shown in detail here. This blind 830 includes a top rail 832, a bottom rail 834, a plurality of slats 836, two lift and tilt stations 838, a lift rod 840, a tilt mechanism 842 connected to a tilt rod (not visible), and the spring clamp brake assembly 500' including an adapter 844 to connect the spring clamp brake assembly 500' to the lift rod 840 as may be better appreciated in FIG. 76. Lift cords (not shown) are connected to a lift drum 846 on the lift and tilt stations 838 and to the bottom rail 834, such that, when the lift rod 840 rotates, it rotates the drum 846 which raises or lowers the bottom rail 834 to raise or lower the slats 836 of the blind 830.

Figure 76:
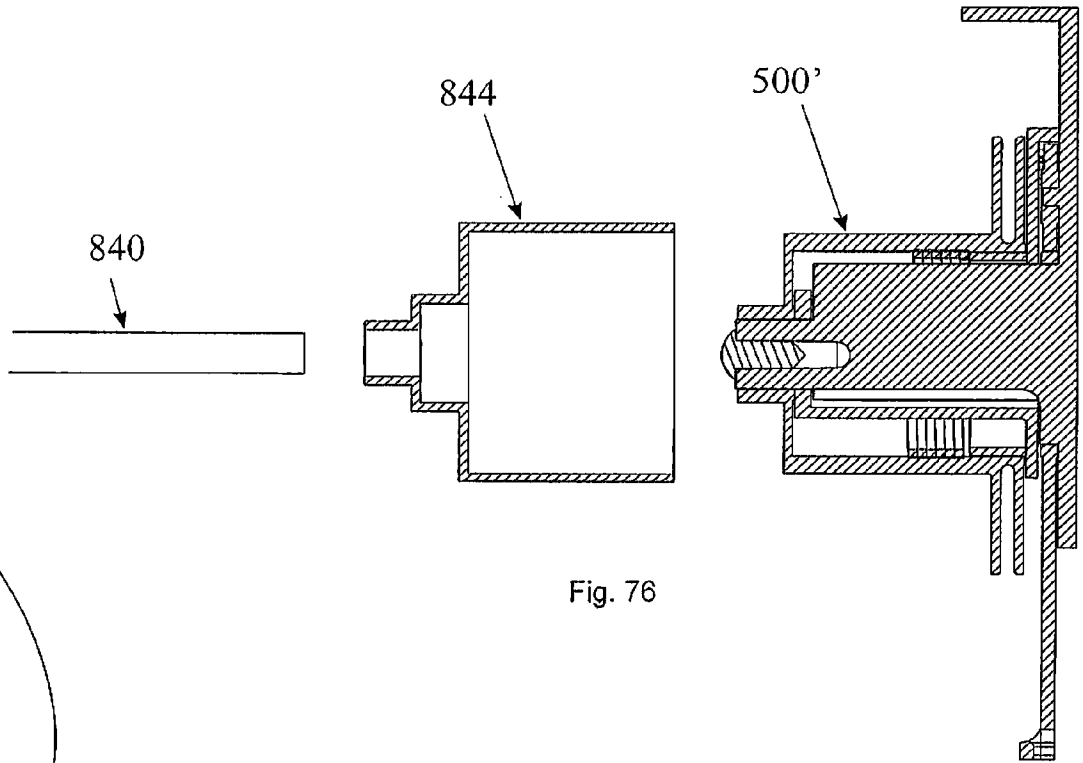
FIG. 76 is a partially exploded, sectional view along line 76-76 of FIG. 75.
Figure 77:
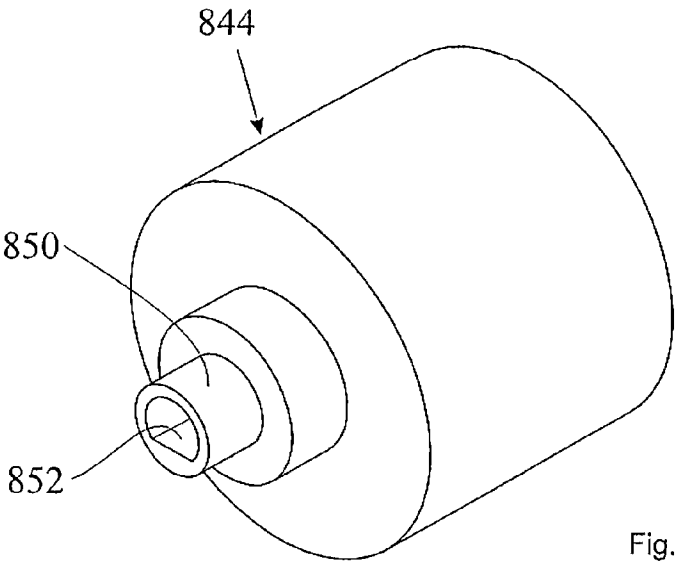
FIG. 77 is a perspective view of the adapter of FIG. 76.

The spring clamp brake assembly 500' is the cord drive mechanism which drives the lift rod 840. Referring to FIGS. 76 and 77, a simple cylindrical adapter 844 with a small bushing 850 defining a non-cylindrical opening 852 is attached for rotation with the spring clamp brake assembly 500'. The lift rod 840 has a similar, non-cylindrical, cross-sectional profile as that of the opening 852 in the adapter 844, and the rod 840 fits into this opening 852 such that, as the spring clamp brake assembly 500' rotates, the adapter 844 and the rod 840 also rotate. Thus, the spring clamp brake assembly 500' acts as the drive mechanism to raise and lower the blind 830.

The operation and performance of the spring clamp brake assembly 500' remains the same as for the previously described embodiments. Furthermore, any of the brake assemblies disclosed may be substituted as cord drives for the spring clamp brake assembly 500' to be used in a wide range of window coverings. This flexibility has already been illustrated by showing these drives being used in conventional roller shades (FIG. 47), variable light control roller shades (FIG. 1), non-variable light control shades (FIG. 46), blinds (FIG. 75), and pleated shades and cellular product shades 854 as shown in FIG. 78 and described briefly below.

Figure 78:
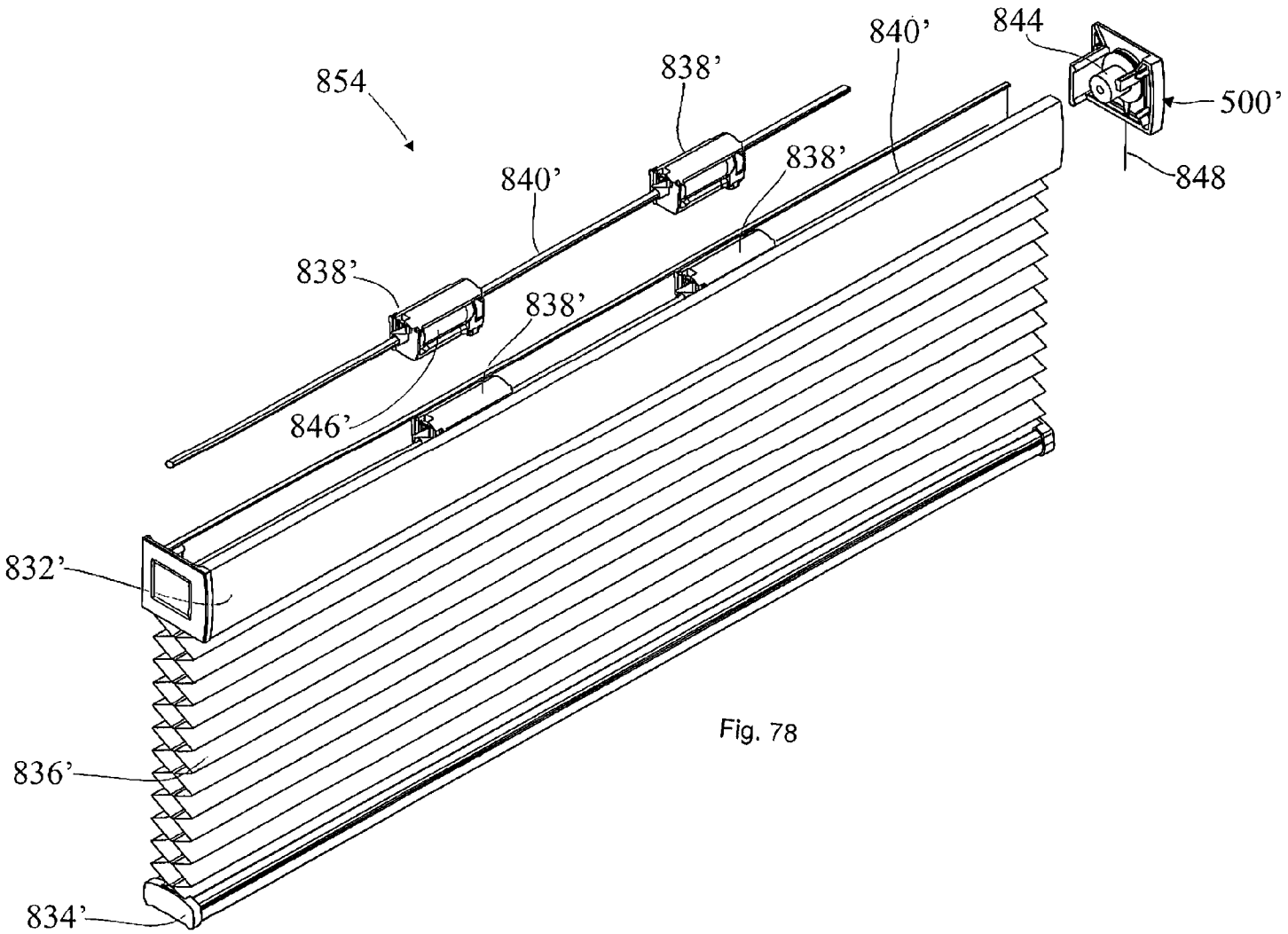
FIG. 78 is a partially exploded, perspective view of a cellular product shade, similar to a pleated shade, utilizing the same cord drive of FIG. 75.

The cellular product shade 854, shown in FIG. 78, is similar to the blind 830 described above, including a top rail 832', a bottom rail 834', two lift stations 838', a lift rod 840', and the spring clamp brake assembly 500' including the adapter 844 to connect the spring clamp brake assembly 500' to the lift rod 840' as has already been described in relation to the embodiment of the blind 830. Instead of slats, this shade 854 includes a cellular product 836', which resembles back-to-back pleated shades to form a three dimensional pleated shade effect. Lift cords (not shown) are connected to a lift drum 846' on the lift stations 838' and to the bottom rail, such that, when the lift rod 840' rotates, it rotates the drum 846' which raises or lowers the bottom rail 834' to raise or lower the shade 854. The spring clamp brake assembly 500' acts as the drive mechanism to raise and lower the shade 854 in the same manner as has already been described for the embodiment of the blind 830.

Gearless Spring Clamp Automatic Brake

Figure 79:
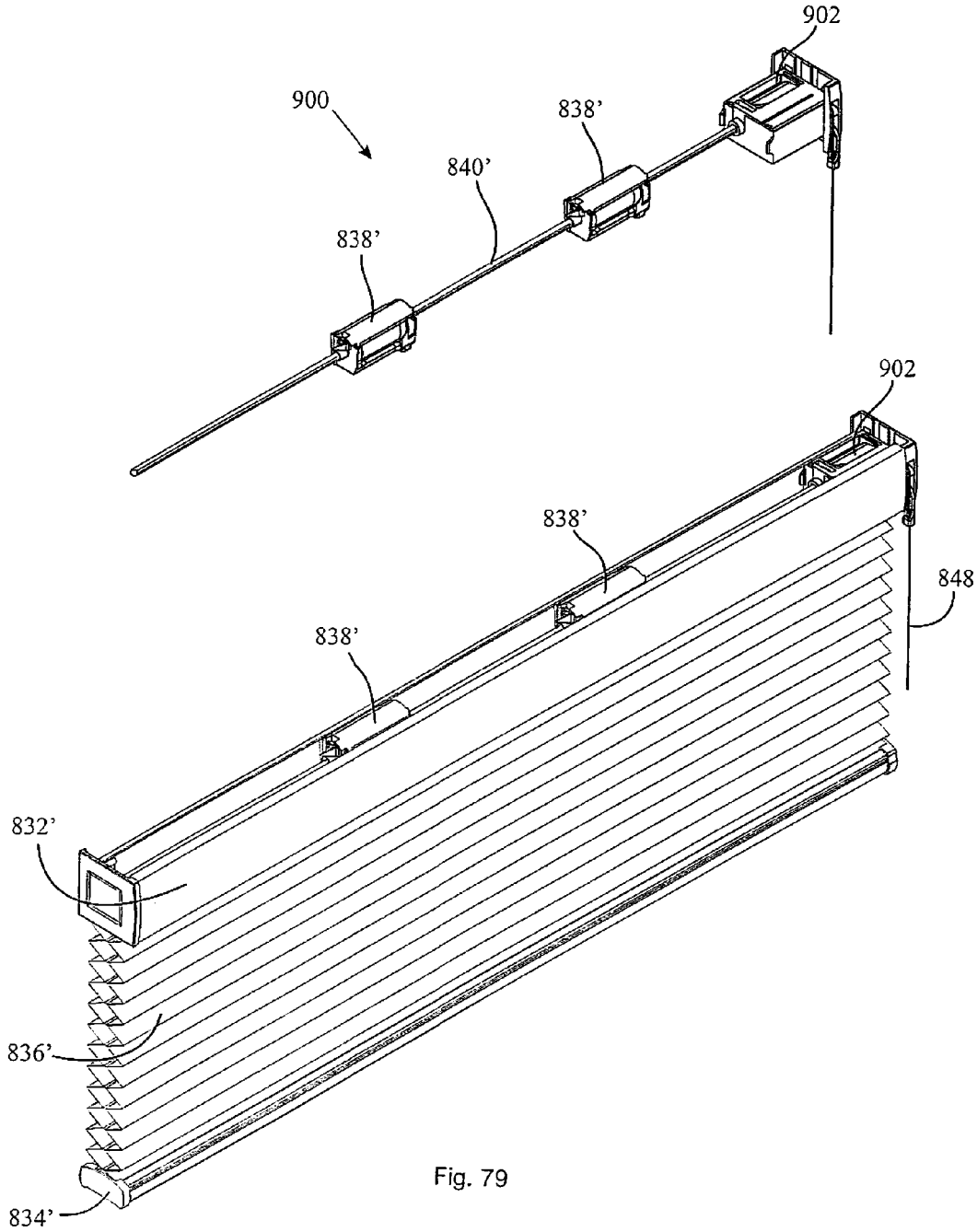
FIG. 79 is a partially broken away perspective view of a cellular product shade, similar to that of FIG. 78, but incorporating a cord drive with a gearless spring clamp brake made in accordance with the present invention.
Figure 80:
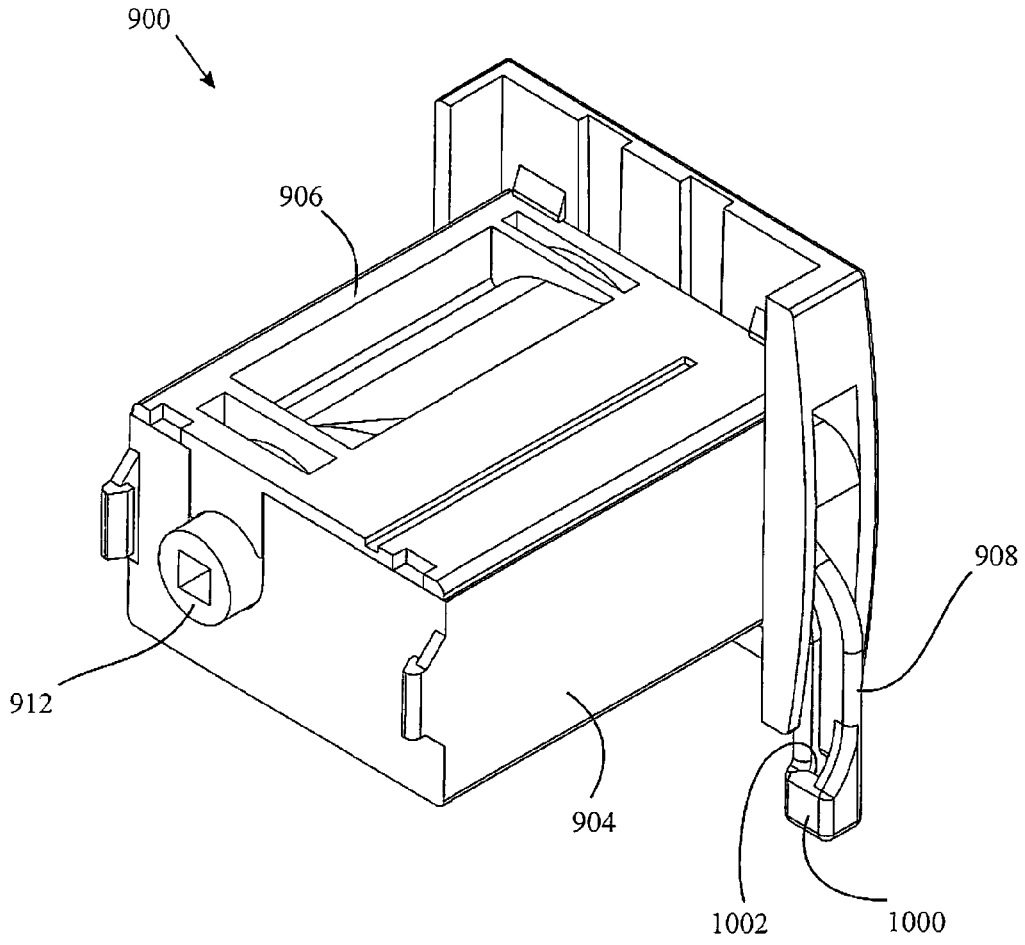
FIG. 80 is a perspective view of the gearless spring clamp brake of FIG. 79.

FIG. 79 shows another embodiment of a cellular product shade 900 made in accordance with the present invention. All components of the shade 900 are identical to those of the shade 854 (See FIG. 78) described earlier except for the automatic brake which is a gearless spring clamp automatic brake 902 (See FIG. 80) instead of a spring clamp brake assembly 500'.

Figure 81:
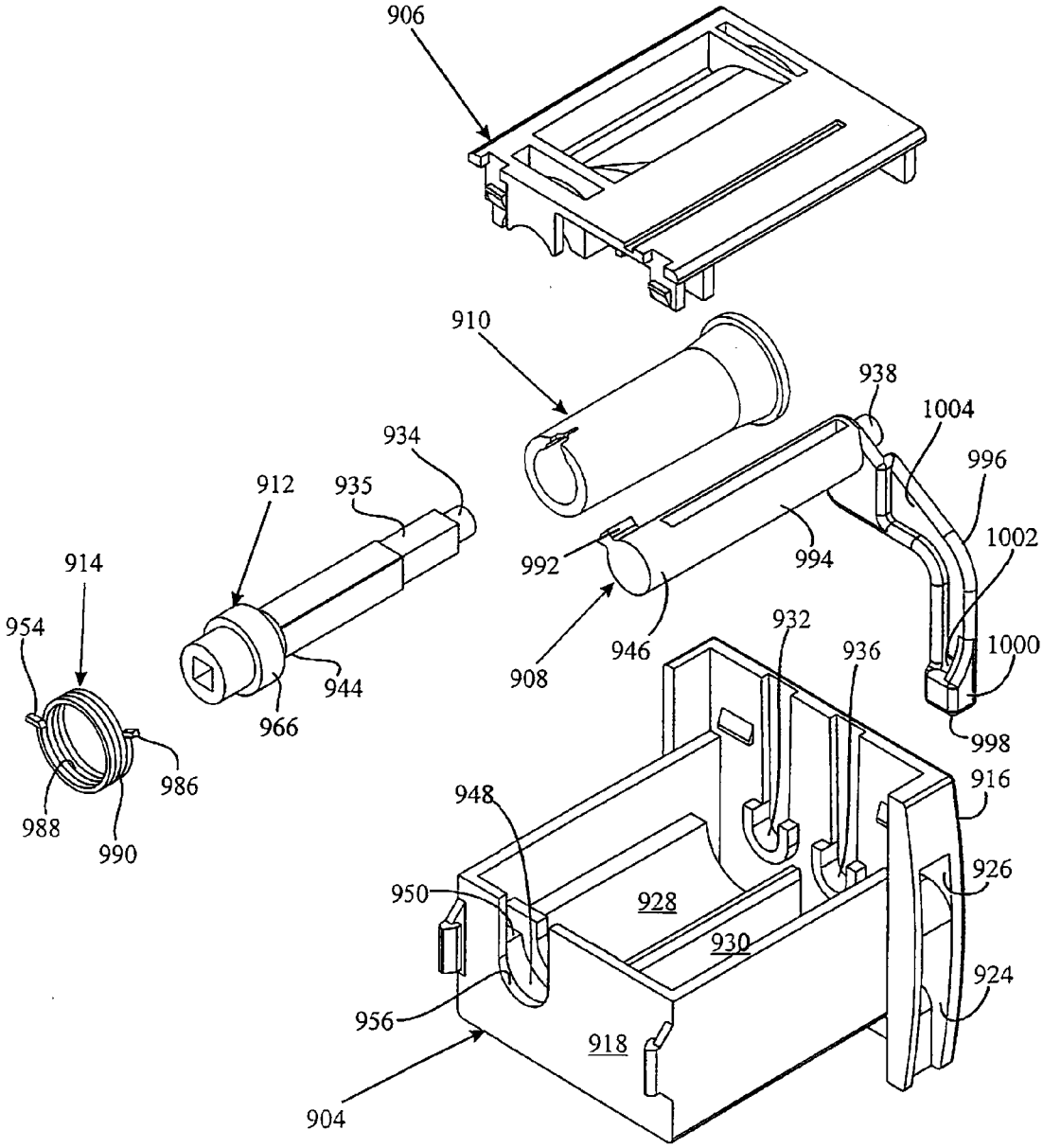
FIG. 81 is an exploded, perspective view of the gearless spring clamp brake of FIG. 80.
Figure 82:
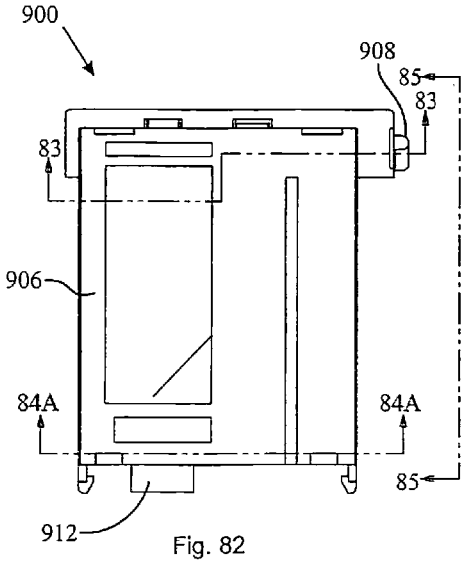
FIG. 82 is a plan view of the gearless spring clamp brake of FIG. 80.

Referring now to FIG. 81, the gearless spring clamp brake 902 includes a spring brake housing 904, a housing cover 906, an actuator arm 908 (or release arm 908), a drive cord spool 910, a drive shaft 912, a spring 914, and the drive cord 848 (as shown in FIG. 79).

Figure 87:
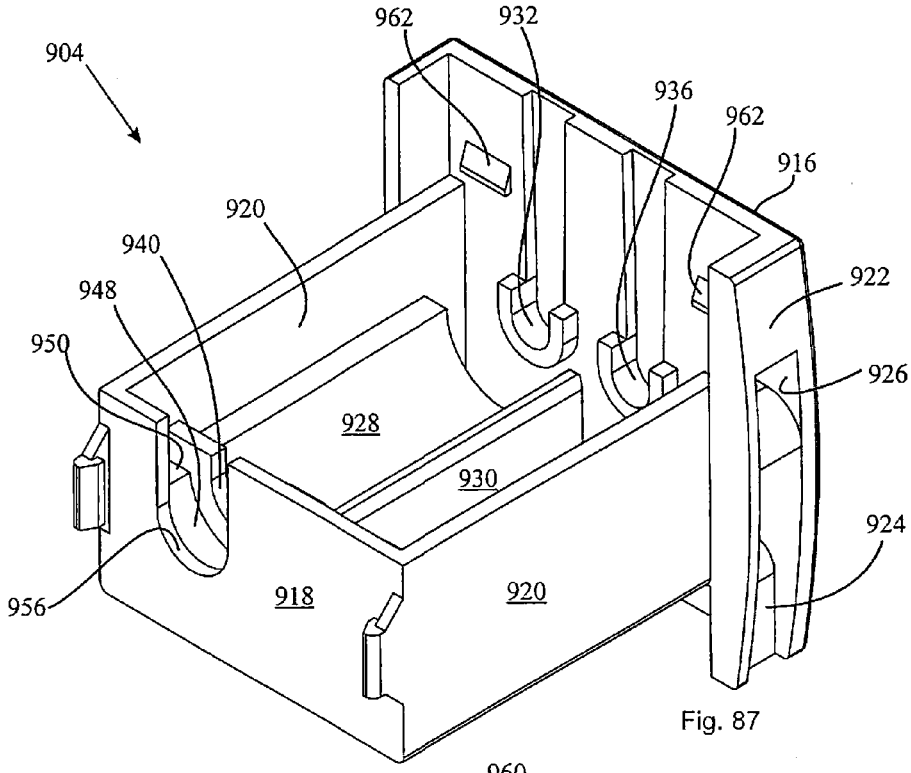
FIG. 87 is a perspective view of the housing for the gearless spring clamp brake of FIG. 80.
Figure 88:
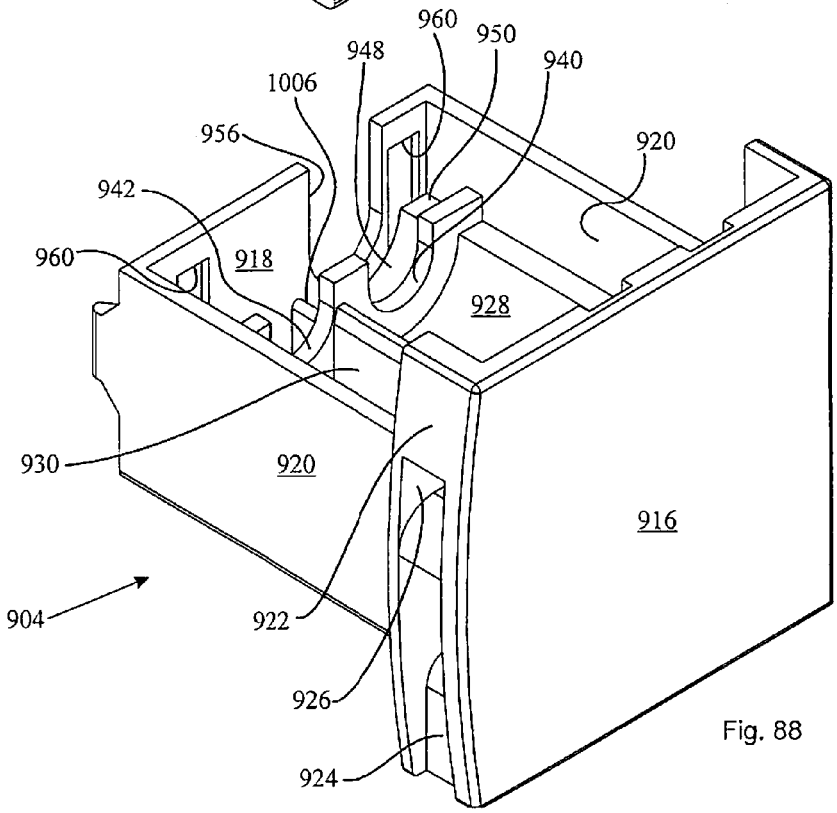
FIG. 88 is an opposite-end, perspective view of the housing of FIG. 87.

FIGS. 87 and 88 show the spring brake housing 904. This housing 904 is a substantially rectangularly-shaped box defining a right side wall 916, a left side wall 918, and interconnecting side walls 920. The right side wall 916 doubles as an end cap for the head rail 832'. A front flange 922 projects inwardly and perpendicularly from the right side wall 916, and this flange 922 defines a pathway with a through opening 924 as well as a second through opening 926 to guide the drive cord 848 into the housing 904 via the release arm 908, as is explained in more detail below.

Extending longitudinally from the right side wall 916 to the left side wall 918 are two open-ended troughs. The first trough 928 has an arcuate-shaped profile (See FIG. 83) and accommodates the spool 910, while the second trough 930 has a rectangularly-shaped profile and accommodates the release arm 908, as explained later. Axially aligned with the first trough 928 and against the right side wall 916 is a first arcuate flange 932 for rotatingly supporting a first end 934 of the drive shaft 912. A second arcuate flange 936, axially aligned with the second trough 930, provides rotating support for the first end 938 of the release arm 908. Axially aligned with these first and second arcuate flanges 932, 936, but proximate the left side wall 918, are first and second U-shaped supports 940, 942 respectively (See FIG. 88), for rotatingly supporting the opposite ends 944, 946 of the drive shaft 912 and of the release arm 908 respectively.

Between the U-shaped support 940 and the left side wall 918 is a chamber 948 which houses the locking spring 914 (as will be explained in more detail later), and a ledge 950 which, together with a corresponding ledge 952 (See FIG. 89) on the housing cover 906, trap the first end 954 of the locking spring 914, as explained in more detail later. Finally, a U-shaped opening 956 on the left side wall 918 allows the drive shaft 912 to extend beyond the housing 904.

Figure 89:
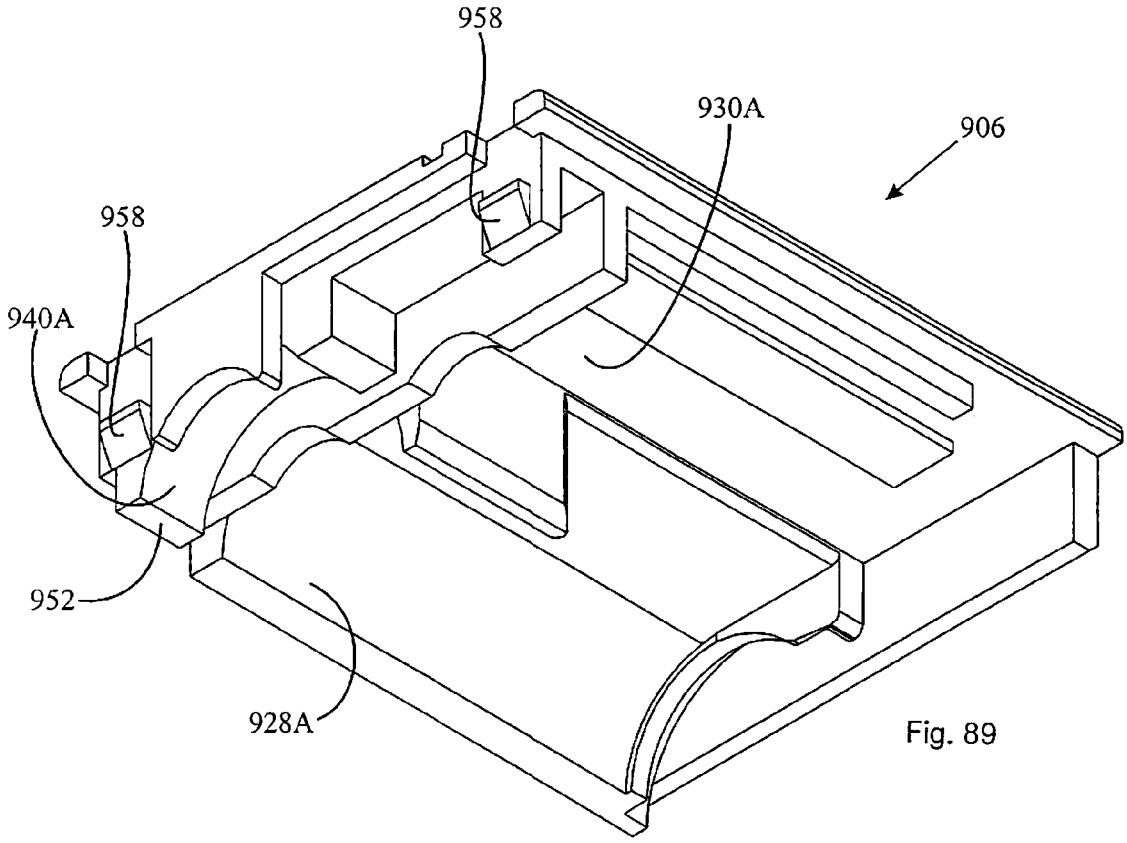
FIG. 89 is a perspective view of the housing cover for the gearless spring clamp brake of FIG. 80.

Referring briefly to FIG. 89, the housing cover 906 includes elements which closely match with the corresponding elements of the housing 904. These include a first cavity 928A corresponding to the trough 928, a second cavity 930A corresponding to the trough 930, a U-shaped cavity 940A corresponding to the cavity 940, and the previously described ledge 952 to trap, and lock against rotation, the first end 954 of the spring 914.

Projecting barbs 958 cooperate with matching indentations 960 (See FIG. 88) in the housing 904 to releasably secure the cover 906 to the housing 904. Barbs 962 (See FIG. 87) on the housing 904 also act to releasably secure the cover 906 to the housing 904.

Figure 90:
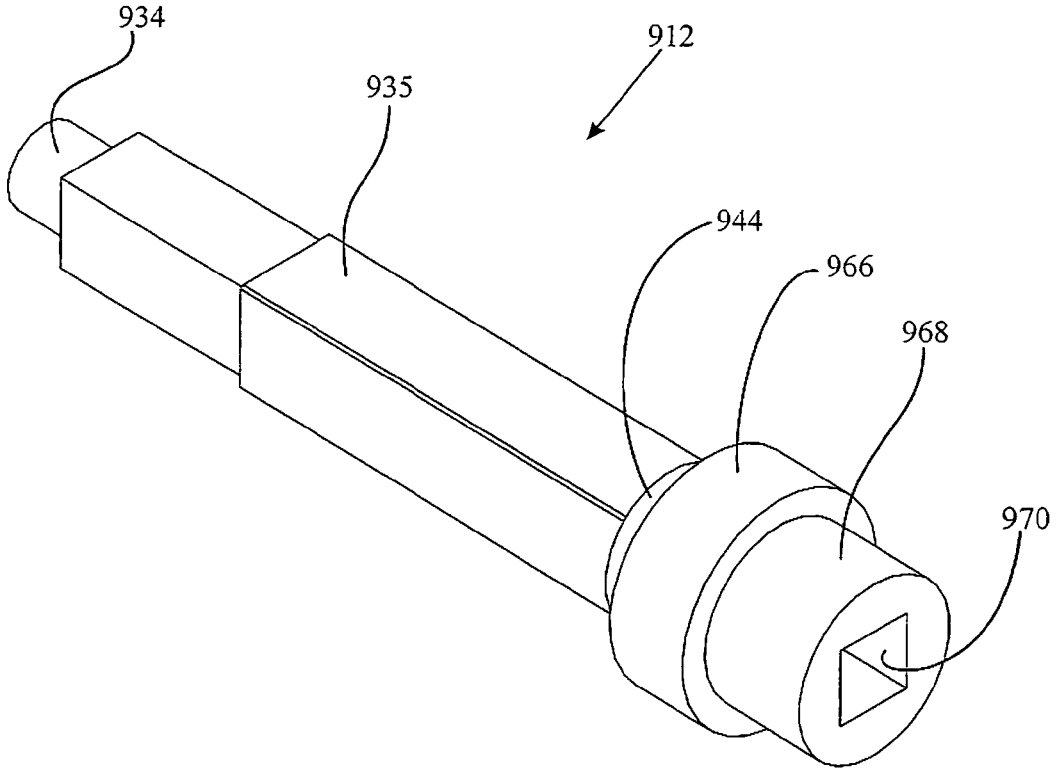
FIG. 90 is a perspective view of the drive shaft for the gearless spring clamp brake of FIG. 80.

FIG. 90 is a perspective view of the drive shaft 912. As already described, this elongated member has a cylindrical first end 934 which rests on the flange 932 of the housing 904 to allow rotation of the drive shaft 912 about its longitudinal axis. Between its first end 934 and its second end 944, the drive shaft 912 has a non-cylindrical profile 935 (in this embodiment, the profile is square, but it may rectangular, triangular, or any other non-cylindrically-shaped profile) to engage the internal profile 964 (See FIG. 92) of the spool 910, such that rotation of one of either the spool 910 or of the drive shaft 912 results in corresponding rotation of the other.

The second end 944 of the drive shaft 912 is also cylindrical, and it rests upon the U-shaped support 940 of the housing 904 to allow for smooth rotation of the drive shaft 912 about its longitudinal axis. Proximate this second end 944 of the drive shaft 912, and extending beyond the first trough 928 of the housing 904, the drive shaft 912 includes a collar 966, and, beyond that, a stub shaft 968 with a non-cylindrical hollow cavity 970 to accommodate the end of the lift rod 840' (See FIGS. 79 and 86). The collar 966 may be an integral piece with the drive shaft 912, or it may be a separate piece, fixedly secured to the drive shaft 912 such that rotation of the drive shaft results in similar rotation of the collar 966.

Figure 86:
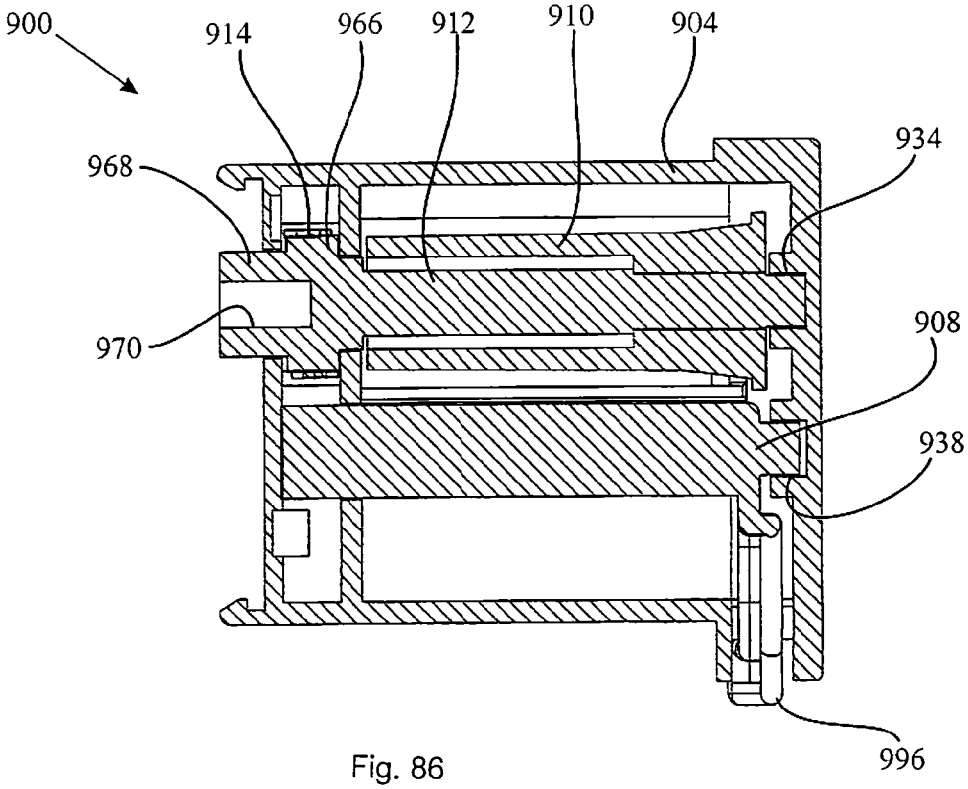
FIG. 86 is a view along line 86-86 of FIG. 85.
Figure 91:
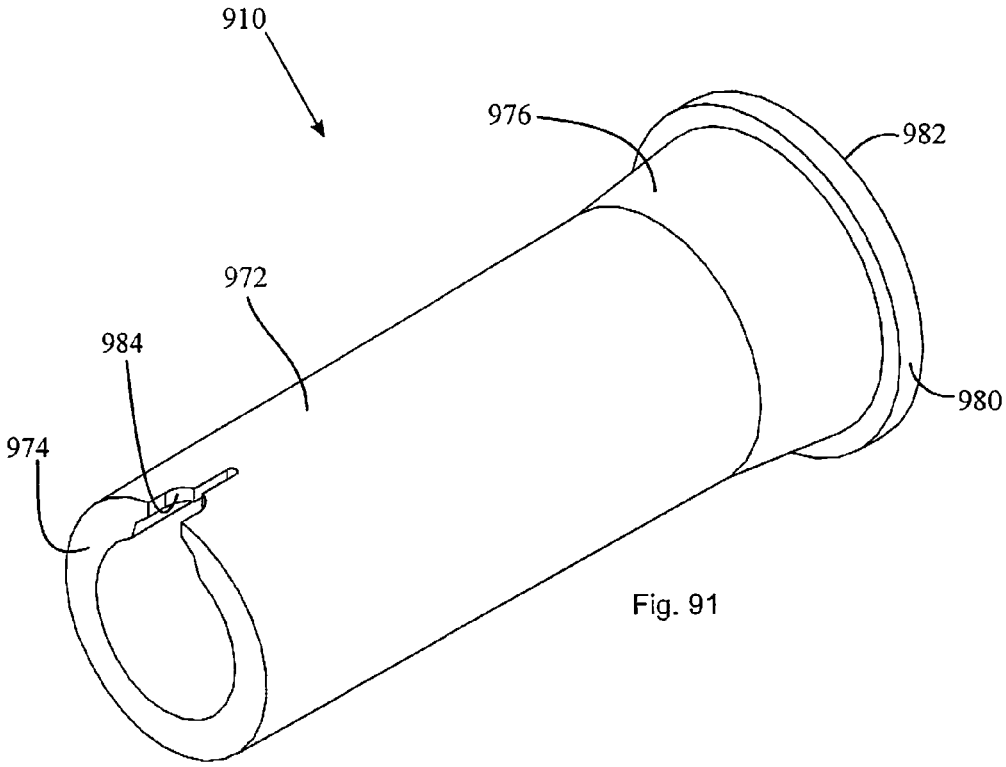
FIG. 91 is a perspective view of the brake housing spool for the gearless spring clamp brake of FIG. 80.
Figure 92:
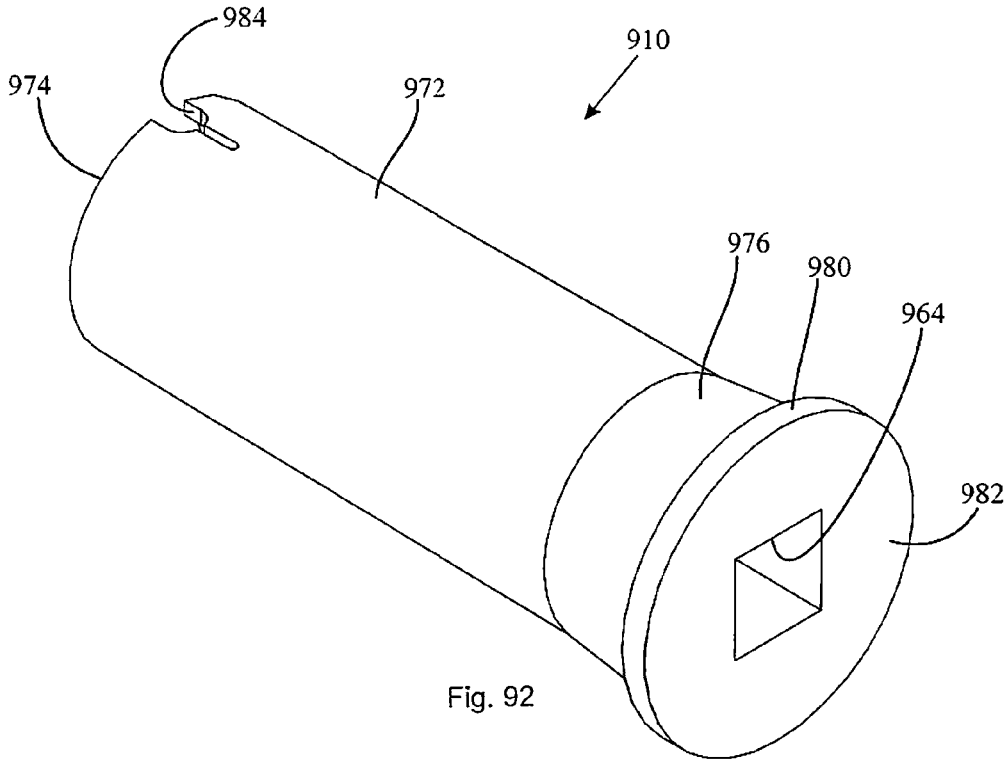
FIG. 92 is an opposite-end, perspective view of the brake housing spool of FIG. 91.

FIGS. 91 and 92 show the spool 910 which slides over the drive shaft 912, and which fits inside the first trough 928 of the housing 904, between the right side wall 916 and the U-shaped support 940 (See also FIG. 86). The spool 910 is a substantially cylindrical member divided into three main sections. The first section 972 extends from a first end 974 to the second section 976 and is substantially cylindrical, with little, if any taper to its walls. The second section 976 is substantially shorter than the first section 972 and tapers out from the first section 972 toward the last section 980 which is a flange proximate the second end 982. As indicated earlier, the spool 910 has a hollow, non-cylindrical cavity 964 proximate its second end 982 to engage the non-cylindrical portion 935 of the drive shaft 912. Proximate the first end 974 of the spool 910 is a slotted opening 984 for tying off the end of the drive cord 848 to the spool 910. An enlargement, such as a knot (not shown), is tied at the end of the drive cord 848 and this enlargement slides inside the spool 910 at the slotted opening 984 to releasably attach the drive cord 848 to the spool 910.

Referring back to FIG. 81, the relatively tightly wound locking spring 914 of the gearless spring clamp brake 902 includes a first end 954 and a second end 986. The coiled spring 914 has a generally cylindrical shape and defines an inner surface 988 and an outside surface 990. The spring 914 mounts over the collar 966 of the drive shaft 912, with the inner surface 988 of the spring 914 being just large enough to allow the spring 914 to be forced over the collar 966. The spring 914 is oriented so that the first end 954 of the spring 914 is trapped and locked against rotation by the ledge 950 of the housing 904 and the ledge 952 of the housing cover 906. The second end 986 of the spring 914 is unrestrained and, as described in more detail later, the actuator projection 992 of the release arm 908 engages this second end 986 of the spring 914 to disengage the inner surface 988 of the spring 914 from the collar 966, in order to allow the drive shaft 912 to rotate.

Figure 93:
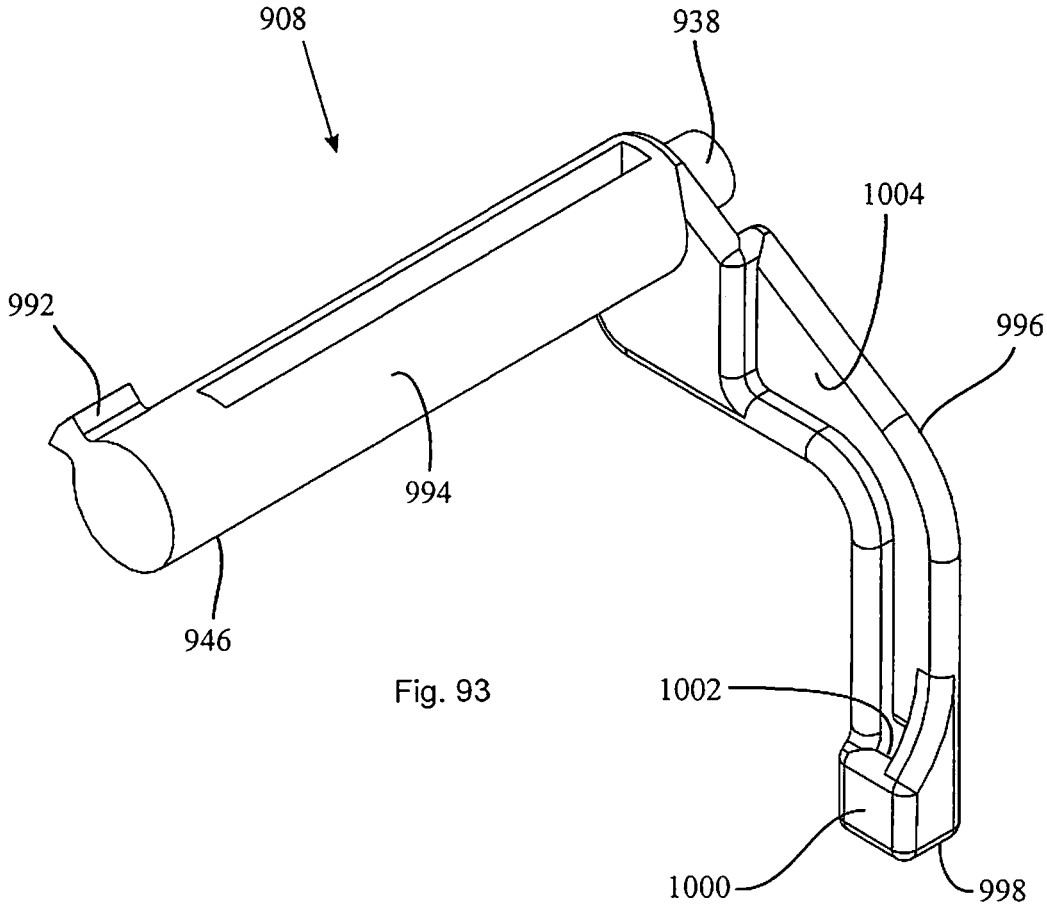
FIG. 93 is a perspective view of the release arm for the gearless spring clamp brake of FIG. 80.

Referring now to FIG. 93, the release arm 908 is roughly "L" shaped. One arm 994 has a stub shaft 938 at its first end, which rests on the flange 936 (See FIG. 87) of the housing 904, and the other end 946 rests on the "U" shaped support 942 of the housing 904, allowing rotation of the release arm 908 about its longitudinal axis. As already disclosed, a radially-extending, actuator projection 992 is located at this second end 946 of the release arm 908.

The second arm 996 of the release arm 908 extends substantially perpendicular to the axis of rotation of the release arm 908, connects to the first end 938 of the first arm 994, and then defines a sweeping downward turn before reaching the second end 998 of the second arm 996. Proximate this second end 998, the arm 996 defines a saddle 1000 and a through opening 1002 in the saddle 1000 through which the drive cord 848 is routed (as seen in FIG. 79). The drive cord 848 rides inside an open cavity 1004.

Gearless Spring Clamp Brake Assembly and Operation

Referring back to FIG. 81, the release arm 908 is installed in the trough 930 with the second arm 996 extending through the opening 924 in the housing 904. The first end 938 is supported by the flange 936, while the second end 946 is supported by the "U"-shaped support 942.

Figure 85:
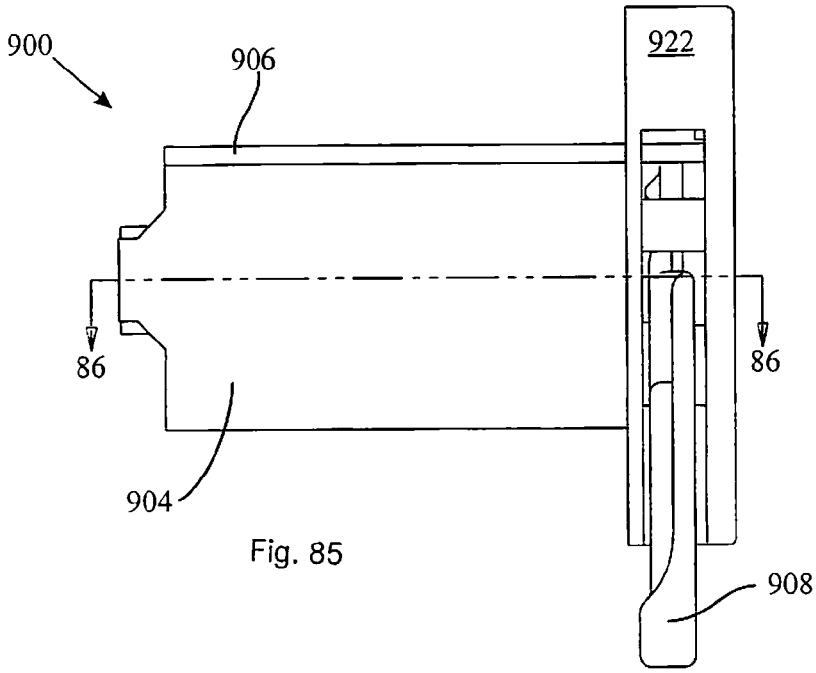
FIG. 85 is a view along line 85-85 of FIG. 82.

The spring 954 mounts over the collar 966 of the drive shaft 912. The spool 910 also mounts over the drive shaft 912 such that the slotted opening 984 is proximate the second end 944, and the non-cylindrical internal profile 964 of the spool 910 engages the non-cylindrical profile 935 of the drive shaft 912. This drive shaft, spool, and spring assembly 912, 910, 914 is then installed in the trough 928 such that the spring 914 lies in the cavity 948, and the first end 954 of the spring 914 lies on the ledge 950. The cover 906 then snaps on top of the housing 904 to hold the assembly together, as seen in FIGS. 85 and 86.

Figure 83:
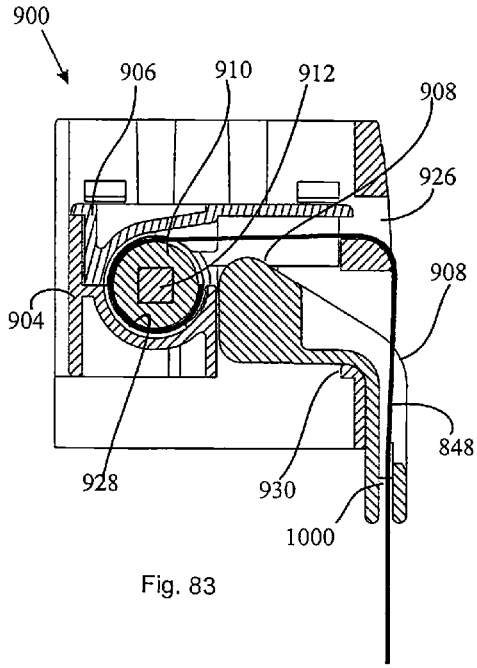
FIG. 83 is a view along line 83-83 of FIG. 82.

Prior to installing the shaft, spool, and spring assembly 912, 910, 914 in the housing 904, one end of the drive cord 848 is threaded through the opening 1002 in the saddle 1000 of the release arm 908. As shown in FIG. 83, the drive cord 848 extends partially through the open cavity 1004 of the release arm (See FIG. 93), through the opening 926, and into the housing 904. An enlargement, such as a knot, is tied to the end of the drive cord 848 and slipped behind the slotted opening 984 of the spool 910 to attach the drive cord 848 to the gearless spring brake 900.

Figure 84A:
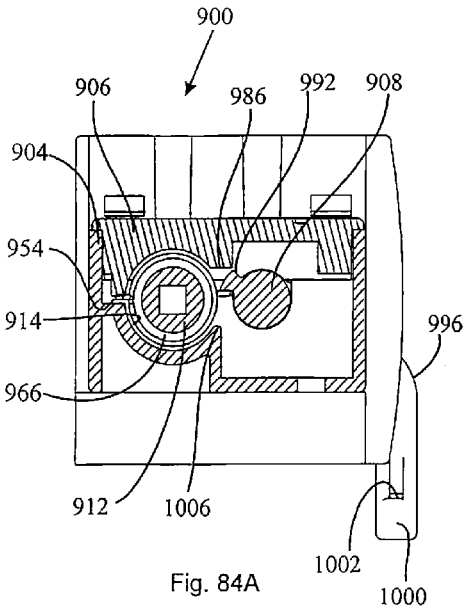
FIG. 84A is a view along line 84A-84A of FIG. 82 with the release arm at rest and the brake engaged.
Figure 84B:
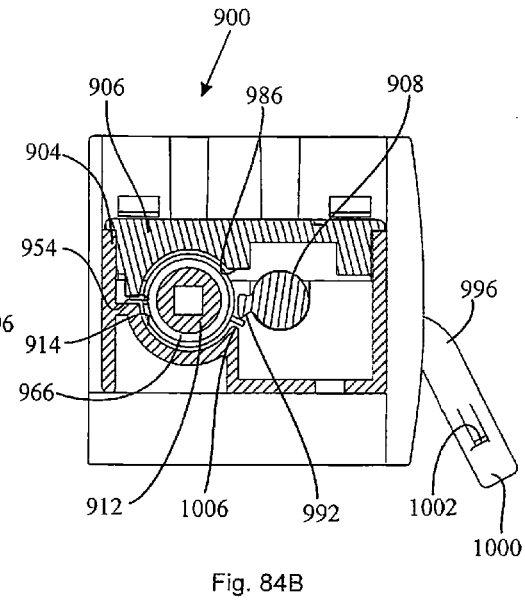
FIG. 84B is the same as FIG. 84A but showing the release arm pivoted out such that the brake is disengaged.

Referring briefly to FIG. 84A, the projection 992 of the release arm 908 rests above and against the second end 986 of the spring 914 such that counter-clockwise rotation (as shown in FIGS. 84A and 84B) of the release arm 908 results in the projection 992 pushing down on the end 986 of the spring 914. The limit stop 1006 on the housing 904 limits the rotation of the release arm 908 in the counter-clockwise direction.

As the release arm 908 rotates counterclockwise about its longitudinal axis of rotation, the first end 954 of the spring 914 remains stationary (trapped between the ledges 950 and 952 of the housing 904, and cover 906, respectively), while the second end 986 of the spring 914 rotates clockwise, pushed by the projection 992 of the release arm 908, causing the spring 914 to become extended, increasing its effective inside diameter and, at the same time, creating a biasing force to rotate the release arm 908 back clockwise as the spring 914 returns to its natural relaxed condition. When the release arm 908 pushes down on the second end 986 of the spring 914, and the effective inside diameter of the spring 914 is thus increased, the inner surface 988 of the spring 914 separates from the collar 966, providing just enough clearance for the collar 966 (and thus the drive shaft 912) to rotate.

When the release arm 908 rotates clockwise such that it is no longer pushing down on the second end 918 of the spring 914, the spring returns to its natural "relaxed" state, the inner surface 988 of the spring 914 collapses back and clamps back onto the collar 966, providing sufficient friction to impede rotation of the collar 966 (and thus also of the drive shaft 912).

The operation of the shade 900 of FIG. 79 with the gearless spring clamp brake 902 is very similar to the operation of the shade 854 (See FIG. 78) with the spring clamp brake 500'. When the user pulls forward on the drive cord 848, the drive cord 848 pulls on the arm 996 of the release arm 908, rotating it counter-clockwise about its longitudinal axis of rotation, and the projection 992 engages the second end 986 of the spring 914, thus expanding the spring 914. As the spring 914 is expanded, its effective inside diameter is increased to the point where it disengages from the collar 966 of the drive shaft 912, allowing the drive shaft 912 and the drive cord spool 910 to rotate freely about the longitudinal axis of rotation of the drive shaft 912.

If the user also pulls down on the drive cord 848, the drive cord 848 unwinds from the spool 910 which rotates clockwise together with the drive shaft 912 and the lift rod 840' which is engaged to the drive shaft 912 via the non-cylindrical cavity 970. The lift stations 838' also rotate with the lift rod 840', winding the lift cords (not shown) onto the lift stations, thus raising the shade 900. If the user eases up on the tension on the drive cord 848 but does not completely release the drive cord 848 such that the release arm 938 is still rotated forward, the gearless spring clamp brake 902 remains disengaged, and the drive cord 848 winds up onto the drive cord spool 910 as the drive cord spool 910 and the drive shaft 912 rotate counter-clockwise together with the lift rod 840', rotating the lift stations 838', thus lowering the shade 900, impelled by the force of gravity acting to close the shade 900.

As soon as the user releases the drive cord 848, the release arm 908 is pushed back by the spring 914 as the spring 914 returns to its relaxed state. The inside diameter of the spring 914 contracts slightly, back to its uncompressed state, and the inside surface 988 of the spring 914 presses against the collar 966 of the drive shaft 912, preventing any rotation of the drive shaft and drive spool assembly 912, 910. This brings the entire assembly to a full stop until the spring clamp brake 900 is once again released by the user.

It will be obvious to those skilled in the art that modifications may be made to the embodiments described above without departing from the scope of the present invention. For instance, all of the embodiments have depicted the brake devices on the right end of the shades (thus called the control-end) and the tilt assist devices on the left end of the shades (called the idler-end). The position of these devices could be switched, or any of the tilt assist devices can be mounted on the same end as any of the brake devices. The support shaft for the brake could also be used to support and journal a tilt assist mechanism. In fact, the two types of component structures could be married into a single combined brake and tilt assist device, providing a single drive end, with a support and skew adjustment mechanism for the rotator rail at the idler-end.

What is claimed is:

1. An automatic brake mechanism for a cord drive, comprising:

a drive cord spool mounted for rotation in a first direction and in a second direction about a first shaft defining a first axis of rotation;

a drive cord including first and second ends, wherein said first end is secured to said drive cord spool;

a release arm mounted for rotation in a first direction and in a second direction about said first axis of rotation;

a spring defining a relaxed position and having a first end attached to said first shaft and a second end attached to said release arm, and defining an outer circumference of said spring wherein said outer circumference is reduced when said first end of said spring is brought toward said second end of said spring, and wherein said spring engages said drive cord spool to stop rotation of said drive cord spool when said release arm is rotated in one of said first and second directions;

wherein the rotation of said release arm in one of said first and second directions about said first axis of rotation results in said first end of said spring being brought toward said second end of said spring; and wherein said drive cord spool defines an inner surface and said spring resides inside said inner surface such that, when said first end of said spring is brought toward said second end of said spring such that said outer circumference of said spring is reduced, said spring releases said inner surface of said drive cord spool allowing rotation of said drive cord spool about said first axis of rotation, and when said spring is back at said relaxed position said outer circumference of said spring engages said inner surface of said drive cord spool, preventing further rotation of said drive cord spool about said first axis of rotation;

a spring actuator mounted for rotation in a first direction and in a second direction about said first axis of rotation; and a transform gear mounted for rotation in a first direction and in a second direction about a second shaft defining a second axis of rotation wherein said transform gear engages said release arm and said spring actuator such that rotation in one of said first and second directions of said release arm about said first axis of rotation results in rotation of said actuator arm in an opposite direction from that of said release arm, and wherein said first end of said spring is attached to said spring actuator wherein rotation of said spring actuator in one of said first and second directions about said first axis moves said first end of said spring toward said second end of said spring.

2. An automatic brake mechanism for a cord drive as recited in claim 1, and further comprising an end cap including said first shaft and said second shaft wherein said shafts are substantially parallel to each other, and wherein said end cap further includes a limit stop which limits rotation of said release arm in one of said first and second directions and which limits rotation of said spring actuator in one of said first and second directions.

3. An automatic brake mechanism for a cord drive as recited in claim 2, wherein said release arm further comprises a means for slidably securing said drive cord to said release arm such that when said second end of said drive cord is pulled, said release arm rotates in one of said first and second directions about said first axis of rotation.

4. An automatic brake mechanism for a cord drive as recited in claim 3, wherein said means for slidably securing said drive cord to said release arm comprises a handle on said arm and an opening through said handle for threading said drive cord through said arm.

5. An automatic brake mechanism for a cord drive as recited in claim 4, wherein said drive cord spool includes means for attaching said first end of said drive cord to said drive cord spool at a point closest to the bottom of said drive cord spool when said drive cord is fully unwound from said drive cord spool.

6. An automatic brake mechanism for a cord drive as recited in claim 5, wherein said means for attaching said first end of said drive cord to said drive cord spool comprises a plurality of openings radially disposed around said drive cord spool.

7. An automatic brake mechanism for a cord drive as recited in claim 6, and further comprising:

a rotator rail mounted for rotation about a rail axis; and at least one opening radially disposed around said drive cord spool and wherein said drive cord spool is mounted onto said rotator rail such that said first end of said drive cord is attached to said drive cord spool at said point closest to the bottom of said drive cord spool when said drive cord is fully unwound from said drive cord spool.

8. An automatic brake mechanism for a cord drive as recited in claim 7 wherein said drive cord spool further comprises a spool segment and a rotator rail adapter segment wherein said spool and adapter segments are adjustably engaged for joint rotation and wherein said drive cord is attached to said spool segment and said rotator rail is secured to said adapter segment.

* * * * *

UNITED STATES PATENT AND TRADEMARK OFFICE

CERTIFICATE OF CORRECTION

PATENT NO. : 8,418,742 B2
APPLICATION NO. : 12/906341
DATED : April 16, 2013
INVENTOR(S) : Anderson et al.

It is certified that error appears in the above-identified patent and that said Letters Patent is hereby corrected as shown below:

In the Specification

In column 7, lines 53 and 59 and in column 11, line 38, delete "1288" and insert therefor --128B--.

In column 9, line 53 and in column 11, line 38, delete "1888" and insert therefor --188B--.

Signed and Sealed this
Fifteenth Day of October, 2013

Teresa Stanek Rea
*Deputy Director of the United States Patent and Trademark Office*